US006730448B2

(12) United States Patent
Yoshino et al.

(10) Patent No.: US 6,730,448 B2
(45) Date of Patent: May 4, 2004

(54) IMAGE FORMING METHOD, PROCESS CARTRIDGE AND IMAGE FORMING APPARATUS

(75) Inventors: Susumu Yoshino, Minamiashigara (JP); Koutarou Yoshihara, Minamiashigara (JP); Masahiko Hodumi, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 45 days.

(21) Appl. No.: 10/227,447

(22) Filed: Aug. 26, 2002

(65) Prior Publication Data

US 2003/0190546 A1 Oct. 9, 2003

(30) Foreign Application Priority Data

Aug. 28, 2001 (JP) ..... 2001-258499

(51) Int. Cl.[7] ..... G03G 15/04

(52) U.S. Cl. ..... 430/66; 430/124; 430/126; 430/58.2; 399/159

(58) Field of Search ..... 430/124, 126, 430/66, 58.2; 399/159

(56) References Cited

U.S. PATENT DOCUMENTS 5,116,703 A 5/1992 Badesha et al.

FOREIGN PATENT DOCUMENTS

| | | |
|---|---|---|
| JP | A 61-238062 | 10/1986 |
| JP | A 62-108260 | 5/1987 |
| JP | A 2-166461 | 6/1990 |
| JP | A 4-273252 | 9/1992 |
| JP | A 4-346356 | 12/1992 |
| JP | A 5-188630 | 7/1993 |
| JP | B2 2575536 | 10/1996 |
| JP | A 9-190004 | 7/1997 |
| JP | A 11-38656 | 2/1999 |
| JP | A 11-184106 | 7/1999 |
| JP | A 11-316468 | 11/1999 |
| JP | A 2001-5207 | 1/2001 |

OTHER PUBLICATIONS

Weiss, D.S., et al., "Analysis of Electrostatic Latent Image Blurring Caused by Photoreceptor Surface Treatments," Proceedings of IS&T's Eleventh International Congress on Advances in Non–Impact Printing Technologies, pp. 57–59.

*Primary Examiner*—Mark A. Chapman
(74) *Attorney, Agent, or Firm*—Oliff & Berridge, PLC

(57) ABSTRACT

An image forming method, a process cartridge, and an image forming apparatus are provided, with which an electrophotographic image that has superior image quality, superior fixing ability and remains good even in a hot and humid environment is obtainable. The image forming method includes: developing, with a developing agent, an electrostatic latent image formed on a surface of a photoreceptor to form a toner image; transferring the toner image onto an image receiving member to form a transfer image; and fixing the transferred image onto the image receiving member to form an image, wherein the photoreceptor includes a layer that contains a siloxane compound having charge-transferability and a crosslinking structure, with a compound having acid-adsorbing ability being supplied to the surface of the photoreceptor. The process cartridge and the image forming apparatus are used in the image forming method.

18 Claims, 4 Drawing Sheets

IMAGE FORMING METHOD, PROCESS CARTRIDGE AND IMAGE FORMING APPARATUS

BACKGROUND OF THE INVENTION

1. Field of the Invention

The present invention relates to an image forming method utilizing electrophotography and electrostatic recording, to a process cartridge and to an image forming apparatus. In particular, the present invention relates to an image forming method, a process cartridge and an image forming apparatus using a compound having an acid-adsorbing ability.

2. Description of the Related Art

The Karlson method has been generally used when an image is formed in copier or a laser beam printer. In conventional image forming methods, an image is formed by developing an electrostatic latent image formed on a photoreceptor by optical means, transferring the electrostatic latent image to an image receiving member such as recording paper, and next fixing to the image receiving member using heat and pressure. Because the photoreceptor is used repeatedly, a cleaning device is disposed to remove residual toner left on the photoreceptor after the transfer.

A structure referred to as a function-separating type, in which a charge generation layer is isolated from a charge transfer layer, has been devised and put to practical use in recent years as an electrophotographic photoreceptor in view of sensitivity and stability. Electrophotographic photoreceptors having such a structure comprise two layers consisting of a charge generation layer, which is produced by binding a charge generation material using a suitable resin as a binding material (binder resin), and a charge transfer layer, which is produced by dispersing or dissolving a charge transfer material in a binder resin. The layer containing a charge transfer material contains a positive hole transfer material in many cases. As the binder resin, thermoplastic resins such as polycarbonate resins, polyester resins, acryl resins and polystyrene resins, and heat-curable resins such as polyurethane resins and epoxy resins are under study.

In this case, the surface of the charge transfer layer must be negatively charged by corona charging or roller charging. This gives rise to problems in that the characteristics of the photoreceptor are adversely affected due to various causes, such as resin deterioration caused by ozone generated when the charge surface layer is negatively charged, wear, reduced sensitivity and reduced charging ability caused by the electrical impact of discharging at the photoreceptor surface, and mechanical breakdown resulting from friction during subsequent toner development, transfer to paper, and cleaning.

Various studies such as those listed below have been made in relation to the foregoing problems. Attempts have made to blend a polysiloxane resin with a copolymer component or other resins, and studies have been made with respect to improve the quality, life and cleaning characteristics of photoreceptors using the characteristics of polysiloxane, as can be seen in Japanese Patent Application Laid-open (JP-A) No. 61-238062, which discloses a photoreceptor that uses a heat-curable resin containing a polysiloxane resin for a charge transfer layer; in JP-A No. 62-108260, which discloses a photoreceptor including a protective layer containing a polysiloxane resin; in JP-A No. 4-346356, which discloses a photoreceptor disposed with a protective layer formed by dispersing silica gel, a urethane resin or a fluororesin in a heat-curable polysiloxane resin; and in JP-A No. 4-273252, which discloses a photoreceptor in which a resin obtained by dispersing a heat-curable polysiloxane resin in a thermoplastic resin is used for a protective layer or as a charge transfer binder resin.

Although polysiloxane has excellent thermal and mechanical strength, it is quite incompatible with organic compounds that function as electronic devices. For this reason, studies have been with respect to photoreceptors in which a charge transfer material having an unsaturated bond is bound directly with polysiloxane such as poly(hydrogen methylsiloxane) to make a resin, which is used as a binder resin for a protective layer or charge transfer material (JP-A No. 8-319353); photoreceptors in which a thin film produced using a sol gel method is used as a protective layer (*Proceedings of IS & T's Eleventh International Congress on Advances in Non-Impact Printing Technologies,* pp. 57–59); and photoreceptors in which an organic silicon modified positive positive hole transfer compound obtained by directly introducing silicon having a hydrolyzable group into a charge transfer material is used for an electrophotographic photoreceptor (JP-A No. 9-190004). In the photoreceptors described in *Proceedings of IS & T's Eleventh International Congress on Advances in Non-Impact Printing Technologies,* pp. 57–59, and in JP Nos. 2575536 and 9-190004, a firm film is formed because siloxane forms a three-dimensional network. As a result, these photoreceptors have attracted considerable attention because mechanical strength is largely improved.

As disclosed in JP-A Nos. 11-38656, 11-184106 and 11-316468, we developed novel materials previously and demonstrated that these materials have superior characteristics. We found that when a series of these materials is used as the surface layer of an electrophotographic photoreceptor, the surface layer had overwhelmingly superior thermal and mechanical strength with respect to conventional surface layers, whereby deterioration of the surface layer caused by wear can be significantly reduced and longevity can be improved.

However, it was found that when the surface layer is used for a long period of time, especially in a humid environment, image defects including image flow are caused.

As a result of investigating the cause of this problem, the following is surmised. It is known that, when a photoreceptor is charged by charging means such as corona charging or a conductive roller, discharge products (active products) such as ozone and NOx are produced in the process. Ozone and NOx produced in the above step not only pose a problem in terms of environmental sanitation, but they also act on the surface of the photoreceptor to increase potential fluctuation and residual potential, and impact photographic characteristics and images (e.g., image flow), thus reducing the durability of the photoreceptor. Therefore, the surface of the photoreceptor is occasionally denatured by the action of the ozone and NOx. Moreover, when the surface of the photoreceptor is hydrophilic, ozone and NOx adhere to the surface, whereby moisture in the atmosphere also tends to adhere to the surface, with the result being that electrical resistance of the surface is microscopically reduced and it is difficult to maintain the charge generated by the charging.

The surface of the photoreceptor comprising the aforementioned series of materials has overwhelmingly superior mechanical strength and significantly small abrasion loss. On the other hand, a conventional surface layer is abraded to some extent. Taking this phenomenon into account, it is surmised that a certain degree of abrasion of the surface layer can suppress the renewal of a deteriorated surface and the progress of the adhesion of products created by discharge. Accordingly, it is believed that it is difficult for the aforementioned phenomenon (suppression the adhesion of products created by discharging) to occur and easy for image defects such as image flow to be generated on a surface layer that has superior mechanical strength and small abrasion loss.

Various studies have been made to suppress these image defects. For instance, a method in which fine particles (abrasives) having an abrasive function are incorporated into a developing agent for the purpose of properly abrading the surface of a photoreceptor (JP-A No. 5-188630) and a method in which a thin film of a fatty acid metal salt is formed on the surface of a photoreceptor to protect the surface layer from adverse effects of discharge products (JP-A No. 2001-5207) have been proposed. Also, for example, a method in which a hydrotalcite compound that adsorbs anions is incorporated into a developing agent to remove discharge products (JP-A No. 2-166461) has been proposed.

However, if the particle diameter of an abrasive is small in the method in which the abrasive is used, abrasive loss is reduced because of small abrasive effects and image defects cannot be sufficiently suppressed. When the particle diameter is large, scratches are caused on the surface of the photoreceptor in the direction of rotation and lines resulting from these scratches appear on the image. Moreover, adhesion (contamination) of toner components resulting from these scratches progresses, and black points, white points and black lines resulting from the adhesion appear on the image.

In the method in which a thin film of a fatty acid metal salt is formed on the surface of a photoreceptor, the coefficient of friction decreases and cleanability is improved when the surface of the photoreceptor is cleaned in a cleaning step with a rubber blade such as a urethane blade. However, because the coefficient of friction with the photoreceptor having the surface layer resistant to abrasion rises, leading to a rise in the rotational torque of the photoreceptor, the blade end pressed to the photoreceptor is abraded or chipped, with the result being that black lines caused by cleaning inferiors appear on an image.

Moreover, in the method in which a hydrotalcite compound is incorporated into a developing agent to remove discharge products, adhesion (contamination) of the hydrotalcite compound resulting from irregularities and scratches caused by partial wear on the surface of the photoreceptor is easily caused, even though this method has initial effects. Therefore, black points, white points and black lines resulting from the adhesion appear on the image in the case of a conventional photoreceptor.

Methods of developing this electrostatic latent image include a one-component developing method, which uses only a toner, and a two-component developing method, which uses a toner and a carrier. In the case of a two-component developing agent in the two-component developing method, the toner and the carrier are stirred to frictionally charge the toner. Therefore, the amount of frictional charge of the toner can be controlled to a considerable extent by selecting carrier characteristics and stirring conditions. Thus, image quality is highly reliable and excellent.

The toner used in the electrophotographic process is usually produced by adding various resins (e.g., polyester resin, styrene-acryl resin, and epoxy resin), colorants, charge control agents, releasing agents and the like, and then melting, kneading, and uniformly dispersing the same, following by crushed the mixture into a predetermined grain size and removing excessively coarse powders and micropowders using a classifier. However, it has become necessary to further reduce toner grain size along with the demand for higher image quality in recent years. It has also, in view of the demand to reduce energy, become necessary to lower the transition temperature and softening point of resins in order to achieve fusing at lower temperatures.

With respect to color toners used in full-color copiers and printers, different color toners must be mixed sufficiently in a fusing step, and color reproducibility and the transparency of overhead projector (OHP) images are essential. Generally, these color toners are preferably formed using a sharp-melt low molecular resin in order to raise color-miscibility in comparison with black toner.

Conventionally, waxes such as polyethylene and polypropylene, which have high crystallinity and a relatively high melting point, are used,in black toner to obtain offset resistance for fusing. However, these waxes compromise the transparency of overhead projector images in full-color toner. For this reasons ordinary full-color toner contains no wax, and a method has been adopted in which silicon rubber or a fluororesin, which is highly releasable with respect to toner, is used to form,the surface of a heat-fusing roller, and a releasable liquid such as silicon oil is supplied to the surface to prevent offset. This method is very effective in terms of preventing the offset phenomenon of toner, but there is a problem in that it requires a device for supplying the offset-preventing liquid. This runs counter to the need to reduce the size and weight of copiers and printers. Moreover, the offset-preventing liquid exudes an unpleasant odor due to being vaporized by heat, and can sometimes contaminate the machine.

Therefore, studies are being made as to toners that are produced by a kneading and crushing method, comprise a sharp-melt resin, a colorant and a low-melting point wax, and have a small grain diameter. In this kneading and crushing method, a thermoplastic resin and the like are melted and kneaded together with a pigment, a charge control agent, a releasing agent such as wax; and then the melted and kneaded mixture is micronized and classified after being cooled to produce a desired toner.

However, in the case of a toner produced by the kneading and crushing method, generally its shape is undefined and its surface composition is not uniform. Although, in this method, the shape and surface composition of the toner are changed subtly corresponding to the crushing characteristics of materials to be used and conditions in a crushing step, it is difficult to control these characteristics in desired ranges intentionally. When the shape of the toner particles is undefined, only insufficient fluidity is obtained even if a fluidity adjuvant is added and fine particles of the fluidity adjuvant are moved to recesses in the toner particles and embedded in the recesses by mechanical force such as shearing force, giving rise to the problem that fluidity is lowered with time and developability, transferability and cleaning ability are impaired.

In light of this, studies being are made with respect to a suspension polymerization method and an emulsion polymerization coagulation method as methods for producing spherical toners that cannot be easily obtained by the above kneading and crushing method.

In the suspension polymerization method, a polymerizable monomer is dispersed in an aqueous medium together with a colorant and a releasing agent, and then the polymerizable monomer is polymerized to obtain a toner.

In the emulsion polymerization coagulation method, a resin dispersion is prepared by emulsion polymerization, and a colorant dispersion in which a colorant is dispersed in a solvent, and a dispersion in which a releasing agent is dispersed, are separately prepared. These dispersions are mixed to form coagulated particles having a particle diameter corresponding to that of a toner, and then fused by being heated to thereby obtain a toner. According to this emulsion polymerization coagulation method, the shape of toner particles can be arbitrarily controlled, from an undefined shape to a spherical shape, by selecting heating temperature conditions Studies are also being made with respect to a carrier having a small particle diameter in order to stably charge toner particles having a small particle diameter. These proceed from the fact that the surface area of the carrier must be increased, because the surface area of the toner particles increases when the toner particles have a small particle diameter. Additionally, a ferrite core having a smaller specific gravity than iron powder, a magnet-dispersion carrier containing a resin as a constitutional component, and a polymerized carrier are being studied. This is because the running torque of a developing machine can be made small by decreasing the mass of a developing agent.

SUMMARY OF THE INVENTION

It is an object of the present invention to provide an image forming method, a process cartridge and an image forming apparatus with which an electrophotographic image having superior image quality and fixing ability over a long period of time is obtainable.

It is also an object of the invention to provide an image forming method, a process cartridge and an image forming apparatus with which good cleaning characteristics are secured and an electrophotographic image that remains good even in a hot and humid environment is obtainable.

The above objects of the invention are attained by the invention shown below.

According to a first aspect of the invention, there is provided an image forming method comprising:

developing, with a developing agent, an electrostatic latent image formed on a surface of a photoreceptor to form a toner image;

transferring the toner image onto an image receiving member to form a transferred image; and fixing the transferred image onto the image receiving member to form an image, wherein the photoreceptor includes a layer that contains a siloxane compound having charge-transferability and a crosslinking structure, with a compound having acid-adsorbing ability being supplied to the surface of the photoreceptor.

According to a second aspect of the invention, there is provided an image forming method, wherein shape factors SF-1 and SF-2 of the toner respectively satisfy expressions (1) and (2), and the average particle diameter of the toner is 3 $\mu$m or more and 11 $\mu$m or less:

$$100 \leqq SF\text{-}1 \leqq 140 \quad (1)$$

$$100 \leqq SF\text{-}2 \leqq 120 \quad (2)$$

provided that SP-1=(maximum length of diameter)$^2\times100\pi/4$ and SF-2=(peripheral length of projected image)$^2\times100/4$).

According to a third aspect of the invention, there is provided a process cartridge used in the image forming method, the process cartridge comprising at least:

a photoreceptor including a layer that contains a siloxane compound having charge-transferability and a crosslinking structure; and supply means for supplying a compound having acid-adsorbing ability to a surface of the photoreceptor.

According to a fourth aspect of the invention, there is provided an image forming apparatus comprising a photoreceptor, latent image forming apparatus for forming an electrostatic latent image formed on a surface of the photoreceptor, a developing device for developing the latent image using a toner, and a transfer device for transferring the toner image to an image receiving member, wherein the photoreceptor includes at least a layer that contains a siloxane compound having charge-transferability and a crosslinking structure, and supply means for supplying a compound having acid-adsorbing ability to the surface of the photoreceptor.

According to a fifth aspect of the invention, there is provided an image forming apparatus, wherein shape factors SF-1 and SF-2 of the toner respectively satisfy expressions (1) and (2), and the average particle diameter of the toner is 3 $\mu$m or more and 11 $\mu$m or less:

$$100 \leqq SF\text{-}1 \leqq 140 \quad (1)$$

$$100 \leqq SF\text{-}2 \leqq 120 \quad (2)$$

provided that SF-1=(maximum length of diameter)$^2\times100\pi/4$ and SF-2=(peripheral length of projected image)$^2\times100/4$).

DESCRIPTION OF THE PREFERRED EMBODIMENTS

Figure 1:
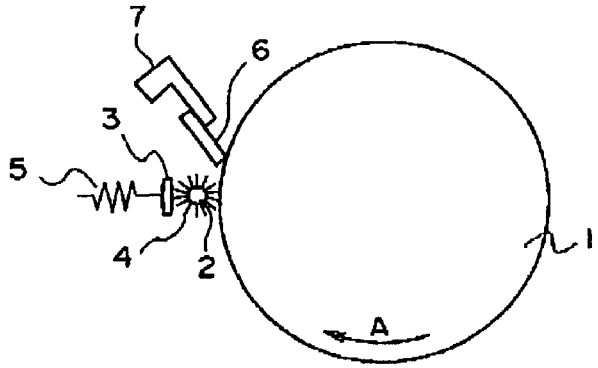
FIG. 1 is an explanatory view for explaining an embodiment in which a compound having acid-adsorbing ability is supplied to the surface of a photoreceptor.

An image forming method, a process cartridge and an image forming apparatus according to the present invention will be explained in detail hereinbelow by way of embodiments.

<Image Forming Method>

The image forming method of the invention comprises developing an electrostatic latent image, formed on the surface of a photoreceptor, by using a developing agent to form a toner image, transferring the toner image to an image receiving member to form a transferred image and fixing the transferred image to the image receiving member to form an image, wherein the photoreceptor is provided with a layer that contains a siloxane compound having charge-transferability and a crosslinking structure and a compound having acid-adsorbing ability is supplied to the surface of the photoreceptor to form an image.

It is to be noted that the surface of the photoreceptor provided with a layer that contains a siloxane compound having charge-transferability and a crosslinking structure means the whole or a part of a light-sensitive layer of the photoreceptor or a protective layer when the protective layer is formed on the surface of the light-sensitive layer.

The supplied compound having acid-adsorbing ability is preferably compounds having anion-exchangeability. Specifically, hydrotalcite compounds which are aluminum hydroxide/magnesium, magnesium silicate, aluminum silicate, magnesium oxide, magnesium hydroxide, magnesium carbonate, aluminum hydroxide/sodium bicarbonate coprecipitates and aluminum hydroxide/magnesium carbonate/calcium carbonate coprecipitates may be used. Among these compounds, hydrotalcite compounds are preferable and, particularly, hydrotalcite compounds having a layer structure are preferably used.

It is to be noted that the aforementioned "compound having acid-adsorbing ability" indicates a compound having the ability to adsorb an acid.

The hydrotalcite compound having a layer structure is a layer compound consisting of a positively charged $[Mg^{++}_{2(1-x)}Al^{+++}_{2x}(OH)_4]$ layer and a negatively charged $[CO_3^{2-}{}_{x}.mH_2O]$ layer and $CO_3^{2-}{}_{x}$ in the structure is ion-exchangeable and is known to be easily substituted for other anions to thereby adsorb an acid. The hydrotalcite compound may be represented by the following general formula.

$$Mg_{(1-x)}Al_x(OH)_2CO_{3x/2}.mH_2O \quad (0<x\leqq 0.5,\ m\text{: positive number})$$

Specific examples (structural general formulae) of the hydrotalcite compound represented by the above general formula may include $Mg_{0.7}Al_{0.3}(OH)_2(CO_3)_{0.15}.0.57H_2O$; $Mg_{0.8}Al_{0.2}(OH)_2(CO_3)_{0.10}.0.61H_2O$; $Mg_{0.75}Al_{0.25}(OH)_2(CO_3)_{0.125}.0.50H_2O$; $Mg_{0.8}Al_{0.2}(OH)_2(CO_3)_{0.10}.0.61H_2O$; and $Mg_{0.83}Al_{0.17}(OH)_2(CO_3)_{0.085}.0.47H_2O$.

As these materials, commercially available materials may be used. With regard to a method of producing a Mg—Al hydrotalcite compound, the compound may be produced by a known production method as described in each of Japanese Patent Application Publication (JP-B) Nos. 47-32918, 50-30039, 51-29129 and 4-73457. For example, Mg; a chloride or nitrate or nitrate solution or hydroxide of a divalent metal (one type among Zn, Cu and Ni) as required; a chloride or nitrate or nitrate solution of Al or a sodium aluminate solution; and an alkali solution are used to run a reaction, thereby synthesizing a Mg—Al hydrotalcite compound slurry retaining, for example, a sulfuric acid ion, carbonic acid ion, chlorine ion or nitric acid ion between layers.

Next, the synthesized Mg—Al hydrotalcite compound slurry is subjected to a hydrothermal process performed in an aqueous medium under the condition of a temperature of about 120° C. to 250° C. for about 1 to about 40 hours to prepare a Mg—Al hydrotalcite compound slurry of which the average secondary particle diameter and BET specific surface area are adjusted.

The obtained Mg—Al hydrotalcite compound slurry (excluding a carbonic acid ion type) is mixed with a solution containing a silicon type, phosphorous type and boron type oxyacid ion to make an exchange of ions during synthesis between the anion and the silicon type, phosphorous type and boron type oxyacid ion, whereby a hydrotalcite compound which retains, for example, the anion and at least one anion among a sulfuric acid ion, carbonic acid ion, chlorine ion and nitric acid ion and of which the average secondary particle diameter and BET specific surface area are adjusted can be produced.

In the case of supplying the compound having acid-adsorbing ability such as a hydrotalcite compound to the surface of the photoreceptor, it is preferable to apply a method (1) or a method (2) explained below.

(Method (1))

In the method (1), the compound having acid-adsorbing ability is supplied before the surface of the photoreceptor is uniformly electrified again after the toner image is transferred to the surface of the image receiving member from the surface of the photoreceptor. As to a specific supply means, it is preferable to dispose a cleaning auxiliary member to thereby supply the compound having acid-adsorbing ability through the cleaning auxiliary member.

In the case of the method (1), various structures are considered as the cleaning auxiliary member. For example, there is a method in which a solid member containing the compound having acid-adsorbing ability is used as a flicker of a brush roller. The content of the compound having acid-adsorbing ability at this time is preferably designed to be 10 mass % or more. When the content is less than 10 mass %, the ability to remove discharge products stuck to the surface layer of the photoreceptor is so low that only insufficient effect is occasionally obtained. Particularly, it is preferable to constitute the flicker only by the compound having acid-adsorbing ability.

When components other than the compound having acid-adsorbing ability are added, any of inorganic compounds and organic compounds may be used. Examples of these compounds include resins such as PMMA, cerium oxide, strontium titanate and others including known compounds as toner additives.

FIG. 1 shows an explanatory view for explaining an example in which a solid member of the compound having acid-adsorbing ability is used as a flicker of a brush roller and supplied to the surface of the photoreceptor.

In the example shown in FIG. 1, a cleaning blade 6 aligned at a fixed position by a cleaning blade-aligning member 7 and a brush roller 4 are brought into contact with a photoreceptor 1. The brush roller 4 is disposed in front of the cleaning blade 6 (the upstream side in the direction A of the rotation of the photoreceptor 1) and is also brought into contact with a flicker 3 which is aligned at a fixed position by a brush aligning roller 5 disposed at a position facing the photoreceptor 1.

It is most preferable that the cleaning blade 6 be made of urethane rubber and, particularly, polyurethane rubber having an impact resistance of 20 to 60 (under the condition of 20° C. and 50±5% RH). When the impact resistance is 20 or less, only insufficient cleaning ability is obtained whereas when the impact resistance exceeds 60, the blade tends to be torn off (the material properties of urethane rubber accord to JIS-K6301:1995).

The shape of the flicker 3 used as the supply means for supplying the compound having acid-adsorbing ability to the surface of the photoreceptor may be selected arbitrarily according to working conditions and any one of a bar-like form, plate-like form and the like may be used.

Also, as to the size of the flicker 3, it is desirable that the thickness be 3 to 20 mm, the longitudinal length be 5 to 20 mm and the lateral length be shorter than the longitudinal length by 0 to 50 mm in the case of the plate form. Also, it is preferable that the diameter be 3 to 20 mm and the length be shorter than the length of the photoreceptor by 0 to 50 mm in the case of the bar form.

Moreover, no particular limitation is imposed on a method of molding a supply means such as the flicker 3 as far as a desired shape is obtained and the supply means may be molded by compression molding or the like.

When the photoreceptor 1 is rotated in the direction of the arrow A on the figure, the brush roller 4 is rotated in a direction opposite or forward to the photoreceptor 1 by the rotary driving force of the photoreceptor 1. By the rotation of the brush roller 4, the flicker 3 is abraded and a powder of the abraded flicker 3 adheres to the brush of the brush roller 4. The attached powder of the flicker 3 is fed to the photoreceptor 1 by the rotation and adheres to the photoreceptor 1. Because the powder of the flicker 3 stuck to the photoreceptor 1 has acid-adsorbing ability, it serves to stick ozone, NOx and the like generated by discharging and the like to the surface of the photoreceptor 1. As a result, the products caused by discharging on the surface of the photoreceptor 1 can be removed efficiently. Also, such an effect ensures that a high quality electrophotographic image can be obtained over a long period of time even if the photoreceptor 1 is used under a high temperature and highly wet environment.

Also, as a method other than the above methods, a solution in which the compound having acid-adsorbing ability is dissolved or dispersed is made to sink into meshes of woven fabric and the resulting woven fabric may be brought into contact with the surface of the photoreceptor as a web roller instead of the brush roller 4 of FIG. 1. In such a method, tho same effect is obtained.

(Method 2)

In the method (2), the compound having acid-adsorbing ability is added to a developing agent containing a toner which will be explained later and the compound having acid-adsorbing ability is supplied together with the toner with dispersing it on the surface of the photoreceptor when the toner image is formed.

Such a structure makes it possible to remove products caused by discharging in an efficient manner due to the foregoing acid-adsorbing ability because the compound having acid-adsorbing ability is also fed to the surface of the photoreceptor 1 when the electrostatic latent image formed on the surface of the photoreceptor 1 is developed by the toner. Accordingly, even if the photoreceptor 1 is used under a high temperature and highly wet environment, a high quality electrophotographic image can be obtained over a long period of time. Also, since it is only required to add the compound having acid-adsorbing ability in a developing agent, it is unnecessary to incorporate a newly complicated system and this method may be therefore applied easily to currently used apparatuses.

The mixing ratio by mass of the toner to the compound having acid-adsorbing ability (toner/compound having acid-adsorbing ability) is preferably 100/0.05 to 100/3 and more preferably 100/0.1 to 100/0.5.

When the ratio is less than 100/0.05, there is the case where the ability to remove the products caused by discharging which products adhere to the surface layer of the photoreceptor is so weak that only insufficient effect is obtained whereas when the ratio is greater than 100/3, the chargeability of the toner is fluctuated because of the chargeability of the compound. For example, negatively chargeable toners are largely decreased in the amount of charge, affording opportunity for causing defects such as contamination inside of the system and the generation of fogging on a print or copy image.

The shape of the compound having acid-adsorbing ability is preferably a powder form and the volumetric average particle diameter of this powder is preferably 0.05 to 3 $\mu$m and more preferably 0.1 to 0.7 $\mu$m. When this particle diameter is greater than 3 $\mu$m, the compound itself is freed of the toner to cause contamination inside of the system whereas when the particle diameter is smaller than 0.05 $\mu$m, the coagulability of the compound is strong, so that the compound cannot be dispersed uniformly on the surface of the toner and there is therefore the case where a desired effect cannot be obtained (Developer)

As the developing agent to be used in the image forming method of the invention, known developing agents such as one-component type developing agents constituted only of a toner and tow-component type developing agents constituted of a toner and a carrier may be used. Explanations of the developing agent will be furnished hereinbelow.

First, the toner is explained.

In full-color copying machines and printers which have been spread in recent years, there is, for example, the problem that it is required to install a system for supplying an offset-preventive liquid to a heat fixing roll or a fixing belt with the intention of preventing contamination and offset of the toner component in the fusing step. This is contrary to the needs for small-sizing and light-weighting. Also, there is the problem that the offset-preventive liquid is vaporized by heating to exude an offensive odor and also there is the case where it causes contamination in the system. Therefore, the toner preferably contains wax to obtain good fixing ability in the condition that substantially no offset-preventive liquid is present.

The wax is preferably melted at 70 to 140° C. and has a melt viscosity of preferably 1 to 200 cp and more preferably 1 to 100 cp.

When the melt temperature is less than 70° C., the transformation temperature of the wax is too low and there is therefore the case where the blocking resistance is deteriorated and the developing ability is impaired when the temperature of a copying machine is raised. When the melt temperature exceeds 140° C., the transformation temperature of the wax becomes too high and fixing,treatment must be therefore carried out, which is undesirable from the viewpoint of energy saving.

Also, the melt viscosity higher than 200 cp sometimes causes reduced elution from the toner and insufficient fixing releasability.

The amount of the wax to be added to the toner is 1 to 15 mass % and more preferably 3 to 10 mass % based on the toner particles (a binder resin and a colorant).

When the amount of the wax is less than 1 mass %, sufficient fixing latitude (the temperature range of a fixing roll or a fixing belt at which temperatures an image can be fixed without the offset of the toner) is not obtained. On the other hand, when the amount of the wax is greater than 15 mass %, the amount of the wax which is desorbed from the toner and freed is increased and contamination to the photoreceptor tends to be caused. Also, the powder fluidity of the toner is impaired and there is the case where the free wax adheres to the surface of the photoreceptor forming an electrostatic latent image and therefore the electrostatic latent image is not always formed exactly. Also, because wax is inferior in transparency to a binder resin and the transparency of an image such as an OHP image is reduced, resulting in the formation of a dark projected image.

As the wax, paraffin wax and its derivatives, montan wax and its derivatives, microcrystalline wax and its derivatives, Fisher-Tropsch wax and its derivatives and polyolefin wax and its derivatives may be used.

Here, the "derivatives" include oxides, polymers with a vinyl monomer and graft modified products.

Besides the above compounds, alcohols, fatty acids, vegetable waxes, animal waxes, mineral waxes, ester waxes and acid amides may be utilized.

As toner particles constituting the toner to be used in the image forming apparatus of the invention, a known one consisting of at least a colorant (coloring agent) and a binder resin is used.

When the toner is produced by a kneading and crushing method, examples of the binder resin may include homopolymers or copolymers of styrenes such as styrene and chlorostyrene; monoolefins such as ethylene, propylene, butylene and isoprene; vinyl esters such as vinyl acetate, vinyl propionate, vinyl benzoate and vinyl acetate; α-methylene aliphatic monocarboxylic acid esters such as methylacrylate, ethylacrylate, butylacrylate, dodecylacrylate, octylacrylate, phenylacrylate, methylmethacrylate, ethylmethacrylate, butylmethacrylate and dodecylmethacrylate; vinyl ethers such as vinyl methyl ether, vinyl ethyl ether and vinyl butyl ether; and vinyl ketones such as vinyl methyl ketone, vinyl hexyl ketone and vinyl isopropenyl ketone.

Particularly typical examples of the binder resin may include polystyrene, styrene/alkylacrylate copolymers, styrene/alkylmethacrylate copolymers, styrene/acrylonitrile copolymers, styrene/butadiene copolymers, styrene/maleic acid anhydride copolymers, polyethylene and polypropylene. Further, polyester, polyurethane, epoxyresins, siliconresins, polyamide, denatured rosin, paraffin and waxes may be exemplified.

Particularly, the case of using polyester among these compounds as the binder resin is effective. For example, a linear polyester resin comprising a polymerization condensation product containing bisphenol A and polyvalent aromatic carboxylic acid as major monomer components is desirably used.

The above polyester resin is synthesized by polymerization condensation from a polyol component and a polycarboxylic acid component.

Examples of the polyol component to be used include ethylene glycol, propylene glycol, 1,3-butanediol, 1,4-butanediol, 2,3-butanediol, diethylene glycol, triethylene glycol, 1,5-butanediol, 1,6-hexanediol, neopentyl glycol, cyclohexane dimethanol, hydrogenated bisphenol A, bisphenol-A ethylene oxide adducts and bisphenol-A propylene oxide adducts.

Examples of the polycarboxylic acid component include maleic acid, fumaric acid, phthalic acid, isophthalic acid, terephthalic acid, succinic:acid, dodecenylsuccinic acid, trimellitic acid, pyromellitic acid, cyclohexanetricarboxylic acid, 2,5,7-naphthalenetricarboxylic acid, 1,2,4-naphthalenetricarboxylic acid, 1,2,5-hexatricarboxylic acid, 1,3-dicarboxyl-2-methylenecarboxypropanetetramethylenecarboxylic acid and their anhydrides.

Among the above compounds, resins having a softening point of 90 to 150° C., a glass transition temperature of 55 to 75° C., a number average molecular weight of 2000 to 6000, a mass average molecular weight of 8000 to 150000, an acid value of 5 to 30 and a hydroxyl value of 5 to 40 may be used particularly preferably.

Also, as the colorant of the toner particle, carbon black, nigrosine, Aniline Blue, Chalcoil Blue, Chrome Yellow, Ultramarine Blue, Du Pond Oil Red, Quinoline Yellow, Methylene Blue chloride, Phthalocyanine Blue, Malachite Green•Oxalate, Lump Slack, Rose Bengale, C.I. Pigment•Red 48:1, C.I. Pigment•Red 122, C.I. Pigment•Red 57:1, C.I. Pigment•Red 238, C.I. Pigment•Yellow 97, C.I. Pigment•Yellow 12, C.I. Pigment•Yellow 180, C.I. Pigment•Blue 15:1 and C.I. Pigment•Blue 15:3 may be given as typical examples.

The toner may be constituted by compounding one or more additives such as a charge control agent used for charge control besides the toner particles (the binder resin and the colorants such as carbon black) and the foregoing wax. Also, a petroleum type resin may be contained to satisfy the crushing ability and thermal preserving ability of the toner.

The petroleum resin is those synthesized using, as starting material, diolefins and monoolefins contained in cracked oil fractions by-produced in an ethylene plant producing ethylene, propylene and the like by steam cracking of petroleums.

As a method for adding the above additives to the toner particles, a kneading treating method is preferably applied. The kneading treatment may be carried out using various heat kneading machines. As the heat kneading machine, a three-roll type, one-shaft screw type, two-shaft screw type and Banbury mixer type are known. However, the heat kneading machine is not limited to these types but known machines may be used.

Also, a method of producing the toner is optional.

The kneaded product is crushed using, for example, a micronizer, Ulmax, Jet-o-mizer, KTM(cryptone) and turbo mill. Further, an I-type Jet-Mill may be used. For classification, an elbow jet using a Coanda effect and air-separation type Acucut may be used. However, the classifier is not limited these types but known classifiers may be used.

The toner maybe produced by a polymerization method. The polymerization method primarily includes a suspension polymerization method and an,emulsion polymerization coagulation method. Particularly, the emulsion polymerization coagulation method is advantageous to control the shape of the toner particle because the shape of the toner can be arbitrarily controlled in a range from an undefined form to a spherical form by selecting the condition of heating temperature.

In the emulsion polymerization coagulation method, a resin dispersion is prepared by emulsion polymerization, a colorant dispersion in which a colorant is dispersed in a solvent and a releasing agent dispersion in which a releasing agent is dispersed in a solvent are prepared separately from the above resin dispersion and these dispersions are mixed to form coagulated particles having a particle diameter corresponding to that of the toner particle (coagulating step), followed by heating to unite (uniting step) to obtain toner particles.

It is to be noted that the resin dispersion is produced by dispersing resin particles made of at least resins used as the binder of the toner particles.

Given as examples of the resin in the above resin particles are thermoplastic resins. Specific examples of these thermoplastic resins include homopolymers or copolymers of styrenes such as styrene, parachlorostyrene and α-methylstyrene (styrene type resins); homopolymers and copolymers of esters having a vinyl group such as methylacrylate, ethylacrylate, n-propylacrylate, n-butylacrylate, laurylacrylate, 2-ethylhexylacrylate, methylmethacrylate, ethylmethacrylate, n-propylmethacrylate, laurylmethacrylate and 2-ethylhexylmethacrylate (vinyl type resins); homopolymers and copolymers of vinylnitriles such as acrylonitrile and methacrylonitrile (vinyl type resins); homopolymers and copolymers of vinyl ethers such as vinyl methyl ether and vinyl isobutyl ether (vinyl type resins); homopolymers and copolymers of ketones such as vinyl methyl ketons, vinyl ethyl ketone and vinyl isopropenyl ketone (vinyl type resins); homopolymers and copolymers of olefins such as ethylene, propylene, butadiene and isoprene (olefin type resins); non-vinyl condensed type resins such as epoxy resins, polyester resins, polyurethane resins, polyamide resins, cellulose resins and polyether resins and graft polymers of these non-vinyl condensed type resins and vinyl type monomers.

These resins may be used either singly or in combinations of two or more. The volumetric average particle diameter of the above resin particles is generally 1 μm or less and preferably 0.01 to 1 μm.

The above colorant dispersion is produced by dispersing at least a colorant.

Examples of the colorant include various pigments such as carbon black, Chrome Yellow, Hansa Yellow, Benzidine Yellow, Indanthrene Yellow, Quinoline Yellow, Permanent Orange GTR, Pyrazolone Orange, Vulcan Orange, Watchung Red, Permanent Red, Brilliant Carmine 3B, Brilliant Carmine 6B, Du Pont K.K. Oil Red, Pyrazolone Red, Lithol Red, Rhodamine B Lake, Lake Red C, Rose Bengale, Aniline Blue, ultramarine Blue, Chalcoil Blue, Methylene Blue Chloride, Phthalocyanine Blue, Phthalocyanine Green and malachite Green Oxalate; and various dyes such as an acridine type, xanthene type, azo type, benzoquinone type, azine type, anthraquinone type, dioxazine type, thiazine type, azomethine type, indigo type, thioindigo type, phthalocyanine type, aniline black type, polymethine type, triphenylmethane type, diphenylmethane type, thiazole type and xanthene type. These colorants may be used either singly or in combinations of two or more. The volumetric average particle diameter (hereinafter simply called "average particle diameter") of the colorant is generally 1 μm or less, preferably 0.5 μm or less and particularly preferably 0.01 to 0.5 μm.

The above releasing agent dispersion is produced by dispersing at least a releasing agent. The releasing agent to be used is preferably releasing agents having poor compatibility with the binder resin of the toner particle. Specific examples of the releasing agent include paraffin wax and its derivatives, montan wax and its derivatives, microcrystalline wax and its derivatives, Fisher-Tropsch wax and its derivatives and polyolefin wax and its derivatives.

Here, the foregoing derivatives include oxides, polymers with vinyl monomers and graft denatured products.

Besides the above compounds, alcohols, fatty acids, vegetable waxes, animal waxes, mineral waxes, ester waxes, acid amides and the like may be utilized. In the invention, these releasing agents may be used either singly or in combinations of two or more. The average particle diameter of the releasing agent particles is preferably 1 μm or less and more preferably 0.01 to 1 μm.

No particular limitation is imposed on the combination of the resin of the resin particles, the colorant and the releasing agent. A preferable combination may be freely selected optionally according to the object and used.

Also, other components (particles) such as internal additives, charge control agents, inorganic particles, organic particles, lubricants and abrasives maybe dispersed in at least one of the resin particle dispersion, the colorant dispersion and the releasing agent dispersion according to the purpose. In this case, other components (particles) may be dispersed in any one of the resin particle dispersion, the colorant dispersion and the releasing agent dispersion or a dispersion prepared by dispersing other components (particles) may be compounded in a mixed solution prepared by mixing the resin particle dispersion, the colorant dispersion and the releasing agent dispersion.

Given as examples of the dispersion media used for the resin particle dispersion, the colorant dispersion, the releasing agent dispersion and the other components are water-type media Examples of the water-type media include water such as distilled water and ion exchange water and alcohols. These media may be, used either singly or in combinations of two or more. Preferable examples of the combination include a combination of distilled water and ion exchange water. The addition of a surfactant is advantageous not only from the viewpoint of the stability of each dispersed particle of the resin particle dispersion, the colorant dispersion and the releasing agent dispersion in a water-type medium and therefore from the viewpoint of the preserving ability of these dispersions but also from the viewpoint of the stability of the coagulated particles in the coagulation step.

Also, rosin, rosin derivatives, coupling agents, high molecular dispersants and the like may be added as dispersants to be added to more stabilize the dispersion stability of the colorant in a water-type medium and to decrease the energy of the colorant in the toner.

The inorganic metal salt having di- or more-valent charge and used as the coagulant in the coagulation step is obtained by dissolving a usual inorganic metal compound or its polymer in a resin fine particle dispersion.

Here, the metal elements constituting the inorganic metal salt are those which have di- or more-valent charge, belong to 2A, 3A, 4A, 5A, 6A, 7A, 8, 1B, 2B and 3B groups in the periodic table (long periodic table) and dissolve in an ion state in the coagulated system of resin fine particles.

Examples of the inorganic metal salt include metal salts such as calcium chloride, calcium nitrate, barium chloride, magnesium chloride, zinc chloride, aluminum chloride and aluminum sulfate; and inorganic metal salt polymers such as aluminum polychloride, aluminum polyhydroxide and calcium polysulfide. Among these compounds, aluminum salts and polymers of these salts are preferable.

In the invention, it is preferable to add and mix a surfactant in a water-type medium in advance to improve the dispersion stability of coagulated particles.

There has been an increased demand for higher image quality in recent yeas and particularly in the formation of a color image, there is a significant tendency to develop smaller-sized toner particles having a more uniform particle diameter with the intention of attain a highly accurate image. However, when a toner particle is small-sized, force other than electrostatic force, for example, van der Waals force is made relatively high and there is the case where the transferability (transfer efficiency) is impaired. It is therefore necessary to prevent the transferability from being impaired. Therefore, the toner particle is preferably spherical to improve the transferability. Further, in the case of a spherical form, concave portions are reduced on the surface of the toner particle and the compound having acid-adsorbing ability and dispersed on its surface tends to exist in the concave portions. The probability that the compound having acid-adsorbing ability on the surface of the toner particles is in contact with the surface of the photoreceptor in a developing section is improved and the effect of removing products caused by discharging is therefore more improved. So the spherical form is desirable.

When a preferable shape of the toner particle is expressed by the shape factors SF-1 and SF-2, the following equations (1) and (2) are preferably fulfilled. It is to be noted that the following equations (1) and (2) are preferably fulfilled when the foregoing method (2) is applied.

$$100 \leqq SF\text{-}1 \leqq 140 \quad (1)$$

$$100 \leqq SF\text{-}2 \leqq 120 \quad (2)$$

$$SF\text{-}1 = (\text{maximum length of diameter})^2 \times 100\pi/4 \quad (1)$$

$$SF\text{-}2 = (\text{peripheral length of projected image})^2 \times 100/4) \quad (2)$$

When SF-1 is larger than 140 or SF-2 is larger than 120, there is the case where the transferability is impaired. A more preferable range is the following (3) and (4).

$$100 \leqq SF\text{-}1 \leqq 135 \quad (3)$$

$$100 \leqq SF\text{-}2 \leqq 117 \quad (4)$$

Also, the average particle diameter of the toner particle is preferably 3 to 11 μm to improve image quality. When the particle diameter is less than 3 μm, there is the case where the fluidity and transferability of the toner are impaired. When the particle diameter is larger than 11 μm, only insufficient image quality is obtained.

As the core material of the carrier in the case of using a two-component type developing agent, known iron powder, ferrite, magnetite and polymerized cores may be properly used. Among these materials, ferrite and polymer cores having a low specific gravity are preferable.

Examples of the resin used when a resin coating layer is formed on the core material include polyolefin type resins such as polyethylene and polypropylene; polyvinyl type resins and polyvinylidene type resins such as polystyrene, acryl resins, polyacrylonitrile, polyvinyl acetate, polyvinyl alcohol, polyvinylbutyral, polyvinyl chloride, polyvinylcarbazole, polyvinyl ether and polyvinyl ketone; vinyl chloride/vinyl acetate copolymers; styrene/acrylic acid copolymers; straight silicon resins comprising organosiloxane bonds and denatured products of these resins; fluororesins such as polytetrafluoroethylene, polyvinyl fluoride, polyvinylidene fluoride and polychlorotrifluoroethylene; polyesters; polyurethanes; polycarbonates; amino resins such as urea-formaldehyde resins; and epoxy resins. These resins maybe used either singly or by mixing plural resins. Fluororesins which are polymerized while including a fluorine type monomer containing a fluorine atom and have a small surface energy are preferable. The amount of resin coating on the surface of the core is 0.8 to 5 mass % and preferably 1.5 to 3.5 mass %.

The resistance of the whole of the magnetic carrier formed in the above manner when it is in the state of a magnetic brush is preferably $10^8$ to $10^{13}$ Ωcm under an electric field of $10^4$ V/cm. When the resistance of the magnetic carrier is less than $10^8$ Ωcm, the carrier adheres to the image portion on the surface of the photoreceptor, and also, a brush mark tends to appear. On the other hand, the resistance of the magnetic carrier exceeds $1\times10^{13}$ Ωcm, an edge effect becomes seen, causing reduced image qualities.

In order to make the resistance of the resin coating layer fall in the above range, a conductive powder may be added to the resin coating layer. As the conductive powder to be added to the resin coating layer, those having a resistance of $1\times10^6$ Ωcm or less are preferably used. Specific examples of these powders include carbon black, zinc oxide, titanium oxide, tin oxide, iron oxide and titanium black. The content of the conductive powder is generally 3 to 40 mass % and preferably 5 to 20 mass % based on all coating amount.

Here, the volumetric specific resistance (resistance of the resin coating layer) is preferably measured in the following manner.

First, the samples are placed in such a manner as to form a flat layer about 1 mm to 3 mm in thickness on the under pole plate of a measuring jig which is a pair of circular pole plates (made of copper) having an area of 20 $cm^2$ which plates are connected to an electrometer (trademark: KEITHLEY 610C, manufactured by Keithley Instruments, Inc.) and a high tension power source (trademark: FLUKE 415B, manufactured by Fluke Corp.). Then, the upper pole plate is placed on the samples and thereafter a 4 kg weight is put on the upper pole plate to eliminate clearances between each sample. In this condition, the thickness of the sample layer is measured. Then, the value of current is measured by applying voltage to both pole plates to calculate the volumetric specific resistance based on the following general formula.

$$\text{Volumetric specific resistance} = \text{Applied voltage} \times 20 \div (\text{Current} - \text{Initial current}) \div \text{Thickness of Sample}$$

where the "Initial current" indicates the value of current when the applied voltage is 0 and the "Current" indicates the value of current measured.

Examples of a method for forming the resin coating layer on the surface of the core material include a dipping method in which the core material is dipped in a resin coating layer-forming solution prepared by dispersing a conductive powder in a solvent in which a resin is dissolved, a spray method in which a resin coating layer-forming solution is sprayed on the surface of the core material, a fluidized bed method in which a resin coating layer-forming solution is sprayed on the surface of the core material which is put in a floated state by flowing air and a kneader coater method in which the core material and a resin coating layer-forming solution are mixed in a kneader coater, followed by removing solvents. No particular limitation is imposed on the solvent used for the resin coating layer-forming solution as far as it dissolves the resin. For example, aromatic hydrocarbons such as toluene and xylene; ketones such as acetone and methyl ethyl ketone; and ethers such as tetrahydrofuran and dioxane may be used. A sand mill, a homomixer or the like may be used for the dispersion of the conductive powder.

An inorganic powder and a resin powder may be used either respectively or in combination to more improve the long term preserving ability, fluidity, developing ability and transferability of the toner.

Examples of the inorganic powder include carbon black, silica, alumina, titania and zinc oxide.

Examples of the resin powder include spherical particles of PMMA, nylon, melamine, benzoguanamine, fluorine types and the like and amorphous powders of vinylidene chloride, fatty acid metal salts and the like. The amount of each powder to be added is 0.1 to 4 mass % and more preferably 0.3 to 3 mass % based on the mass of the toner.

(Photoreceptor)

As mentioned above, when a hydrotalcite compound is used as the compound having acid-adsorbing ability, the adhesion (contamination) of the hydrotalcite compound which adhesion is originated from irregularities and scratches caused by partial wear on the surface of the photoreceptor is easily caused and therefore such a defect that black points, white points and black lines originated from that adhesion appear on an image tends to be caused in the case of a conventional photoreceptor type.

For this, in the image forming method of the invention, the photoreceptor provided with the layer having charge-transferability and containing a siloxane compound having a crosslinking structure is used.

The details of the photoreceptor will be explained hereinbelow.

Figure 2:
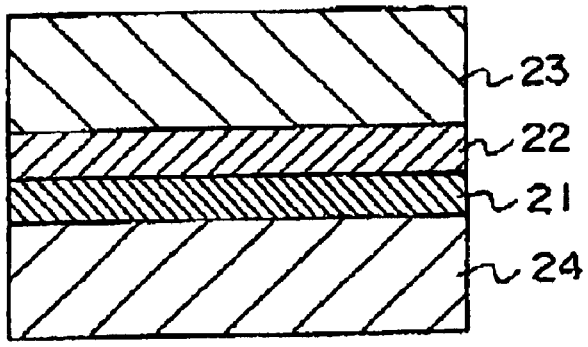
FIG. 2 is a sectional view showing one example of the layer structure of a photoreceptor.
Figure 3:
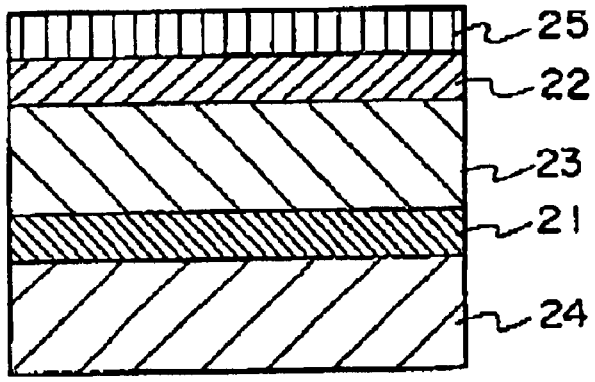
FIG. 3 is a sectional view showing another example of the layer structure of a photoreceptor.
Figure 4:
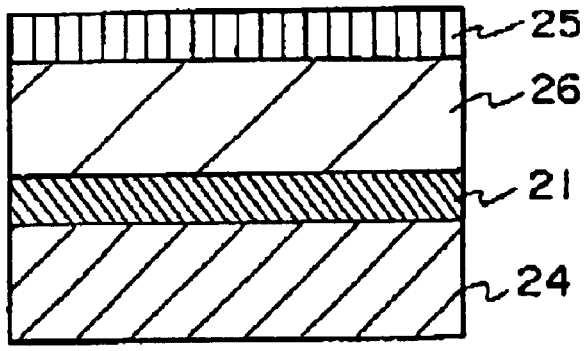
FIG. 4 is a sectional view showing still another example of the layer structure of a photoreceptor.
Figure 5:
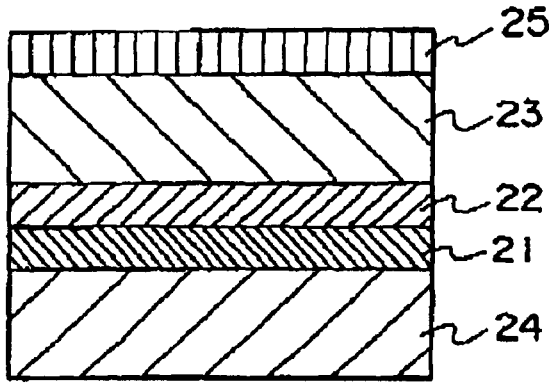
FIG. 5 is a sectional view showing a further example of the layer structure of a photoreceptor.
Figure 6:
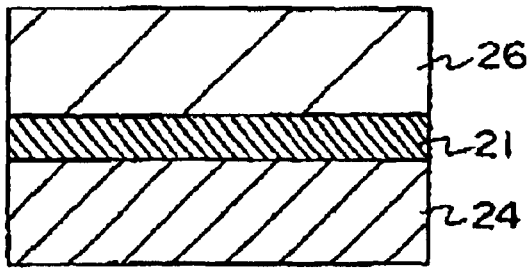
FIG. 6 is a sectional view showing a still further example of the layer structure of a photoreceptor.

FIG. 2 to FIG. 6 show typical sectional views of the photoreceptor used in the image forming method of the invention. FIG. 2 to FIG. 4 show the case where the light-sensitive layer has a laminate structure and FIG. 5 and FIG. 6 show the case where light-sensitive layer has a monolayer structure.

In the example of FIG. 2, an intermediate layer 21 is disposed on the surface of a conductive support 24 and a charge generation layer 22 and a charge transfer layer 23 are disposed on the intermediate layer 21. The example of FIG. 3 has the same structure as the example of FIG. 2 except that a protective layer 25 is further formed on the charge transfer layer 23. In FIG. 4, an intermediate layer 21 is formed on the surface of the conductive support 24, a, charge transfer layer 23 and a charge generation layer 22 are disposed on the intermediate layer 21 and a protective layer 25 is further formed on the charge transfer layer 23. In FIG. 2 to FIG. 4, the intermediate layer may be formed or not formed.

The charge transfer layer 23 in the example of FIG. 2 and the protective layer 25 in FIG. 3 and FIG. 4 respectively correspond to the layer having charge transferability and containing a siloxane compound having a crosslinking structure.

In the example of FIG. 5, the intermediate layer 21 is disposed on the surface of the conductive support 24 and a charge generation/charge transfer layer 26 is disposed on the intermediate layer 21. The example of FIG. 6 has the same structure as the example of FIG. 5 except that a protective layer 25 is further formed on the surface.

The charge generation/charge transfer layer 26 in the example of FIG. 5 and the protective layer 25 in rig. 6 respectively correspond to the layer having charge-transferability and containing a siloxane compound having a crosslinking structure.

As the conductive support 24, those made of aluminum, SUS or the like and having a proper form such as a drum form, sheet form and plate form are used. However, the conductive support 24 is not limited to these materials.

The outer periphery of the conductive support 24 may be processed by anodic oxidation treatment to form an anodic oxide film as the intermediate layer 21. The anodic oxidation treatment in the case of using aluminum for the conductive support 24 may be performed by running anodic oxidation using the aluminum as the anode in an electrolytic solution, whereby an anodic oxide film can be formed on the surface. As the electrolytic solution used at this time, a sulfuric acid solution, oxalic acid solution or the like may be used.

In the meantime, the anodic oxide film as it stands is porous and chemically active and is therefore easily soiled and its resistance is largely fluctuated by environmental variation. It is therefore preferable to treat the oxide film by running a hydration reaction using pressure steam or in a boiled water (salts of metals such as nickel maybe added) to cause volumetric expansion and to convert the oxide into a more stable hydrate oxide, thereby carrying out pore-sealing treatment for sealing micropores of the oxide film.

The film thickness of the anodic oxide film is preferably 0.3 to 15 $\mu$m. When the film thickness is less than 0.3 $\mu$m, the barrier characteristics against intrusion is so poor that only insufficient effect is obtained. On the other hand, a film thickness exceeding 15 $\mu$m causes a rise of residual potential in repeated use.

In addition, the anodic oxide film may be processed by acid solution treatment or boehmite treatment.

The acid solution treatment is carried out using an acidic processing solution consisting of phosphoric acid, chromic acid or hydrofluoric acid in the following manner.

Each proportion of phosphoric acid, chromic acid and hydrofluoric acid is in a range from 10 to 11 mass % in the case of phosphoric acid, in a range from 3 to 5 mass % in the case of chromic acid and in a range from 0.5 to 2 mass % in the case of hydrofluoric acid. The total concentration of these acids is preferably in-a range from 13.5 to 18 mass %. The treating temperature is 42 to 48° C. It is possible to form a thick film at a higher rate by maintaining high treatment temperature. The film thickness of the coating film is preferably 0.3 to 15 $\mu$m. When the film thickness is less than 0.3 $\mu$m, the barrier characteristics against intrusion is so poor that only insufficient effect is obtained. On the other hand, a film thickness exceeding 15 $\mu$m causes a rise of residual potential in repeated use.

The boehmite treatment may be carried out by dipping the anodic oxide film in pure water kept at 90 to 100° C. for 5 to 60 minutes or by bringing the anodic oxide film into contact with 90 to 120° C. heating steam for 5 to 60 minutes. The film thickness of the coating film formed by the boehmite treatment is preferably 0.1 to 5 $\mu$m.

After the boehmite treatment, anodic oxidation treatment may be carried out using an electrolytic solution reduced in coating film solubility such as adipic acid, boric acid, borates, phosphates, phthalates, maleates, benzoates, tartarates and citrates.

In the case of using the photoreceptor in a laser printer, the surface of the conductive support is preferably roughened so as to have a surface roughness of 0.04 $\mu$m to 0.5 $\mu$m in terms of arithmetic mean roughness Ra to prevent an interference fringe generated when laser light is applied. As a surface roughing method, wet honing performed by spraying abrasives suspended in water on the conductive support or centerless grinding in which the conductive support is pressed to rotating grinding stone to carry out grinding processing continuously is preferable. When Ra is less than 0.04 $\mu$m, the surface of the conductive support is close to a mirror surface and the effect of preventing an interference fringe is not therefore obtained, whereas when Ra exceeds 0.5 $\mu$m, an image quality is roughened even if the coating film is formed according to the invention, and therefore a surface roughness out of the above defined range is unsuitable.

It is to be noted that when non-interference light is used as a light source, the surface roughing for preventing an interference fringe is not particularly required and the generation of defects caused by the irregularities on the surface of the conductive support can be prevented, showing that the use of non-interference light is suitable for achieving longer life Examples of materials used for the intermediate layer 21 besides the above anodic oxidation film include organic metal compounds such as organic zirconium compounds, e.g., zirconium chelate compounds, zirconium alkoxide compounds and zirconium coupling agents; organic titanium compounds, e.g., titanium chelate compounds, titanium alkoxide compounds and titanate coupling agents; organic aluminum compounds, e.g., aluminum chelate compounds and aluminum coupling agents; antimony alkoxide compounds, germanium alkoxide compounds, indium alkoxide compounds, indium chelate compounds, manganese alkoxide compounds, manganese chelate compounds, tin alkoxide compounds, tin chelate compounds, aluminum silicon alkoxide compounds, aluminum titanium alkoxide compounds and aluminum zirconium alkoxide compounds. Among these compounds, organic zirconium compounds, organic titanium compounds and organic aluminum compounds are preferably used because these compounds are decreased in residual potential and exhibit good electrophotographic characteristics.

Also, these compounds may be used by combining with a silane coupling agent such as vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane or β-3,4-epoxycyclohexyltrimethoxysilane.

Further, known binding resins which are conventionally used in the intermediate layer 21 maybe used. Examples of these binding resins include polyvinyl alcohol, polyvinyl methyl ether, poly-N-vinylimidazole, polyethylenoxide, ethyl cellulose, methyl cellulose, ethylene/acrylic acid copolymers, polyamides, polyimides, casein, gelatin, polyethylene, polyesters, phenol resins, vinyl chloride/vinyl acetate copolymers, epoxy reins, polyvinylpyrrolidone, polyvinylpyridine, polyurethane, polyglutamic acid and polyacrylic acid. The proportion of these compounds may be optionally designed according the need.

Also, in the intermediate 21, an electron-transferable pigment may be used by mixing/dispersing it in an organic solvent. Examples of the electron-transferable pigment include organic pigments such as perylene pigments, bisbenzimidazoleperylene pigments, polycyclic quinone pigments, indigo pigments and quinacridone pigments; organic pigments such as bisazo pigments and phthalocyanine pigments having electron-attractive substituents such as a cyano group, nitro group, nitroso group and halogen atom; and inorganic pigments such as zinc oxide and titanium oxide as described in JP-A No. 47-30330. Among these pigments, perylene pigments, bisbenzimidazoleperylene pigments and polycyclic quinone pigments have high electron-transferability and are therefore desirably used. The electron-transferable pigments are used in an amount of 95 mass % or less and preferably 90 mass % or less based on the solid component of the intermediate layer 21 because the strength of the intermediate layer 21 is lowered, causing defects of the coating film if the amount is excessive.

As a method of mixing/dispersing the electron-transferable pigment, usual methods using a ball mill, roll mill, sand mill, attritor or ultrasonic wave are applied. The mixing and dispersing operation is carried out in an organic solvent. As the organic solvent, any solvent may be used as far as it dissolves organic metal compounds and resins and is neither gelled nor coagulated when mixing/dispersing the electron-transferable pigment.

For example, usual organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene may be used either singly or by mixing two or more.

The thickness of the intermediate layer 21 is generally 0.1 to 20 μm and preferably 0.2 to 10 μm. As a coating method used when disposing the intermediate 21, usual methods such as a blade coating method, wire bar coating method, spray coating method, dip coating method, beads coating method, air knife coating method and curtain coating method may be used.

The resulting coating film is dried to obtain the intermediate layer 21. The drying is usually carried out at temperatures enabling solvents to be vaporized and a film to be formed. Particularly, the substrate processed by the above acidic solution treatment and boehmite treatment tends to have insufficient ability to conceal defects and it is therefore to form the intermediate layer 21.

Next, explanations will be furnished as to the protective layer 25. The protective layer of the electrophotographic photoreceptor to be used in the image forming method of the invention has charge-transferability and contains a siloxane compound having a crosslinking structure. The siloxane compounds are represented by the, following general formula (1).

G-D-F General formula (1)

where G represents an inorganic glassy network subgroup, D represents a flexible sub-unit and F represents a charge-transferable sub-unit.

Examples of F in the general formula (1) include, as a structure having photo carrier transferability, triarylamine type compounds, benzidine type compounds, arylalkane type compounds, aryl substituted ethylene type compounds, stilbene type compounds, anthracene type compounds, hydrazone type compounds, quinone type compounds, fluorenone compounds, xanthone type compounds, benzophenone type compounds, cyanovinyl type compounds and ethylene type compounds.

G in the general formula (1) is preferably a Si group having reactivity and gives rise to a crosslinking reaction among the parts of G to form a three-dimensional Si—O—Si bond, namely, an inorganic glassy network.

D in the general formula (1) serves to bond the above F for imparting charge-transferability, directly with the three-dimensional inorganic glassy network. D also works to impart a moderate flexibility to the inorganic glassy network which has high hardness, but is fragile in some respects thereby improving the strength required for a film.

To state in detail, as D, divalent hydrocarbon groups represented by $—C_nH_{2n}—$, $C_nH_{(2n-2)}—$ or $—C_nH_{(2n-4)}—$ in the case where n represents an integer from 1 to 15, —COO—, —S—, —O—, $—CH_2—C_6H_4—$, —N═CH—, $—(C_6H_4)—(C_6H_4)—$, combinations of these groups and those obtained by introducing substituents may be used.

The compound represented by the general formula (1) may be obtained by a sol-gel method as described in JP-A No. 3-191358, for example.

Also, the compound represented by the general formula (1) preferably has a structure represented by the general formula (2).

General formula (2)

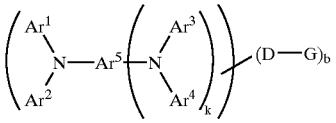

wherein $Ar^1$ to $Ar^4$ respectively represent a substituted or unsubstituted aryl group, $Ar^5$ represents a substituted or unsubstituted aryl group or an arylene group, provided that one to four groups among $Ar^3$ to $Ar^5$ have a connector which can be connected to a connecting group represented by -D-G, D represents a flexible sub-unit, G represents an inorganic glassy network subgroup and is derived from a substituted silicon group having a hydrolyzable group represented by, particularly, $—Si(R_1)_{(3-a)}Q_0$ where $R_1$ represents a hydrogen, an alkyl group or a substituted or unsubstituted aryl group, Q represents a hydrolyzable group and a denotes an integer from 1 to 3, and b denotes an integer from 1 to 4.

The compound represented by the general formula (2) exhibits particularly excellent high positive hole transferability and mechanical characteristics. $Ar^1$ to $Ar^4$ in the general formula (2) respectively represent a substituted or unsubstituted aryl group and specifically, the following structures are exemplified.

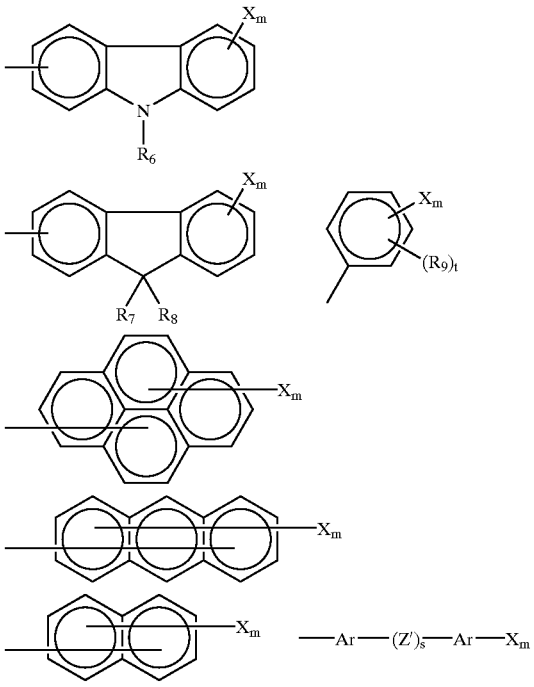

Ar in the above general formula is selected from the structures shown below.

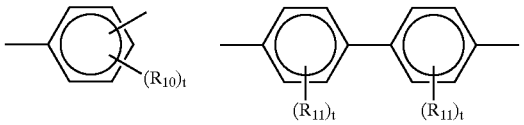

wherein $R_6$ is selected from a hydrogen, an alkyl group having 1 to 4 carbon atoms, a phenyl group substituted with an alkyl group having 1 to 4 carbon atoms or with an alkoxy group having 1 to 4 carbon atoms or an unsubstituted phenyl group and an aralkyl group having 7 to 10 carbon atoms, $R_7$ to $R_{11}$ are respectively selected from hydrogen, an alkyl group having 1 to 4 carbon atoms, an alkoxy group having 1 to 4 carbon atoms or a phenyl group substituted with an alkoxy group having 1 to 4 carbon atoms or an unsubstituted phenyl group, an aralkyl group having 7 to 10 carbon atoms and a halogen, m and s respectively denote 0 or 1 and X represents a substituent represented by -D-G which has been already shown in the definition of the general formula (1).

Also, Z' is selected from the structures shown below.

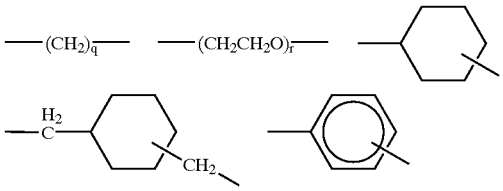

-continued

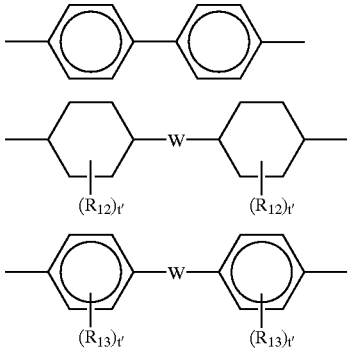

wherein $R_{12}$ and $R_{13}$ respectively represent any one of a hydrogen atom, an alkyl group having 1 to 4 carbon atoms, an alkoxy group having 1 to 4 carbon atoms, a phenyl group, an alkoxyphenyl group having 7 to 10 carbon atoms, an aralkyl group having 7 to 10 carbon atoms and a halogen atom, q and r respectively denote an integer from 1 to 10 and t and t' respectively represent an integer from 1 to 3.

W is selected from the following groups.

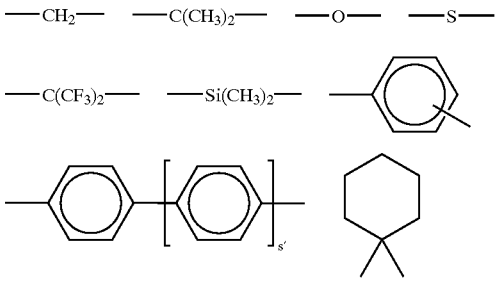

Wherein s' denotes an integer from 0 to 3.

As specific examples of the structure of $Ar^5$ in the general formula (2), any one of the structures of $Ar^1$ to $Ar^4$ wherein m=1 when k=0 and any one of the structures of $Ar^1$ to $Ar^4$ wherein m=0 when k=1 are given.

Specific examples of the compound represented by the general formula (2) are shown collectively in the following table by specifying each substituent. It is needless to say that the invention is not limited to the following compounds. Incidentally, the symbol obtained by adding the prefix "(2)-" to the number of each compound in the table shown below is designated as the symbol of the exemplified compound in this specification (for example, a compound having the number "27" is expressed as "an exemplified compound (2)-27").

TABLE 1
| Compound | k | $Ar^1$ | $Ar^2$ | $Ar^3$ | $Ar^4$ |
|---|---|---|---|---|---|
| 1 | 0 | 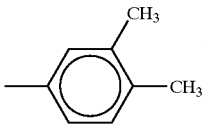 | 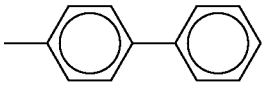 | — | — |
| 2 | 0 | 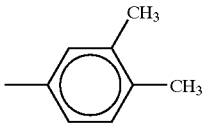 | 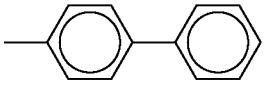 | — | — |
| 3 | 0 | 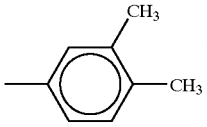 | 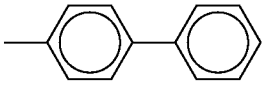 | — | — |
| 4 | 0 | 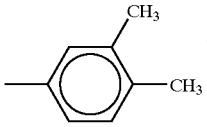 | 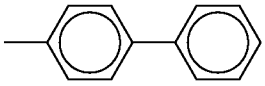 | — | — |
| 5 | 0 | 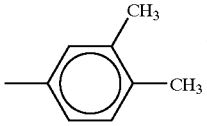 | 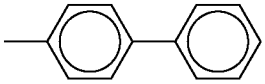 | — | — |
| Compound | k | $Ar^5$ | X |
|---|---|---|---|
| 1 | 0 | 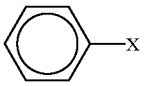 | —CH═NCH$_2$— —Si(OMe)$_2$Me |
| 2 | 0 | 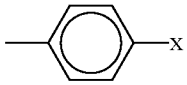 | —CH═N(CH$_2$)$_3$ —Si(OMe)$_3$ |
| 3 | 0 | 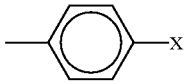 | —CH═N(CH$_2$)$_3$— —Si(OEt)$_3$ |
| 4 | 0 | 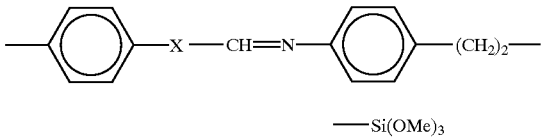 | |
| 5 | 0 | 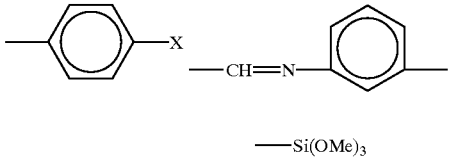 | |

TABLE 2
| Compound | k | $Ar^1$ | $Ar^2$ | $Ar^3$ | $Ar^4$ | $Ar^5$ | X |
|---|---|---|---|---|---|---|---|
| 6 | 0 | 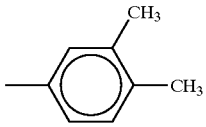 | 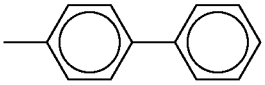 | — | — | 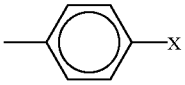 | —O(CH$_2$)$_3$Si(OMe)$_3$ |
| 7 | 0 | 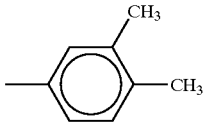 | 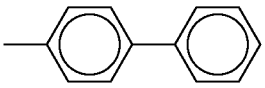 | — | — | 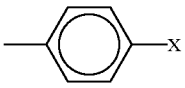 | —O(CH$_2$)$_3$—<br>—SiMe(OMe)$_2$ |
| 8 | 0 | 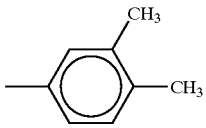 | 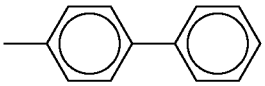 | — | — | 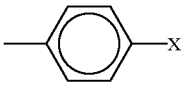 | —O(CH$_2$)$_3$Si(OEt)$_3$ |
| 9 | 0 | 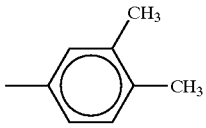 | 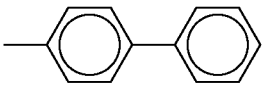 | — | — | 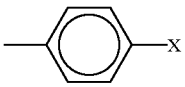 | —CH$_2$O(CH$_2$)$_3$—<br>—Si(OMe)$_3$ |
| 10 | 0 | 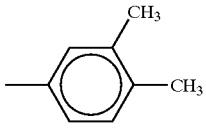 | 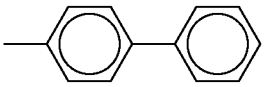 | — | — | 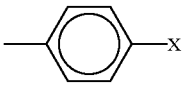 | —(CH$_2$)$_3$O(CH$_2$)$_3$—<br>—Si(OMe)$_3$ |
TABLE 3
| Compound | k | $Ar^1$ | $Ar^2$ | $Ar^3$ | $Ar^4$ | $Ar^5$ | X |
|---|---|---|---|---|---|---|---|
| 11 | 0 | 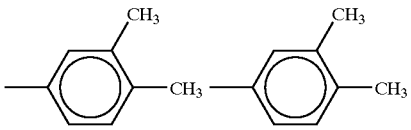 | | — | — | 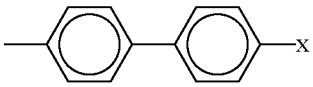 | —COO(CH$_2$)$_3$—<br>—Si(OMe)$_3$ |
| 12 | 0 | 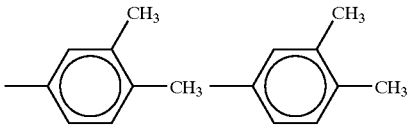 | | — | — | 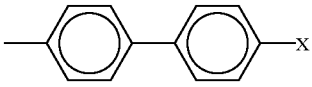 | —CH$_2$COO(CH$_2$)$_3$—<br>—Si(OMe)$_3$ |
| 13 | 0 | 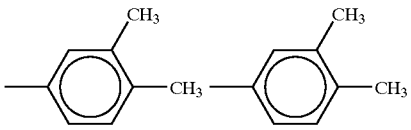 | | — | — | 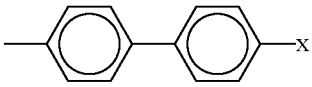 | —(CH$_2$)$_2$COO—<br>—(CH$_2$)$_3$Si(OMe)$_3$ |
| 14 | 0 | 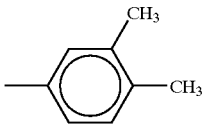 | 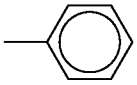 | — | — | 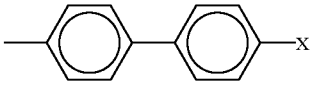 | —COO(CH$_2$)$_3$—<br>—Si(OMe)$_3$ |

TABLE 3-continued
| Compound | k | $Ar^1$ | $Ar^2$ | $Ar^3$ | $Ar^4$ | $Ar^5$ | X |
|---|---|---|---|---|---|---|---|
| 15 | 0 | 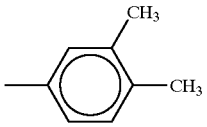 | 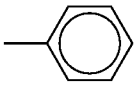 | — | — | 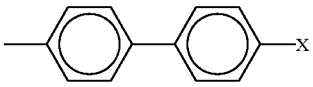 | —$CH_2COO(CH_2)_3$— —$Si(OMe)_3$ |
TABLE 4
| Compound | k | $Ar^1$ | $Ar^2$ | $Ar^3$ | $Ar^4$ | $Ar^5$ | X |
|---|---|---|---|---|---|---|---|
| 16 | 0 | 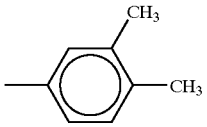 | 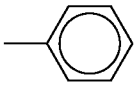 | — | — | 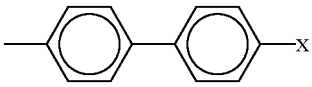 | —$(CH_2)_2COO$— —$(CH_2)_3Si(OMe)_3$ |
| 17 | 0 | 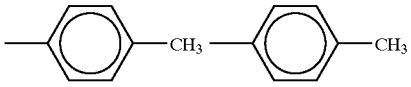 | | — | — | 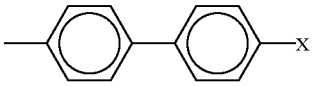 | —$COO(CH_2)_3$— —$Si(OMe)_3$ |
| 18 | 0 | 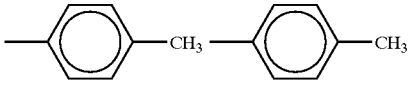 | | — | — | 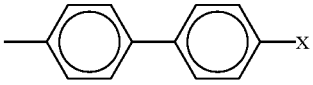 | —$CH_2COO(CH_2)_3$— —$Si(OMe)_3$ |
| 19 | 0 | 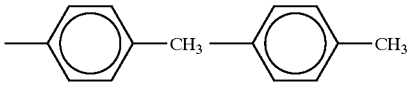 | | — | — | 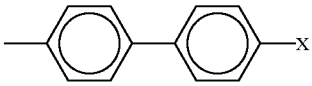 | —$(CH_2)_2COO$— —$(CH_2)_3Si(OMe)_3$ |
| 20 | 0 | 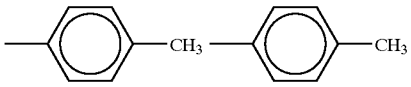 | | — | — | 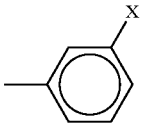 | —$COO(CH_2)_3$— —$Si(OMe)_3$ |
TABLE 5
| Compound | k | $Ar^1$ | $Ar^2$ | $Ar^3$ | $Ar^4$ | $Ar^5$ | X |
|---|---|---|---|---|---|---|---|
| 21 | 0 | 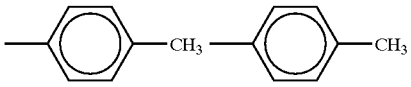 | | — | — | 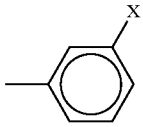 | —$COOCH_2C_6H_4$— —$Si(OMe)_3$ |
| 22 | 0 | 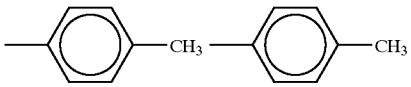 | | — | — | 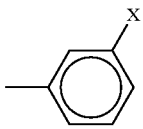 | —$COOCH_2C_6H_4$— —$(CH_2)_3Si(OMe)_3$ |
| 23 | 0 | 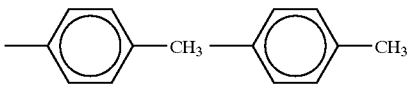 | | — | — | 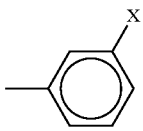 | —$CH_2COO(CH_2)_3$— —$Si(OMe)_3$ |

TABLE 5-continued
| Compound | k | $Ar^1$ | $Ar^2$ | $Ar^3$ | $Ar^4$ | $Ar^5$ | X |
|---|---|---|---|---|---|---|---|
| 24 | 0 | 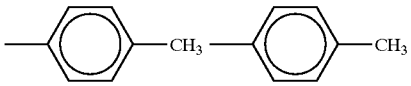 | | — | — | 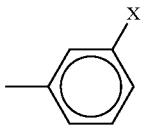 | —$CH_2COOCH_2$— —$C_6H_4Si(OMe)_3$ |
| 25 | 0 | 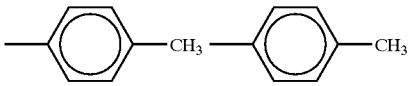 | | — | — | 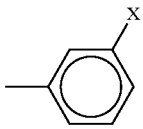 | —$CH_2COO$— —$CH_2C_6H_4(CH_2)_2$— —$Si(OMe)_3$ |
TABLE 6
| Compound | k | $Ar^1$ | $Ar^2$ | $Ar^3$ | $Ar^4$ | $Ar^5$ | X |
|---|---|---|---|---|---|---|---|
| 26 | 0 | 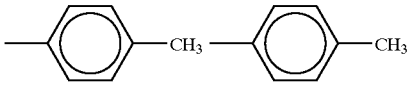 | | — | — | 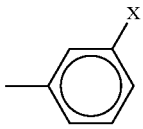 | —$(CH_2)_3COO$— —$(CH_2)_3Si(OMe)_3$ |
| 27 | 0 | 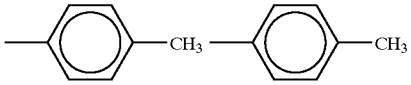 | | — | — | 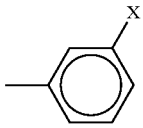 | —$(CH_2)_3COOCH_2$— —$C_6H_4Si(OMe)_3$ |
| 28 | 0 | 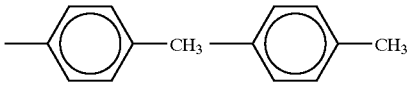 | | — | — | 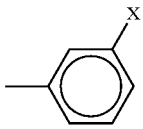 | —$CH_2COO$— —$CH_2C_6H_4(CH_2)_2$— —$Si(OMe)_3$ |
| 29 | 0 | 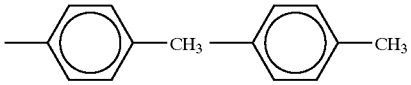 | | — | — | 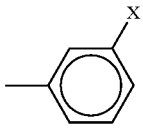 | —$COO(CH_2)_3$— —$Si(OMe)_3$ |
| 30 | 0 | 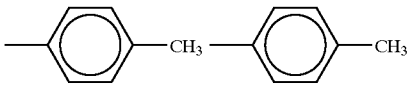 | | — | — | 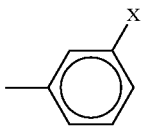 | —$COOCH_2C_6H_4$— —$(CH_2)_3Si(OMe)_3$ |
TABLE 7
| Compound | k | $Ar^1$ | $Ar^2$ | $Ar^3$ | $Ar^4$ | $Ar^5$ | X |
|---|---|---|---|---|---|---|---|
| 31 | 0 | 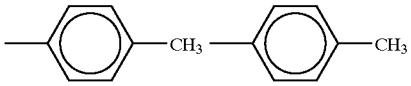 | | — | — | 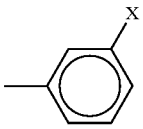 | —$(CH_2)_3COO$— —$(CH_2)_3Si(OMe)_3$ |

TABLE 7-continued
| Compound | k | $Ar^1$ | $Ar^2$ | $Ar^3$ | $Ar^4$ | $Ar^5$ | X |
|---|---|---|---|---|---|---|---|
| 32 | 0 | 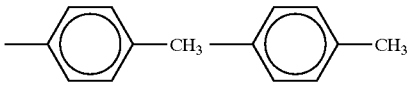 | | — | — | 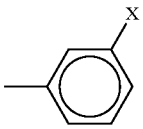 | —$(CH_2)_2COO$—<br>—$CH_2C_6H_4(CH_2)_2$—<br>—$Si(OMe)_3$ |
| 33 | 0 | 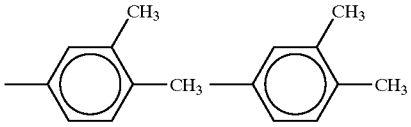 | | — | — | 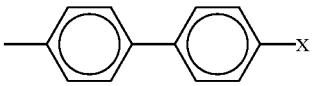 | —$COO(CH_2)_3$—<br>—$Si(OMe)_3$ |
| 34 | 0 | 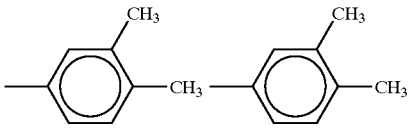 | | — | — | 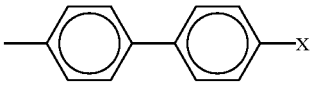 | —$COOCH_2$—<br>—$C_6H_4Si(OMe)_3$ |
| 35 | 0 | 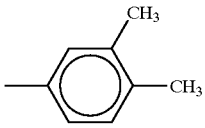 | 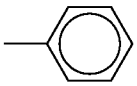 | — | — | 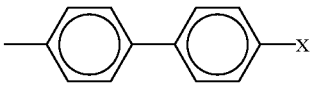 | —$COO(CH_2)_3$—<br>—$Si(OMe)_3$ |
TABLE 8
| Compound | k | $Ar^1$ | $Ar^2$ | $Ar^3$ | $Ar^4$ | $Ar^5$ | X |
|---|---|---|---|---|---|---|---|
| 36 | 0 | 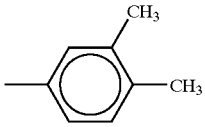 | 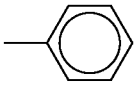 | — | — | 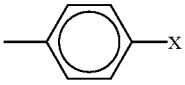 | —$COO(CH_2)_3$—<br>—$Si(OMe)_3$ |
| 37 | 0 | 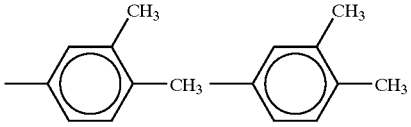 | | — | — | 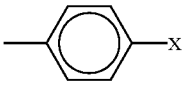 | —$COO(CH_2)_3$—<br>—$Si(OMe)_3$ |
| 38 | 0 | 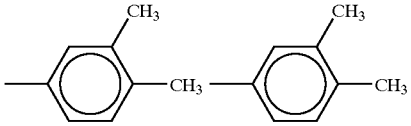 | | — | — | 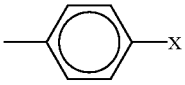 | —$COOCH_2C_6H_4$—<br>—$(CH_2)_3Si(OMe)_3$ |
| 39 | 0 | 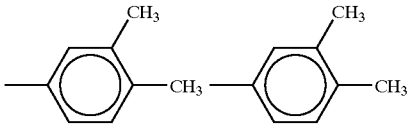 | | — | — | 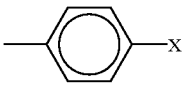 | —$CH_2COO(CH_2)_3$—<br>—$Si(OMe)_3$ |
| 40 | 0 | 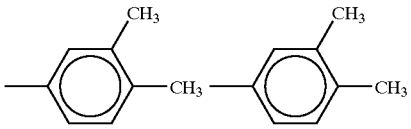 | | — | — | 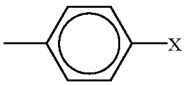 | —$CH_2COO$—<br>—$CH_2C_6H_4(CH_2)_3$—<br>—$Si(OMe)_3$ |

TABLE 9
| Compound | k | $Ar^1$ | $Ar^2$ | $Ar^3$ | $Ar^4$ | $Ar^5$ | X |
|---|---|---|---|---|---|---|---|
| 41 | 0 | 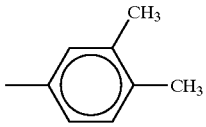 | 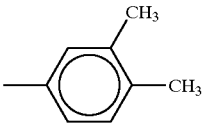 | — | — | 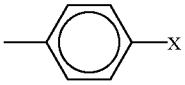 | —$(CH_2)_3COO$— —$(CH_2)_3Si(OMe)_3$ |
| 42 | 0 | 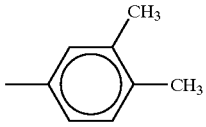 | 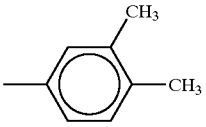 | — | — | 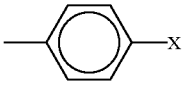 | —$(CH_2)_2COO$— —$CH_2C_6H_4(CH_2)_3$— —$Si(OMe)_3$ |
| 43 | 0 | 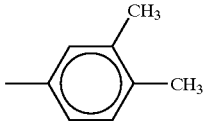 | 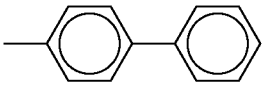 | — | — | 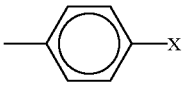 | —$COO(CH_2)_3$— —$Si(OMe)_3$ |
| 44 | 0 | 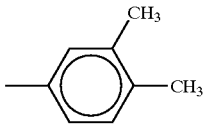 | 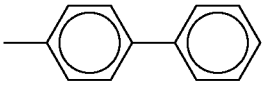 | — | — | 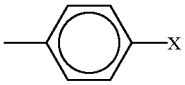 | —$COOCH_2C_6H_4$— —$(CH_2)_3Si(OMe)_3$ |
| 45 | 0 | 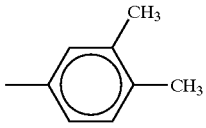 | 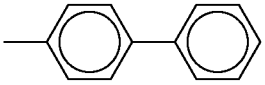 | — | — | 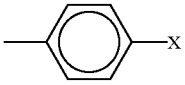 | —$CH_2COO(CH_2)_3$— —$Si(OMe)_3$ |
TABLE 10
| Compound | k | $Ar^1$ | $Ar^2$ | $Ar^3$ | $Ar^4$ | $Ar^5$ | X |
|---|---|---|---|---|---|---|---|
| 46 | 0 | 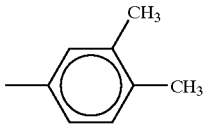 | 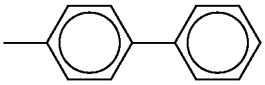 | — | — | 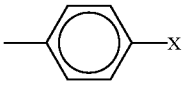 | —$CH_2COO$— —$CH_2C_6H_4(CH_2)_3$— —$Si(OMe)_3$ |
| 47 | 0 | 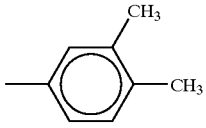 | 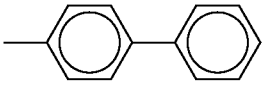 | — | — | 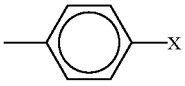 | —$(CH_2)_3COO$— —$(CH_2)_3Si(OMe)_3$ |
| 48 | 0 | 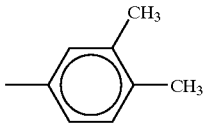 | 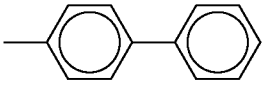 | — | — | 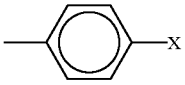 | —$(CH_2)_3COO$— —$CH_2C_6H_4(CH_2)_3$— —$Si(OMe)_3$ |
| 49 | 0 | 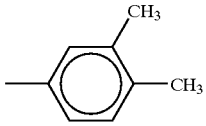 | 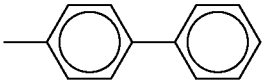 | — | — | 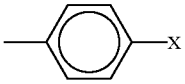 | —CH═CH$Si(OEt)_3$ |

TABLE 10-continued
| Compound | k | $Ar^1$ | $Ar^2$ | $Ar^3$ | $Ar^4$ | $Ar^5$ | X |
|---|---|---|---|---|---|---|---|
| 50 | 0 | 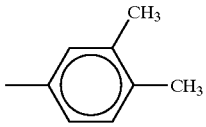 | 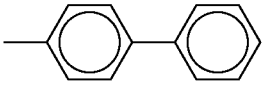 | — | — | 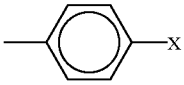 | —CH═CHCH$_2$— —Si(OEt)$_3$ |
TABLE 11
| Compound | k | $Ar^1$ | $Ar^2$ | $Ar^3$ | $Ar^4$ | $Ar^5$ | X |
|---|---|---|---|---|---|---|---|
| 51 | 0 | 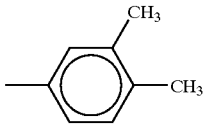 | 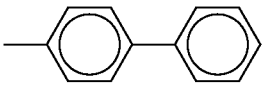 | — | — | 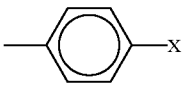 | —CH═CH(CH$_2$)$_2$— —Si(OMe)$_3$ |
| 52 | 0 | 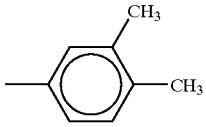 | 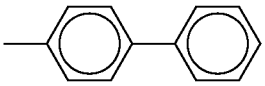 | — | — | 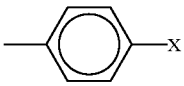 | —CH═CH(CH$_2$)$_3$— —SiMe(OMe)$_2$ |
| 53 | 0 | 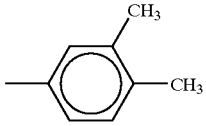 | 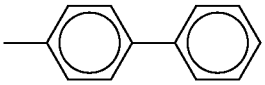 | — | — | 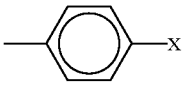 | —CH═CHCH$_2$— —Si(OMe)$_2$Me |
| 54 | 0 | 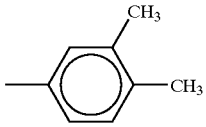 | 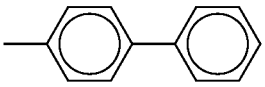 | — | — | 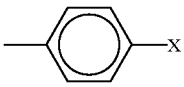 | —CH═CH(CH$_2$)$_3$— —Si(OEt)$_3$ |
| 55 | 0 | 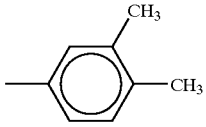 | 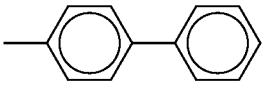 | — | — | 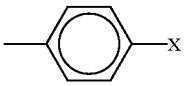 | —CH═CH(CH$_2$)$_3$— —Si(OMe)$_3$ |
TABLE 12
| Compound | k | $Ar^1$ | $Ar^2$ | $Ar^3$ | $Ar^4$ | $Ar^5$ | X |
|---|---|---|---|---|---|---|---|
| 56 | 0 | 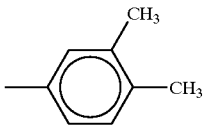 | 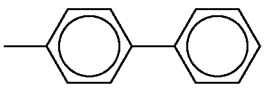 | — | — | 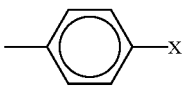 | —CH═CHC$_6$H$_4$— —Si(OMe)$_3$ |
| 57 | 0 | 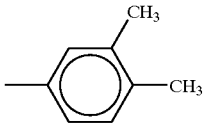 | 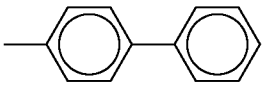 | — | — | 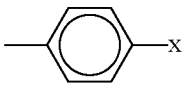 | —CH═CHC$_6$H$_4$— —(CH$_2$)$_2$Si(OMe)$_3$ |

TABLE 12-continued
| Compound | k | $Ar^1$ | $Ar^2$ | $Ar^3$ | $Ar^4$ | $Ar^5$ | X |
|---|---|---|---|---|---|---|---|
| 58 | 0 | 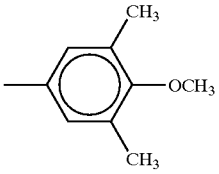 | 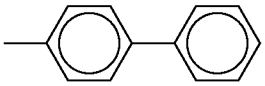 | — | — | 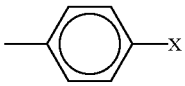 | —CH═CH$(CH_2)_3$— —Si$(OMe)_3$ |
| 59 | 0 | 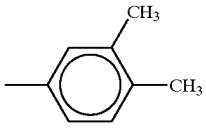 | 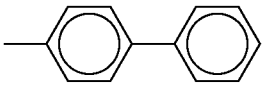 | — | — | 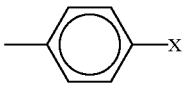 | —$(CH_2)_3$Si$(OEt)_3$ |
| 60 | 0 | 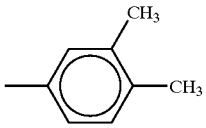 | 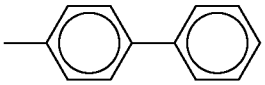 | — | — | 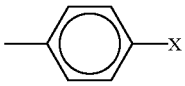 | —$(CH_2)_3$Si$(OEt)_3$ |
TABLE 13
| Compound | k | $Ar^1$ | $Ar^2$ | $Ar^3$ | $Ar^4$ | $Ar^5$ | X |
|---|---|---|---|---|---|---|---|
| 61 | 0 | 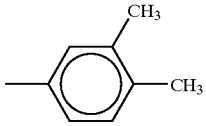 | 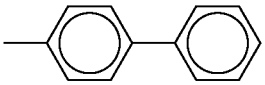 | — | — | 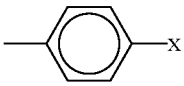 | —$(CH_2)_4$Si$(OMe)_3$ |
| 62 | 0 | 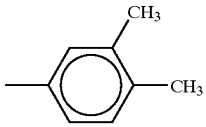 | 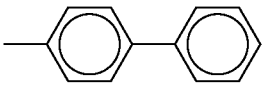 | — | — | 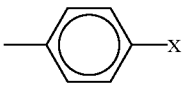 | —$(CH_2)_4$— —SiMe$(OMe)_2$ |
| 63 | 0 | 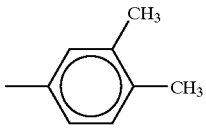 | 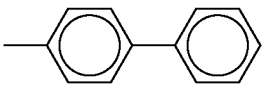 | — | — | 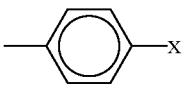 | —$(CH_2)_4$— —$SiMe_2$(OMe) |
| 64 | 0 | 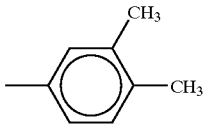 | 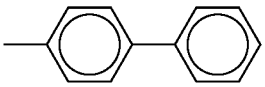 | — | — | 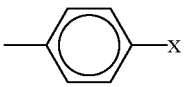 | —$(CH_2)_4$Si$(OEt)_3$ |
| 65 | 0 | 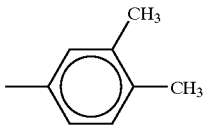 | 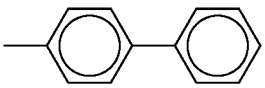 | — | — | 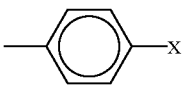 | —$(CH_2)_6$SiMe$(OEt)_2$ |

TABLE 14
| Compound | k | $Ar^1$ | $Ar^2$ | $Ar^3$ |
|---|---|---|---|---|
| 66 | 0 | 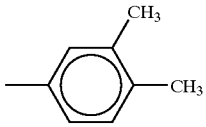 | 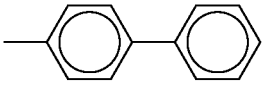 | — |
| 67 | 0 | 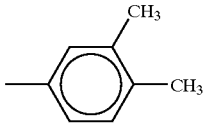 | 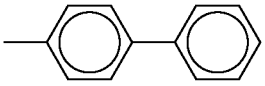 | — |
| 68 | 0 | 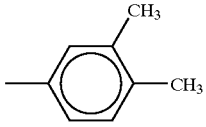 | 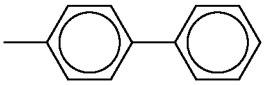 | — |
| 69 | 1 | 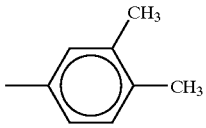 | 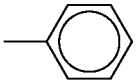 | 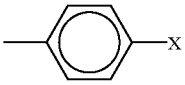 |
| 70 | 1 | 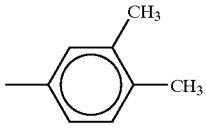 | 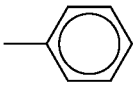 | 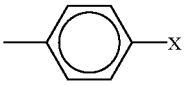 |
| Compound | k | $Ar^4$ | $Ar^5$ | X |
|---|---|---|---|---|
| 66 | 0 | — | 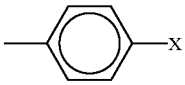 | $—(CH_2)_{12}Si(OMe)_3$ |
| 67 | 0 | — | 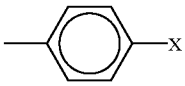 | $—(CH_2)_3C_6H_4—$ $—(CH_2)_3Si(OMe)_3$ |
| 68 | 0 | — | 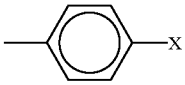 | $—C_2H_4C_4H_6—$ $—Si(OMe)_3$ |
| 69 | 1 | 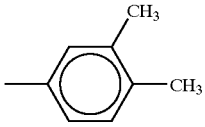 | 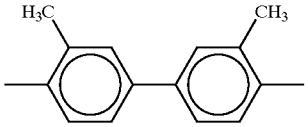 | $—CH=N(CH_2)_3—$ $—Si(OMe)_3$ |
| 70 | 1 | 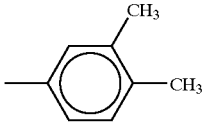 | 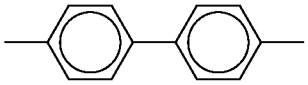 | $—CH=N(CH_2)_3—$ $—Si(OMe)_3$ |

TABLE 15
| Compound | k | $Ar^1$ | $Ar^2$ | $Ar^3$ |
|---|---|---|---|---|
| 71 | 1 | 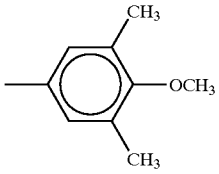 | 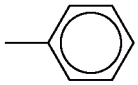 | 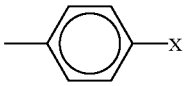 |
| 72 | 1 | 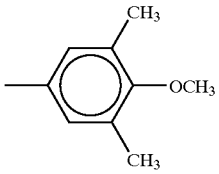 | 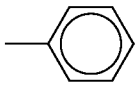 | 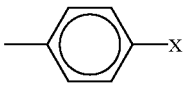 |
| 73 | 1 | 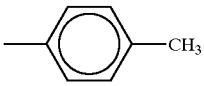 | 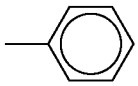 | 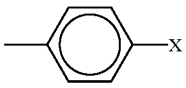 |
| 74 | 1 | 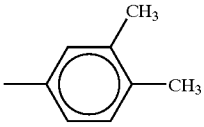 | 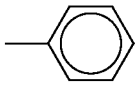 | 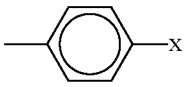 |
| 75 | 1 | 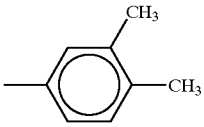 | 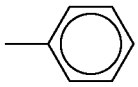 | 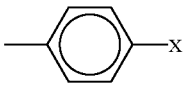 |
| Compound | k | $Ar^4$ | $Ar^5$ | X |
|---|---|---|---|---|
| 71 | 1 | 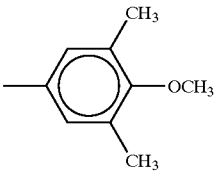 | 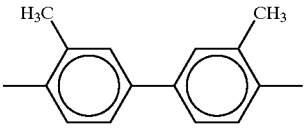 | —CH═N$(CH_2)_3$— —Si$(OMe)_3$ |
| 72 | 1 | 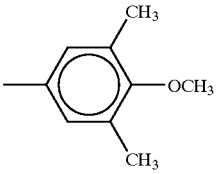 | 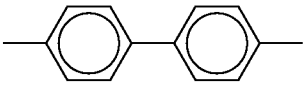 | —CH═N$(CH_2)_3$— —Si$(OMe)_3$ |
| 73 | 1 | 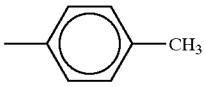 | 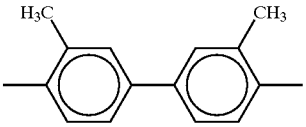 | —CH═N$(CH_2)_3$— —Si$(OMe)_3$ |
| 74 | 1 | 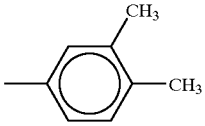 | 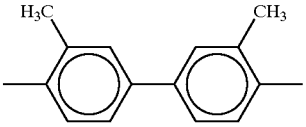 | 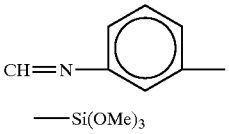 |

TABLE 15-continued
| | | | | |
|---|---|---|---|---|
| 75 | 1 | 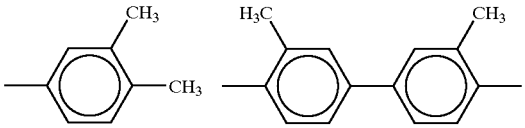 | | —O(CH$_2$)$_3$Si(OMe)$_3$ |
TABLE 16
| Compound | k | Ar$^1$ | Ar$^2$ | Ar$^3$ |
|---|---|---|---|---|
| 76 | 1 | 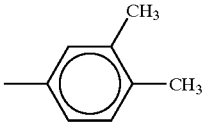 | 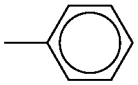 | 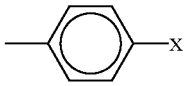 |
| 77 | 1 | 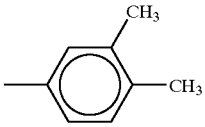 | 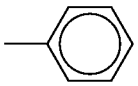 | 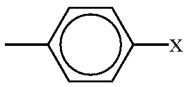 |
| 78 | 1 | 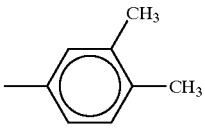 | 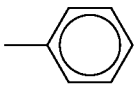 | 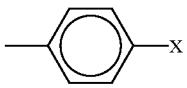 |
| 79 | 1 | 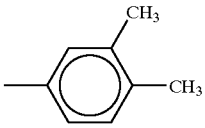 | 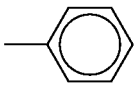 | 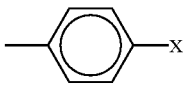 |
| 80 | 1 | 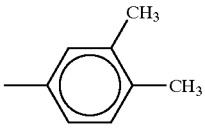 | 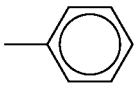 | 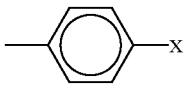 |
| Compound | k | Ar$^4$ | Ar$^5$ | X |
|---|---|---|---|---|
| 76 | 1 | 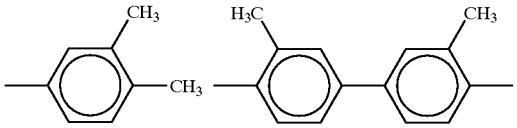 | | —O(CH$_2$)$_3$Si(OEt)$_3$ |
| 77 | 1 | 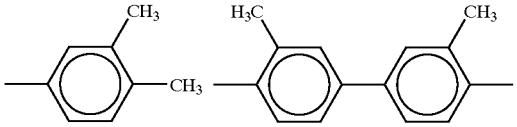 | | —CH$_2$O(CH$_2$)$_3$—<br>—Si(OMe)$_3$ |
| 78 | 1 | 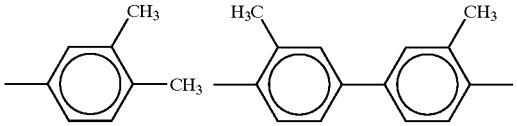 | | —(CH$_2$)$_3$O(CH$_2$)$_3$—<br>—Si(OMe)$_3$ |

TABLE 16-continued
| | | | |
|---|---|---|---|
| 79 | 1 | 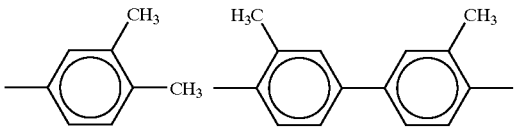 | —$(CH_2)_4Si(OMe)_3$ |
| 80 | 1 | 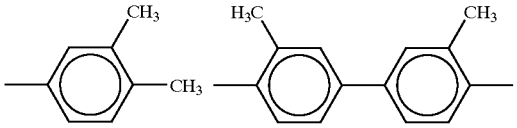 | —$(CH_2)_2C_6H_4$— —$Si(OMe)_3$ |
15
TABLE 17
| Compound | k | $Ar^1$ | $Ar^2$ | $Ar^3$ |
|---|---|---|---|---|
| 81 | 1 | 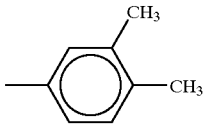 | 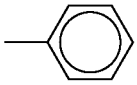 | 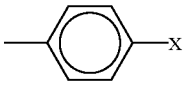 |
| 82 | 1 | 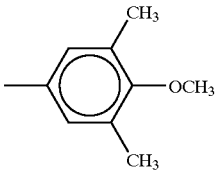 | 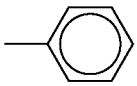 | 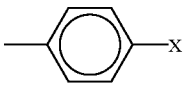 |
| 83 | 1 | 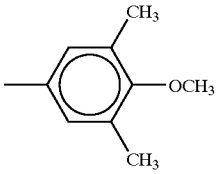 | 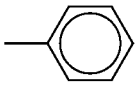 | 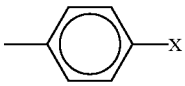 |
| 84 | 1 | 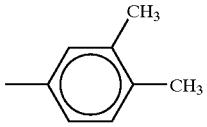 | 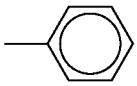 | 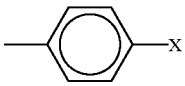 |
| 85 | 1 | 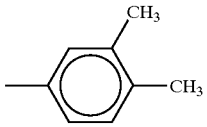 | 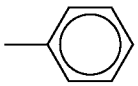 | 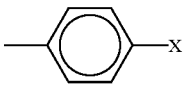 |
| Compound | k | $Ar^4$ | $Ar^5$ | X |
|---|---|---|---|---|
| 81 | 1 | 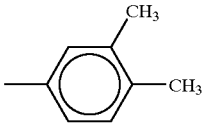 | 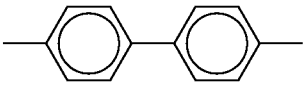 | —$(CH_2)_4Si(OMe)_3$ |

TABLE 17-continued
| | | | | |
|---|---|---|---|---|
| 82 | 1 | 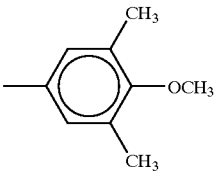 | 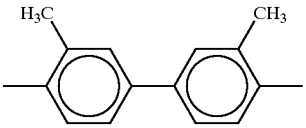 | —$(CH_2)_4Si(OMe)_3$ |
| 83 | 1 | 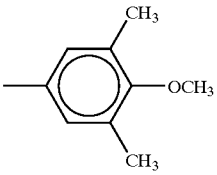 | 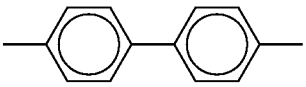 | —$(CH_2)_4Si(OMe)_3$ |
| 84 | 1 | 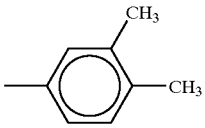 | 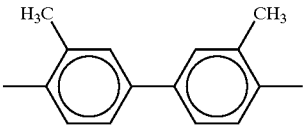 | —CH═CH$(CH_2)_2$— —$Si(OMe)_3$ |
| 85 | 1 | 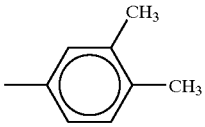 | 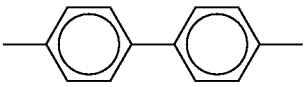 | —CH═CH$(CH_2)_2$— —$Si(OMe)_3$ |
30
TABLE 18
| Compound | k | $Ar^1$ | $Ar^2$ | $Ar^3$ |
|---|---|---|---|---|
| 86 | 1 | 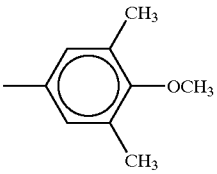 | 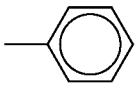 | 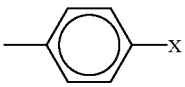 |
| 87 | 1 | 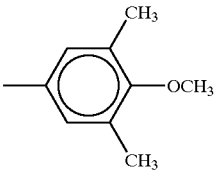 | 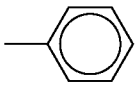 | 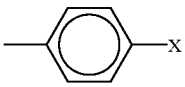 |
| 88 | 1 | 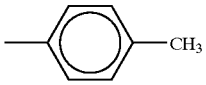 | 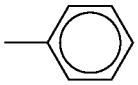 | 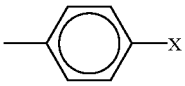 |
| 89 | 0 | 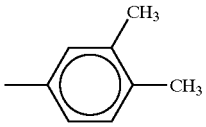 | 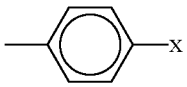 | — |
| 90 | 0 | 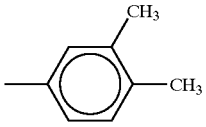 | 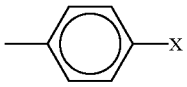 | — |

TABLE 18-continued
| Compound | k | $Ar^4$ | $Ar^5$ | X |
|---|---|---|---|---|
| 86 | 1 | 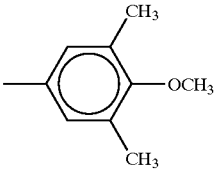 | 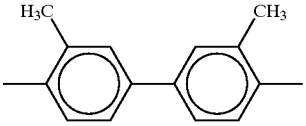 | —CH═CH$(CH_2)_2$— —Si$(OMe)_3$ |
| 87 | 1 | 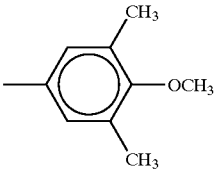 | 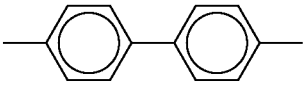 | —CH═CH$(CH_2)_2$— —Si$(OMe)_3$ |
| 88 | 1 | 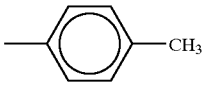 | 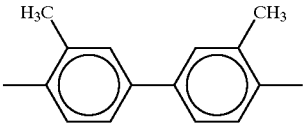 | —CH═CH$(CH_2)_2$— —Si$(OMe)_3$ |
| 89 | 0 | — | 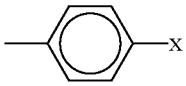 | —$(CH_2)_2$Si$(OEt)_3$ |
| 90 | 0 | — | 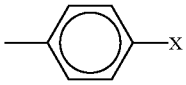 | —$(CH_2)_3$Si$(OEt)_3$ |
TABLE 19
| Compound | k | $Ar^1$ | $Ar^2$ | $Ar^3$ | $Ar^4$ | $Ar^5$ | X |
|---|---|---|---|---|---|---|---|
| 91 | 0 | 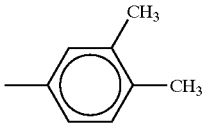 | 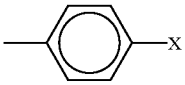 | — | — | 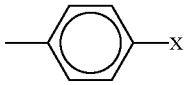 | —$(CH_2)_2$— —Si$(OMe)_2$Me |
| 92 | 0 | 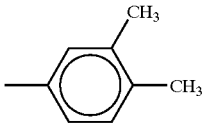 | 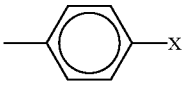 | — | — | 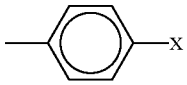 | —$(CH_2)_4$Si$(OMe)_3$ |
| 93 | 0 | 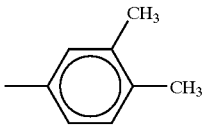 | 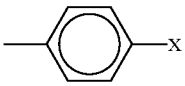 | — | — | 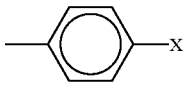 | —$(CH_2)_{12}$Si$(OMe)_3$ |
| 94 | 0 | 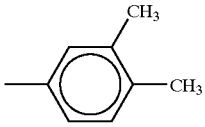 | 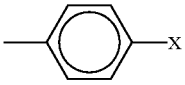 | — | — | 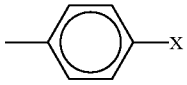 | —$(CH_2)_4$Si$(OEt)_3$ |

TABLE 19-continued
| Compound | k | $Ar^1$ | $Ar^2$ | $Ar^3$ | $Ar^4$ | $Ar^5$ | X |
|---|---|---|---|---|---|---|---|
| 95 | 0 | 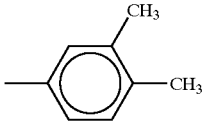 | 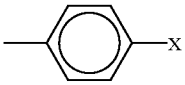 | — | — | 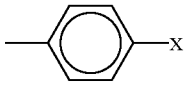 | —$(CH_2)_2C_6H_4$— —$Si(OMe)_3$ |
TABLE 20
| Compound | k | $Ar^1$ | $Ar^2$ | $Ar^3$ | $Ar^4$ | $Ar^5$ | X |
|---|---|---|---|---|---|---|---|
| 96 | 0 | 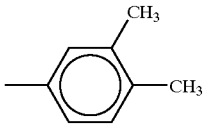 | 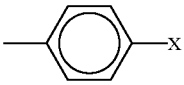 | — | — | 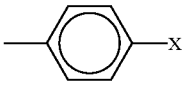 | —$(CH_2)_2C_6H_4$— —$(CH_2)_2Si(OMe)_3$ |
| 97 | 0 | 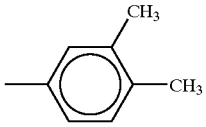 | 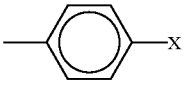 | — | — | 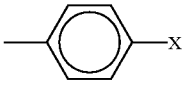 | —$(CH_2)_4Si(OMe)_3$ |
| 98 | 0 | 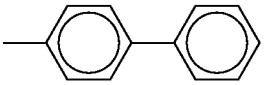 | 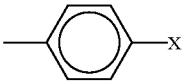 | — | — | 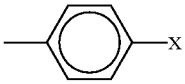 | —$(CH_2)_4Si(OMe)_3$ |
| 99 | 0 | 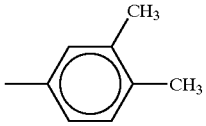 | 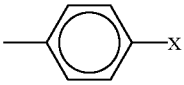 | — | — | 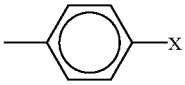 | —CH=CH$Si(OEt)_3$ |
| 100 | 0 | 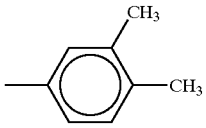 | 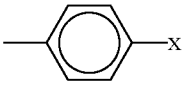 | — | — | 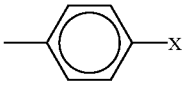 | —CH=$CHCH_2$— —$Si(OMe)_2Me$ |
45
TABLE 21
| Compound | k | $Ar^1$ | $Ar^2$ | $Ar^3$ | $Ar^4$ | $Ar^5$ | X |
|---|---|---|---|---|---|---|---|
| 101 | 0 | 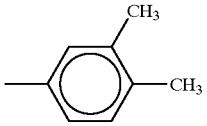 | 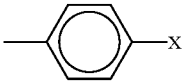 | — | — | 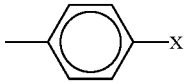 | —CH=$CH(CH_2)_2$— —$Si(OMe)_3$ |
| 102 | 0 | 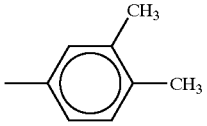 | 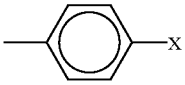 | — | — | 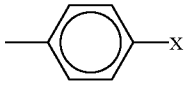 | —CH=$CH(CH_2)_2$— —$Si(OMe)_2Me$ |

TABLE 21-continued
| Compound | k | $Ar^1$ | $Ar^2$ | $Ar^3$ | $Ar^4$ | $Ar^5$ | X |
|---|---|---|---|---|---|---|---|
| 103 | 0 | 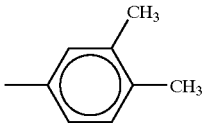 | 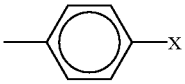 | — | — | 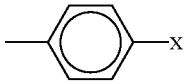 | —CH=CH$(CH_2)_2$— —$SiMe_2$(OMe) |
| 104 | 0 | 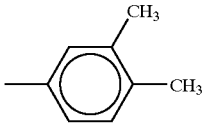 | 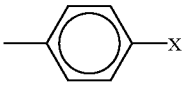 | — | — | 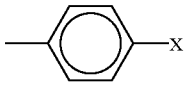 | —CH=CH$(CH_2)_3$— —Si$(OEt)_3$ |
| 105 | 0 | 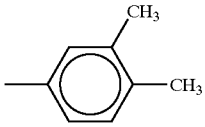 | 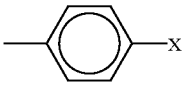 | — | — | 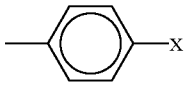 | —CH=CH$(CH_2)_{10}$— —Si$(OMe)_3$ |
TABLE 22
| Compound | k | $Ar^1$ | $Ar^2$ | $Ar^3$ | $Ar^4$ | $Ar^5$ | X |
|---|---|---|---|---|---|---|---|
| 106 | 0 | 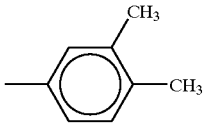 | 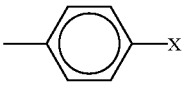 | — | — | 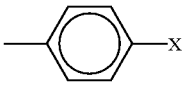 | —CH=CH$C_6H_4$— —Si$(OMe)_3$ |
| 107 | 0 | 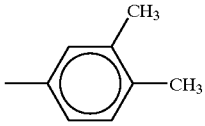 | 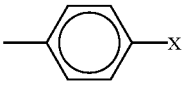 | — | — | 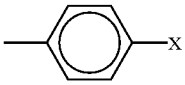 | —CH=CH$C_6H_4$— —$(CH_2)_2$Si$(OMe)_3$ |
| 108 | 0 | 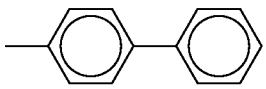 | 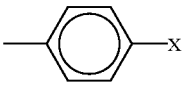 | — | — | 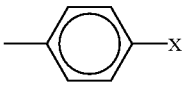 | —CH=CH$(CH_2)_2$— —Si$(OMe)_3$ |
| 109 | 0 | 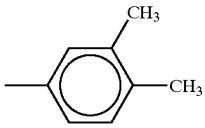 | 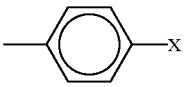 | — | — | 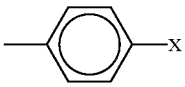 | —CH=N$(CH_2)_3$— —Si$(OMe)_3$ |
| 110 | 0 | 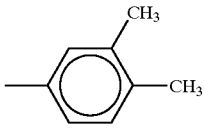 | 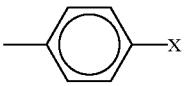 | — | — | 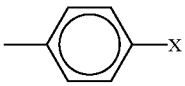 | —CH=N$(CH_2)_3$— —Si$(OEt)_3$ |

TABLE 23
| Compound | k | $Ar^1$ | $Ar^2$ | $Ar^3$ | $Ar^4$ | $Ar^5$ | X |
|---|---|---|---|---|---|---|---|
| 111 | 0 | 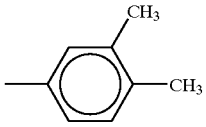 | 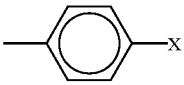 | — | — | 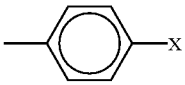 | —CH=NCH$_2$— —Si(OMe)$_2$Me |
| 112 | 0 | 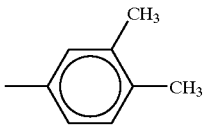 | 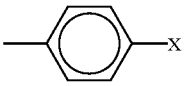 | — | — | 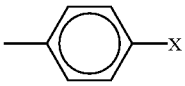 | —CH=NC$_6$H$_4$— —(CH$_2$)$_2$Si(OMe)$_3$ |
| 113 | 0 | 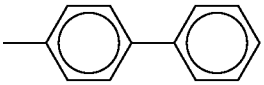 | 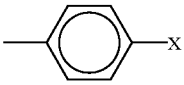 | — | — | 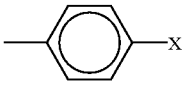 | —CH=N(CH$_2$)$_3$— —Si(OMe)$_3$ |
| 114 | 0 | 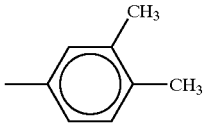 | 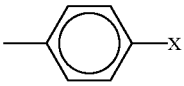 | — | — | 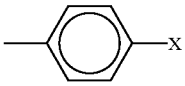 | —O(CH$_2$)$_3$Si(OMe)$_3$ |
| 115 | 0 | 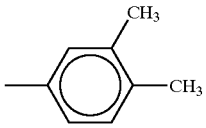 | 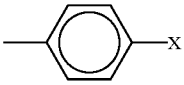 | — | — | 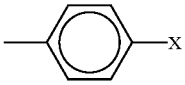 | —O(CH$_2$)$_3$Si(OEt)$_3$ |
TABLE 24
| Compound | k | $Ar^1$ | $Ar^2$ | $Ar^3$ | $Ar^4$ | $Ar^5$ | X |
|---|---|---|---|---|---|---|---|
| 116 | 0 | 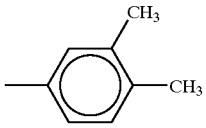 | 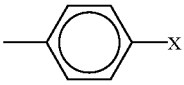 | — | — | 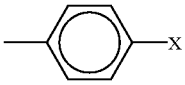 | —CH$_2$O(CH$_2$)$_3$— —Si(OMe)$_3$ |
| 117 | 0 | 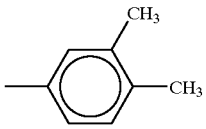 | 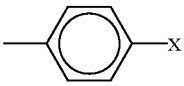 | — | — | 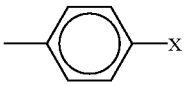 | —(CH$_2$)$_3$O(CH$_2$)$_3$— —Si(OMe)$_3$ |
| 118 | 0 | 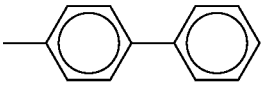 | 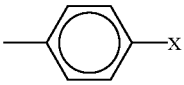 | — | — | 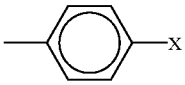 | —CH$_2$O(CH$_2$)$_3$— —Si(OMe)$_3$ |
| 119 | 0 | 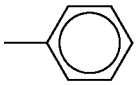 | 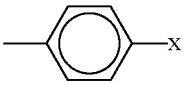 | — | — | 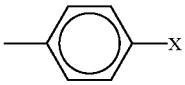 | —CH$_2$COO(CH$_2$)$_3$— —Si(OMe)$_3$ |
| 120 | 0 | 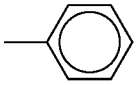 | 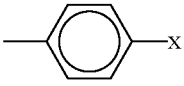 | — | — | 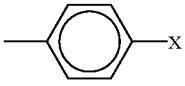 | —(CH$_2$)$_2$COO— —(CH$_2$)$_3$Si(OMe)$_3$ |

TABLE 25
| Compound | k | $Ar^1$ | $Ar^2$ | $Ar^3$ | $Ar^4$ | $Ar^5$ | X |
|---|---|---|---|---|---|---|---|
| 121 | 0 | 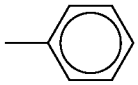 | 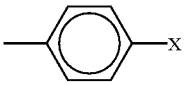 | — | — | 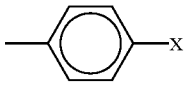 | —$(CH_2)_2$COO— —$CH_2C_6H_4(CH_2)_3$— —Si$(OMe)_3$ |
| 122 | 0 | 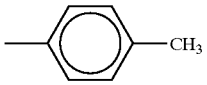 | 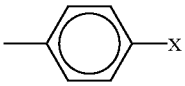 | — | — | 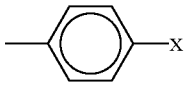 | —$CH_2$COO— —$CH_2C_6H_4(CH_2)_2$— —Si$(OMe)_3$ |
| 123 | 0 | 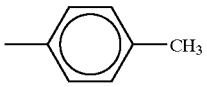 | 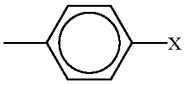 | — | — | 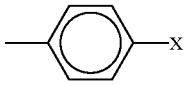 | —$(CH_2)_3$COO— —$(CH_2)_3$Si$(OMe)_3$ |
| 124 | 0 | 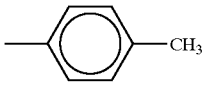 | 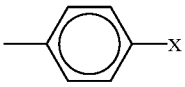 | — | — | 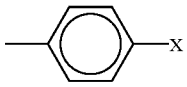 | —$(CH_2)_3$COO— —$CH_2C_6H_4(CH_2)_2$— —Si$(OMe)_3$ |
| 125 | 0 | 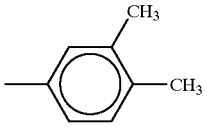 | 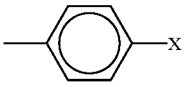 | — | — | 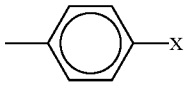 | —$CH_2$COO— —$CH_2C_6H_4(CH_2)_2$— —Si$(OMe)_3$ |
TABLE 26
| Compound | k | $Ar^1$ | $Ar^2$ | $Ar^3$ | $Ar^4$ | $Ar^5$ | X |
|---|---|---|---|---|---|---|---|
| 126 | 0 | 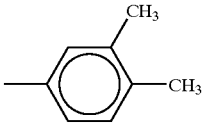 | 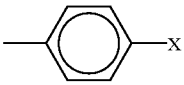 | — | — | 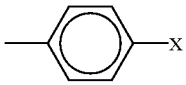 | —$(CH_2)_2$COO— —$(CH_2)_3$Si$(OMe)_3$ |
| 127 | 0 | 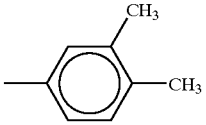 | 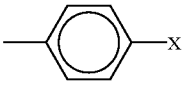 | — | — | 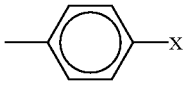 | —$(CH_2)_2$COO— —$CH_2C_6H_4$Si$(OMe)_3$ |
| 128 | 0 | 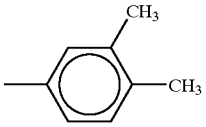 | 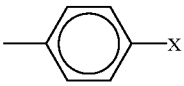 | — | — | 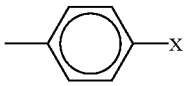 | —$(CH_2)_2$COO— —$CH_2C_6H_4(CH_2)_3$— —Si$(OMe)_3$ |
| 129 | 0 | 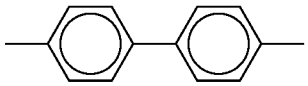 | 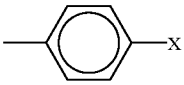 | — | — | 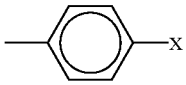 | —$CH_2$COO$(CH_2)_3$— —Si$(OMe)_3$ |
| 130 | 0 | 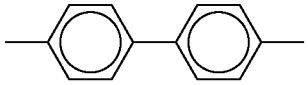 | 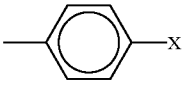 | — | — | 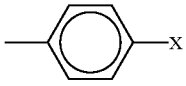 | —$(CH_2)_2$COO— —$(CH_2)_3$Si$(OMe)_3$ |

TABLE 27
| Compound | k | $Ar^1$ | $Ar^2$ | $Ar^3$ |
|---|---|---|---|---|
| 131 | 0 | 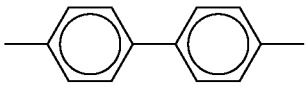 | 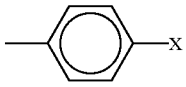 | — |
| 132 | 0 | 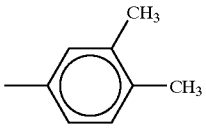 | 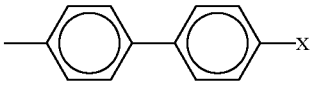 | — |
| 133 | 0 | 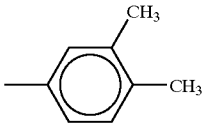 | 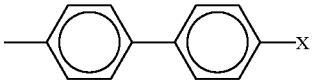 | — |
| 134 | 0 | 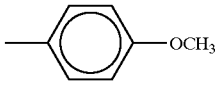 | 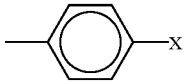 | — |
| 135 | 0 | 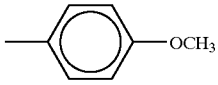 | 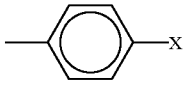 | — |
| Compound | k | $Ar^4$ | $Ar^5$ | X |
|---|---|---|---|---|
| 131 | 0 | — | 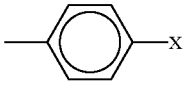 | —$(CH_2)_2COO$— —$CH_2C_6H_4(CH_2)_3$— —$Si(OMe)_3$ |
| 132 | 0 | — | 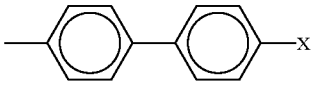 | —$COO(CH_2)_3$— —$Si(OMe)_3$ |
| 133 | 0 | — | 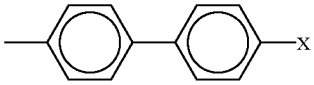 | —$COOCH_2C_6H_4$— —$(CH_2)_2Si(OMe)_3$ |
| 134 | 0 | — | 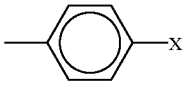 | —$CH_2COO$— —$CH_2C_6H_4(CH_2)_2$— —$Si(OMe)_3$ |
| 135 | 0 | — | 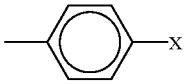 | —$(CH_2)_2COO$— —$(CH_2)_3Si(OMe)_3$ |
TABLE 28
| Compound | k | $Ar^1$ | $Ar^2$ | $Ar^3$ | $Ar^4$ | $Ar^5$ | X |
|---|---|---|---|---|---|---|---|
| 136 | 0 | 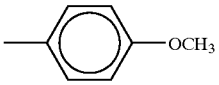 | 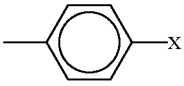 | — | — | 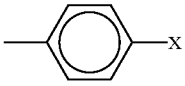 | —$(CH_2)_2COO$— —$CH_2C_6H_4(CH_2)_3$— —$Si(OMe)_3$ |

TABLE 28-continued
| Compound | k | $Ar^1$ | $Ar^2$ | $Ar^3$ | $Ar^4$ | $Ar^5$ | X |
|---|---|---|---|---|---|---|---|
| 137 | 0 | 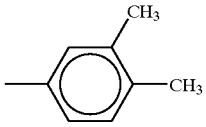 | 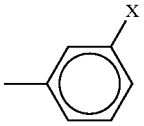 | — | — | 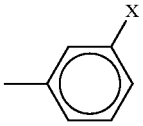 | —$(CH_2)_2COO$— —$(CH_2)_3Si(OMe)_3$ |
| 138 | 0 | 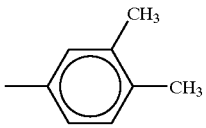 | 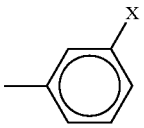 | — | — | 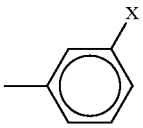 | —$(CH_2)_2COO$— —$CH_2C_6H_4Si(OMe)_3$ |
| 139 | 0 | 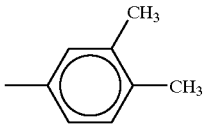 | 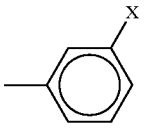 | — | — | 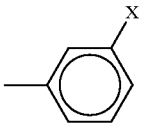 | —$(CH_2)_2COO$— —$CH_2C_6H_4(CH_2)_2$— —$Si(OMe)_3$ |
| 140 | 0 | 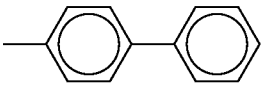 | 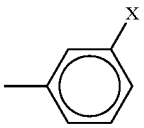 | — | — | 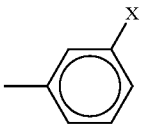 | —$CH_2COO(CH_2)_3$— —$Si(OMe)_3$ |
TABLE 29
| Compound | k | $Ar^1$ | $Ar^2$ | $Ar^3$ |
|---|---|---|---|---|
| 141 | 0 | 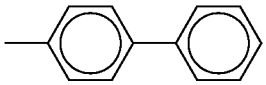 | 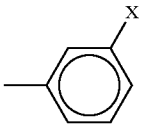 | — |
| 142 | 0 | 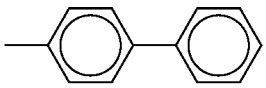 | 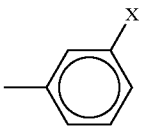 | — |
| 143 | 1 | 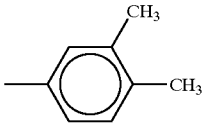 | 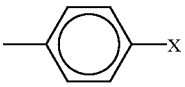 | 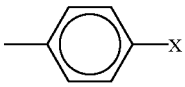 |
| 144 | 1 | 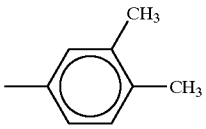 | 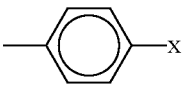 | 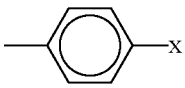 |
| 145 | 1 | 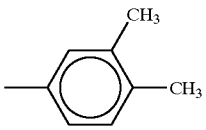 | 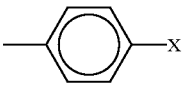 | 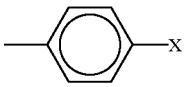 |

TABLE 29-continued
| Compound | k | $Ar^4$ | $Ar^5$ | X |
|---|---|---|---|---|
| 141 | 0 | — | 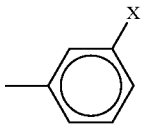 | —$(CH_2)_2$COO— —$(CH_2)_3Si(OMe)_3$ |
| 142 | 0 | — | 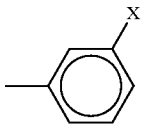 | —$(CH_2)_2$COO— —$CH_2C_6H_4(CH_2)_3$— —$Si(OMe)_3$ |
| 143 | 1 | 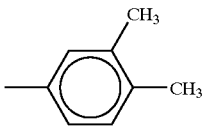 | 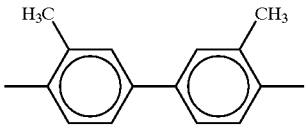 | —$(CH_2)_2Si(OEt)_3$ |
| 144 | 1 | 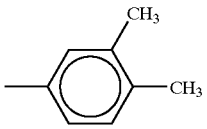 | 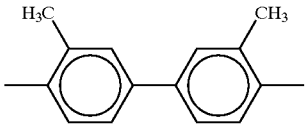 | —$(CH_2)_3Si(OEt)_3$ |
| 145 | 1 | 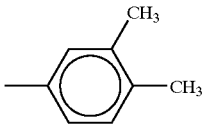 | 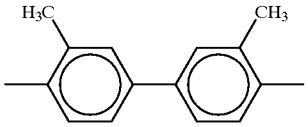 | —$(CH_2)_4Si(OMe)_3$ |
TABLE 30
| Compound | k | $Ar^1$ | $Ar^2$ | $Ar^3$ |
|---|---|---|---|---|
| 146 | 1 | 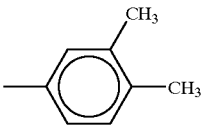 | 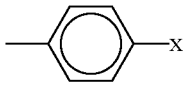 | 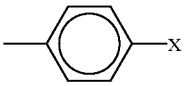 |
| 147 | 1 | 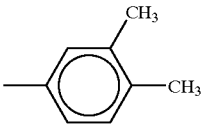 | 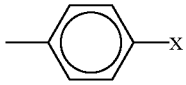 | 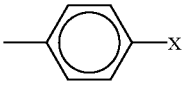 |
| 148 | 1 | 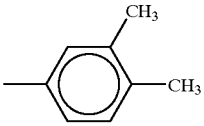 | 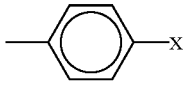 | 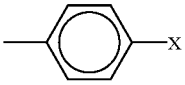 |
| 149 | 1 | 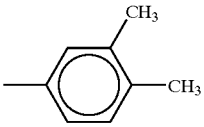 | 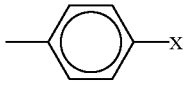 | 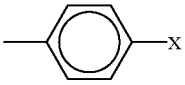 |

TABLE 30-continued
| | | | | |
|---|---|---|---|---|
| 150 | 1 | 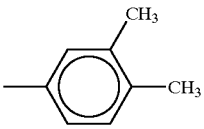 | 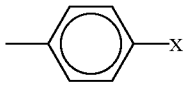 | 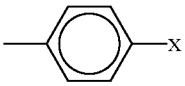 |
| Compound | k | $Ar^4$ | $Ar^5$ | X |
|---|---|---|---|---|
| 146 | 1 | 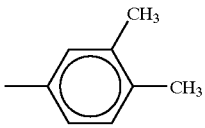 | 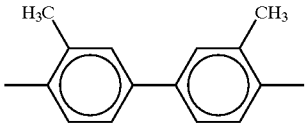 | —$(CH_2)_4$— —$SiMe(OMe)_2$ |
| 147 | 1 | 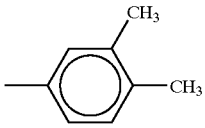 | 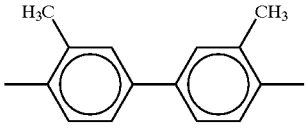 | —$(CH_2)_4$— —$SiMe_2(OMe)$ |
| 148 | 1 | 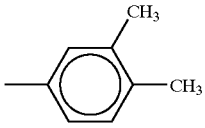 | 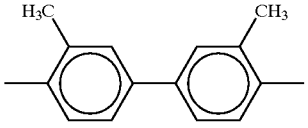 | —$(CH_2)_4Si(OEt)_3$ |
| 149 | 1 | 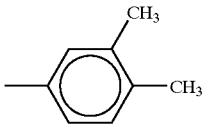 | 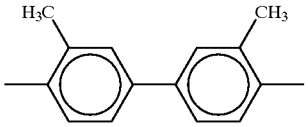 | —$(CH_2)_2C_6H_4$— —$Si(OMe)_3$ |
| 150 | 1 | 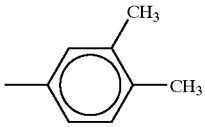 | 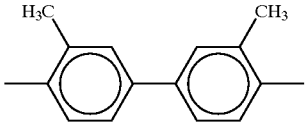 | —$(CH_2)_2C_6H_4$— —$(CH_2)_2Si(OMe)_3$ |
TABLE 31
| Compound | k | $Ar^1$ | $Ar^2$ | $Ar^3$ |
|---|---|---|---|---|
| 151 | 1 | 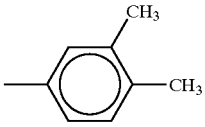 | 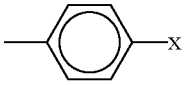 | 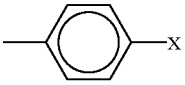 |
| 152 | 1 | 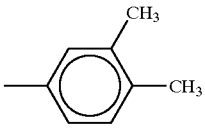 | 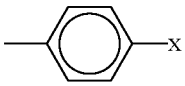 | 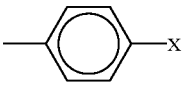 |
| 153 | 1 | 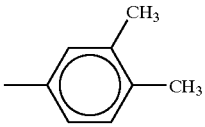 | 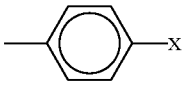 | 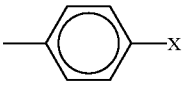 |

TABLE 31-continued
| | | | | |
|---|---|---|---|---|
| 154 | 1 | 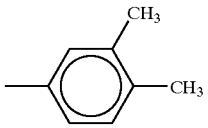 | 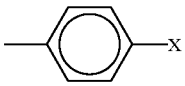 | 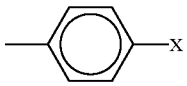 |
| 155 | 1 | 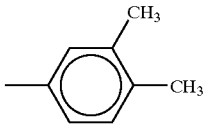 | 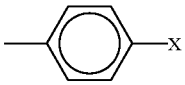 | 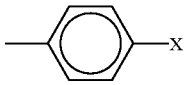 |
| Compound | k | $Ar^4$ | $Ar^5$ | X |
|---|---|---|---|---|
| 151 | 1 | 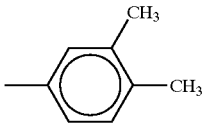 | 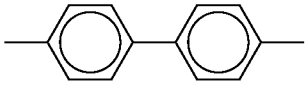 | —$(CH_2)_3$— —$Si(OMe)_2Me$ |
| 152 | 1 | 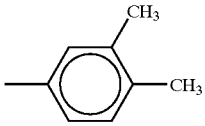 | 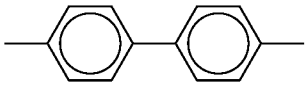 | —$(CH_2)_4Si(OMe)_3$ |
| 153 | 1 | 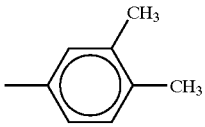 | 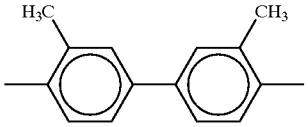 | —CH═CHSi$(OEt)_3$ |
| 154 | 1 | 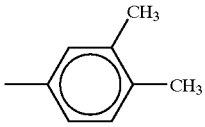 | 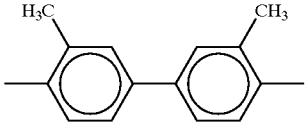 | —CH═$CHCH_2$— —$Si(OMe)_2Me$ |
| 155 | 1 | 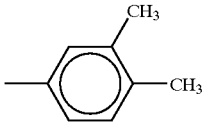 | 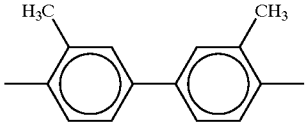 | —CH═$CH(CH_2)_2$— —$Si(OMe)_3$ |
45
TABLE 32
| Compound | k | $Ar^1$ | $Ar^2$ | $Ar^3$ |
|---|---|---|---|---|
| 156 | 1 | 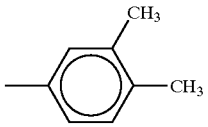 | 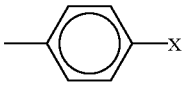 | 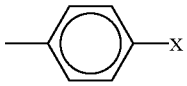 |
| 157 | 1 | 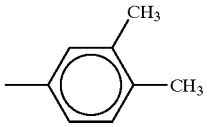 | 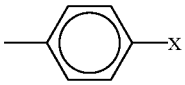 | 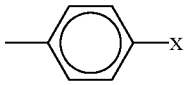 |

TABLE 32-continued
| | | | | |
|---|---|---|---|---|
| 158 | 1 | 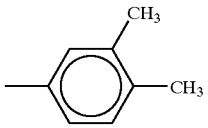 | 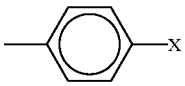 | 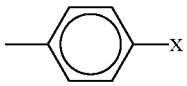 |
| 159 | 1 | 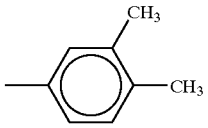 | 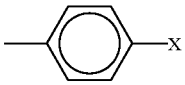 | 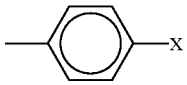 |
| 160 | 0 | 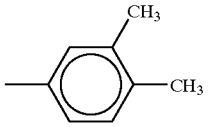 | 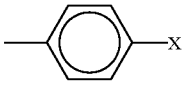 | 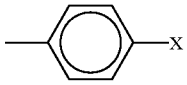 |
| Compound | k | $Ar^4$ | $Ar^5$ | X |
|---|---|---|---|---|
| 156 | 1 | 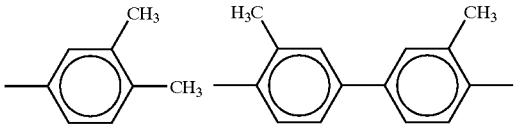 | | —CH═CH$(CH_2)_2$— —SiMe$(OMe)_2$ |
| 157 | 1 | 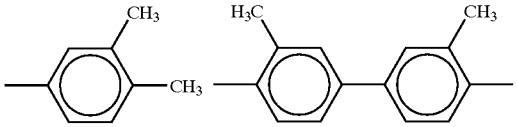 | | —CH═CH$(CH_2)_2$— —SiMe$_2$(OMe) |
| 158 | 1 | 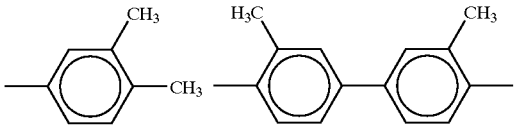 | | —CH═CH$(CH_2)_2$— —Si$(OEt)_3$ |
| 159 | 1 | 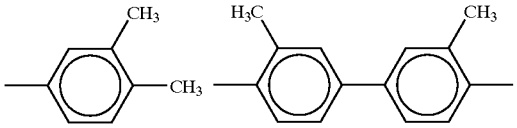 | | —CH═CH$C_6H_4$— —Si$(OMe)_3$ |
| 160 | 0 | 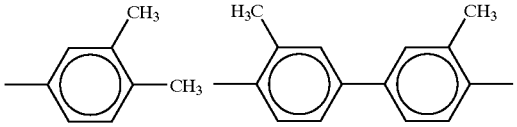 | | —CH═CH$C_6H_4$— —$(CH_2)_2$Si$(OMe)_3$ |
TABLE 33
| Compound | k | $Ar^1$ | $Ar^2$ | $Ar^3$ |
|---|---|---|---|---|
| 161 | 1 | 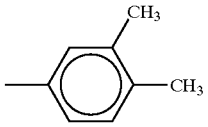 | 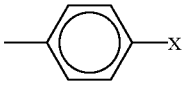 | 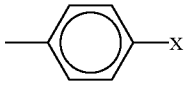 |

TABLE 33-continued
| | | | | |
|---|---|---|---|---|
| 162 | 1 | 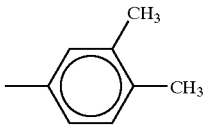 | 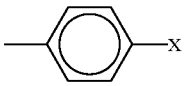 | 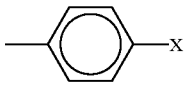 |
| 163 | 1 | 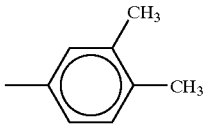 | 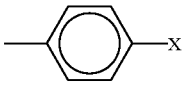 | 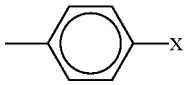 |
| 164 | 1 | 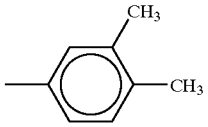 | 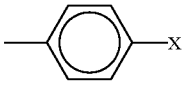 | 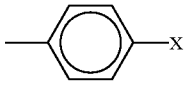 |
| 165 | 1 | 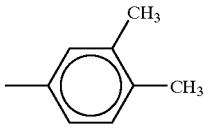 | 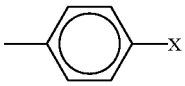 | 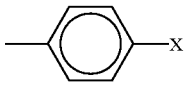 |
| Compound | k | $Ar^4$ | $Ar^5$ | X |
|---|---|---|---|---|
| 161 | 1 | 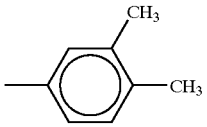 | 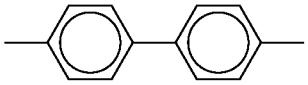 | —CH═CHCH$_2$— —Si(OMe)$_2$Me |
| 162 | 1 | 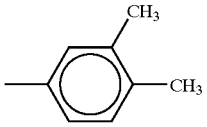 | 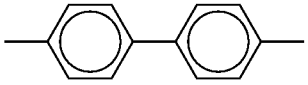 | —CH═CH(CH$_2$)$_2$— —Si(OMe)$_3$ |
| 163 | 1 | 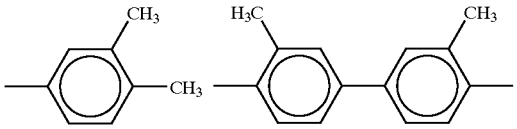 | | —CH═NCH$_2$— —Si(OMe)$_2$Me |
| 164 | 1 | 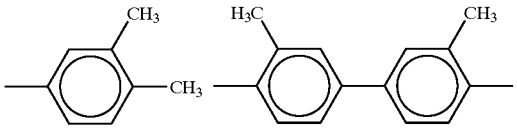 | | —CH═N(CH$_2$)$_2$— —Si(OEt)$_3$ |
| 165 | 1 | 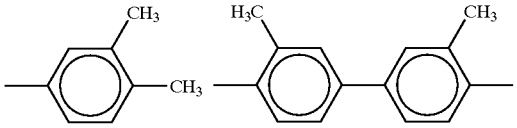 | | —CH═N(CH$_2$)$_3$— —Si(OMe)$_3$ |

TABLE 34
| Compound | k | $Ar^1$ | $Ar^2$ | $Ar^3$ | $Ar^4$ |
|---|---|---|---|---|---|
| 166 | 1 | 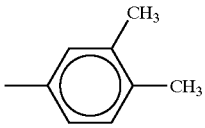 | 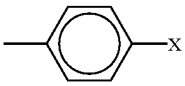 | 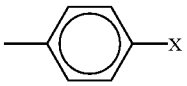 | 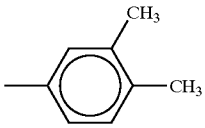 |
| 167 | 1 | 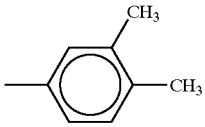 | 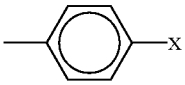 | 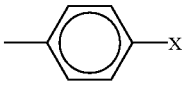 | 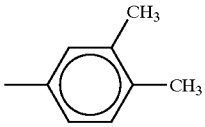 |
| 168 | 1 | 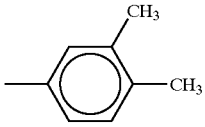 | 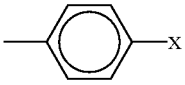 | 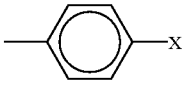 | 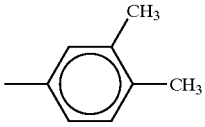 |
| 169 | 1 | 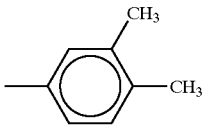 | 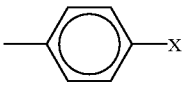 | 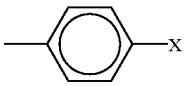 | 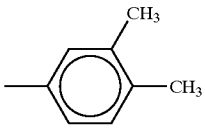 |
| 170 | 1 | 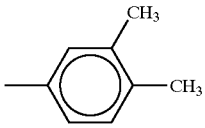 | 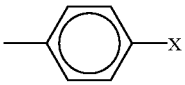 | 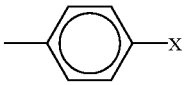 | 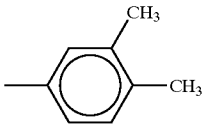 |
| Compound | k | $Ar^5$ | X |
|---|---|---|---|
| 166 | 1 | 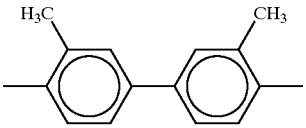 | 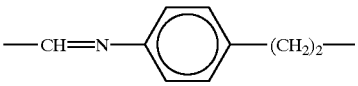 <br> —Si(OMe)$_3$ |
| 167 | 1 | 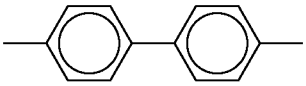 | —CH═NCH$_2$— <br> —Si(OMe)$_2$Me |
| 168 | 1 | 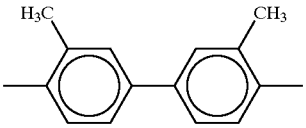 | —O(CH$_2$)$_3$Si(OMe)$_3$ |
| 169 | 1 | 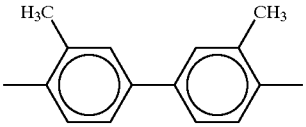 | —O(CH$_2$)$_3$— <br> —SiMe(OMe)$_2$ |
| 170 | 1 | 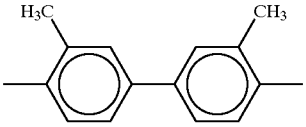 | —O(CH$_2$)$_3$Si(OEt)$_3$ |

TABLE 35
| Compound | k | $Ar^1$ | $Ar^2$ | $Ar^3$ |
|---|---|---|---|---|
| 171 | 1 | 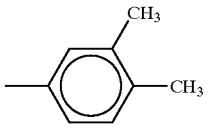 | 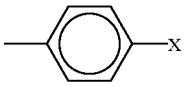 | 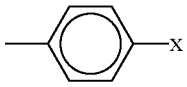 |
| 172 | 1 | 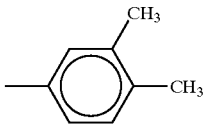 | 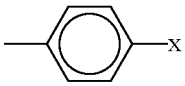 | 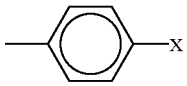 |
| 173 | 1 | 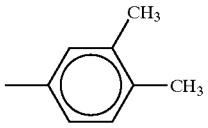 | 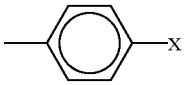 | 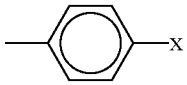 |
| 174 | 1 | 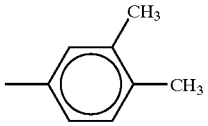 | 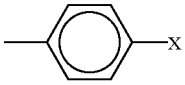 | 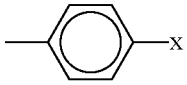 |
| 175 | 1 | 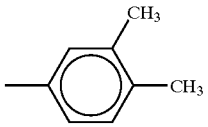 | 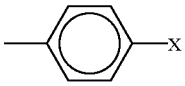 | 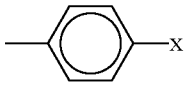 |
| Compound | k | $Ar^4$ | $Ar^5$ | X |
|---|---|---|---|---|
| 171 | 1 | 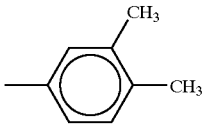 | 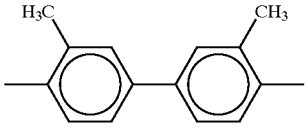 | $—CH_2O(CH_2)_3—$ $—Si(OMe)_3$ |
| 172 | 1 | 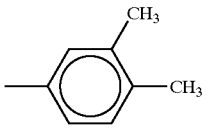 | 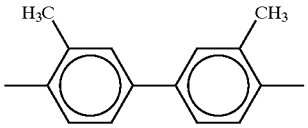 | $—(CH_2)_3O(CH_2)_3—$ $—Si(OMe)_3$ |
| 173 | 1 | 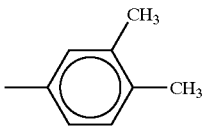 | 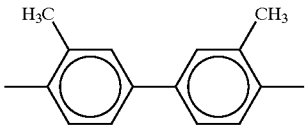 | $—COO(CH_2)_3—$ $—Si(OMe)_3$ |
| 174 | 1 | 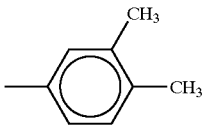 | 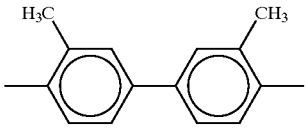 | $—COOCH_2C_6H_4—$ $—(CH_2)_2Si(OMe)_3$ |
| 175 | 1 | 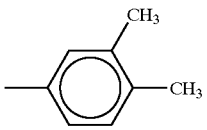 | 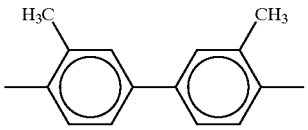 | $—CH_2COO(CH_2)_3—$ $—Si(OMe)_3$ |

TABLE 36
| Compound | k | $Ar^1$ | $Ar^2$ | $Ar^3$ |
|---|---|---|---|---|
| 176 | 1 | 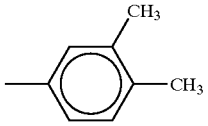 | 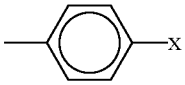 | 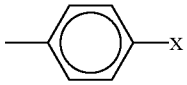 |
| 177 | 1 | 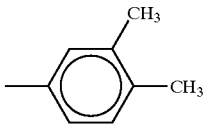 | 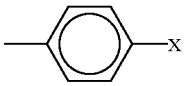 | 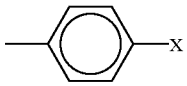 |
| 178 | 1 | 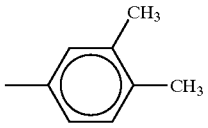 | 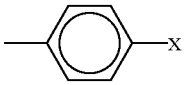 | 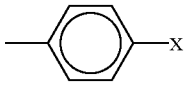 |
| 179 | 1 | 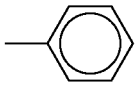 | 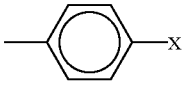 | 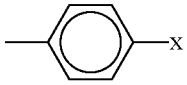 |
| 180 | 1 | 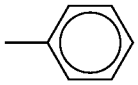 | 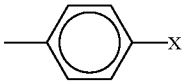 | 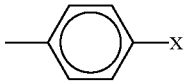 |
| Compound | k | $Ar^4$ | $Ar^5$ | X |
|---|---|---|---|---|
| 176 | 1 | 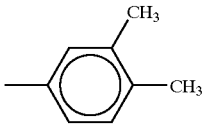 | 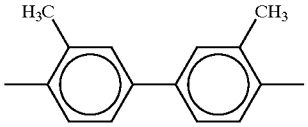 | —$CH_2COO$—<br>—$CH_2C_6H_4(CH_2)_2$—<br>—$Si(OMe)_3$ |
| 177 | 1 | 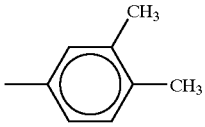 | 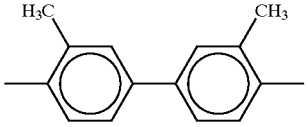 | —$(CH_2)_2COO$—<br>—$(CH_2)_3Si(OMe)_3$ |
| 178 | 1 | 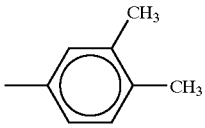 | 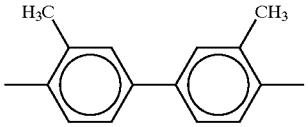 | —$(CH_2)_2COO$—<br>—$CH_2C_6H_4(CH_2)_2$—<br>—$Si(OMe)_3$ |
| 179 | 1 | 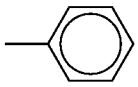 | 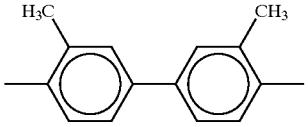 | —$COOCH_2C_6H_4$—<br>—$(CH_2)_2Si(OMe)_3$ |
| 180 | 1 | 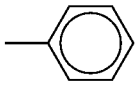 | 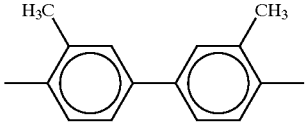 | —$CH_2COO(CH_2)_3$—<br>—$Si(OMe)_3$ |

TABLE 37
| Compound | k | $Ar^1$ | $Ar^2$ | $Ar^3$ |
|---|---|---|---|---|
| 181 | 1 | 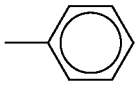 | 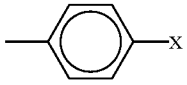 | 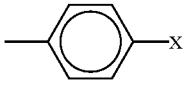 |
| 182 | 1 | 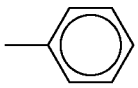 | 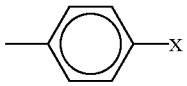 | 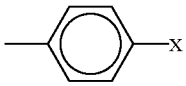 |
| 183 | 1 | 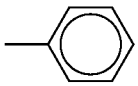 | 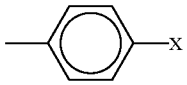 | 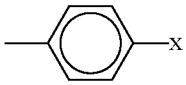 |
| 184 | 1 | 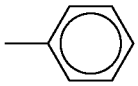 | 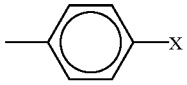 | 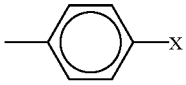 |
| 185 | 1 | 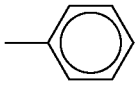 | 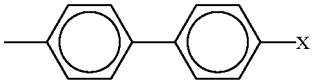 | 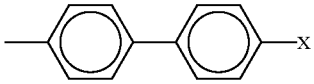 |
| Compound | k | $Ar^4$ | $Ar^5$ | X |
|---|---|---|---|---|
| 181 | 1 | 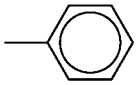 | 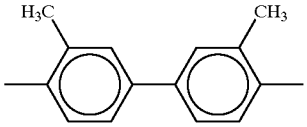 | —$CH_2COOCH_2$—<br>—$C_6H_4Si(OMe)_3$ |
| 182 | 1 | 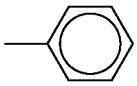 | 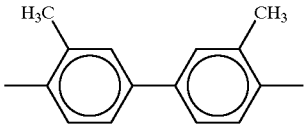 | —$CH_2COO$—<br>—$CH_2C_6H_4(CH_2)_2$—<br>—$Si(OMe)_3$ |
| 183 | 1 | 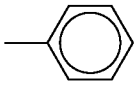 | 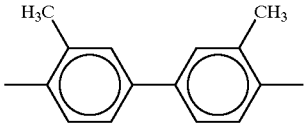 | —$(CH_2)_2COO$—<br>—$(CH_2)_3Si(OMe)_3$ |
| 184 | 1 | 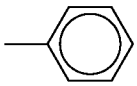 | 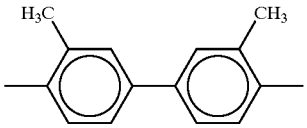 | —$(CH_2)_2COO$—<br>—$CH_2C_6H_4(CH_2)_2$—<br>—$Si(OMe)_3$ |
| 185 | 1 | 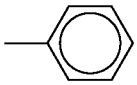 | 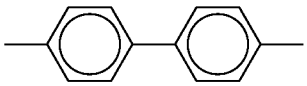 | —$COO(CH_2)_3$—<br>—$Si(OMe)_3$ |
TABLE 38
| Compound | k | $Ar^1$ | $Ar^2$ | $Ar^3$ |
|---|---|---|---|---|
| 186 | 1 | 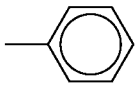 | 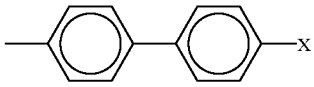 | 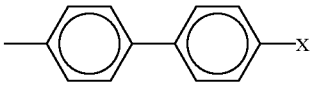 |

TABLE 38-continued
| | | | | |
|---|---|---|---|---|
| 187 | 1 | 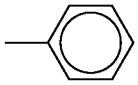 | 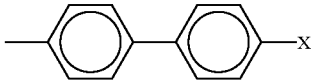 | 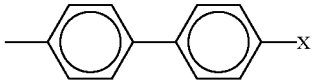 |
| 188 | 1 | 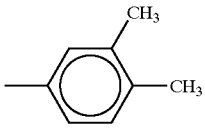 | 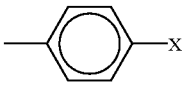 | 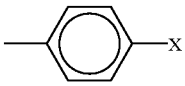 |
| 189 | 1 | 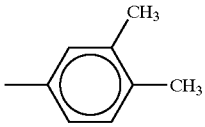 | 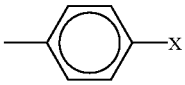 | 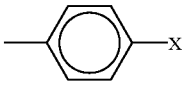 |
| 190 | 1 | 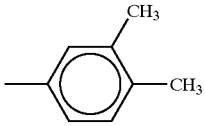 | 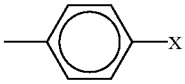 | 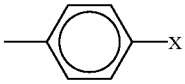 |
| Compound | k | $Ar^4$ | $Ar^5$ | X |
|---|---|---|---|---|
| 186 | 1 | 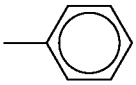 | 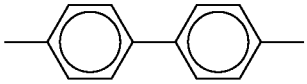 | —$COOCH_2C_6H_4$— —$Si(OMe)_3$ |
| 187 | 1 | 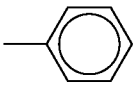 | 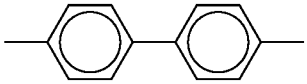 | —$COOCH_2C_6H_4$— —$(CH_2)_3Si(OMe)_3$ |
| 188 | 1 | 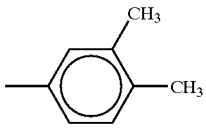 | 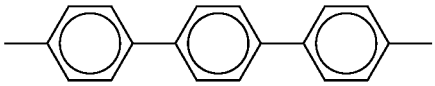 | —$COO(CH_2)_3$— —$Si(OMe)_3$ |
| 189 | 1 | 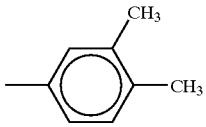 | 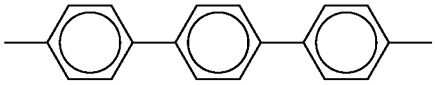 | —$COOCH_2C_6H_4$— —$Si(OMe)_3$ |
| 190 | 1 | 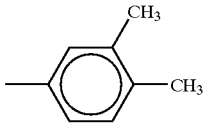 | 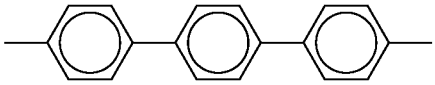 | —$COOCH_2C_6H_4$— —$(CH_2)_3Si(OMe)_3$ |
TABLE 39
| Compound | k | $Ar^1$ | $Ar^2$ | $Ar^3$ | $Ar^4$ |
|---|---|---|---|---|---|
| 191 | 1 | 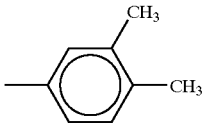 | 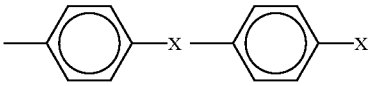 | | 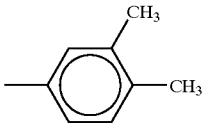 |

TABLE 39-continued
| | | | | | |
|---|---|---|---|---|---|
| 192 | 1 | 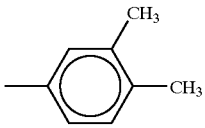 | 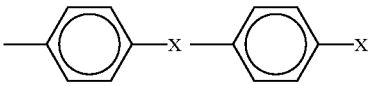 | 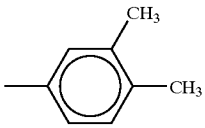 | |
| 193 | 1 | 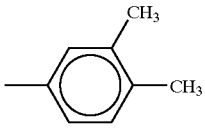 | 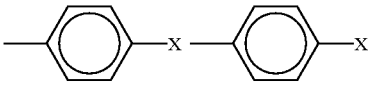 | 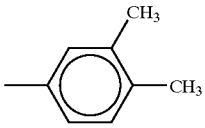 | |
| 194 | 0 | 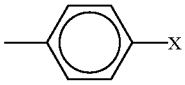 | 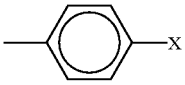 | — | — |
| 195 | 0 | 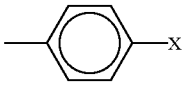 | 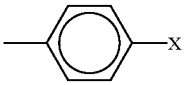 | — | — |
| Compound | k | $Ar^5$ | X |
|---|---|---|---|
| 191 | 1 | 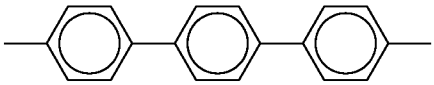 | —$CH_2COO(CH_2)_3$— —$Si(OMe)_3$ |
| 192 | 1 | 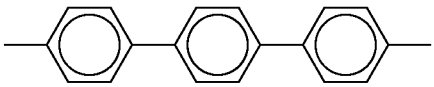 | —$(CH_2)_3COO$— —$(CH_2)_3Si(OMe)_3$ |
| 193 | 1 | 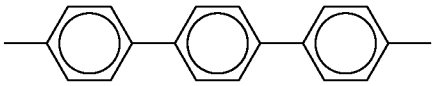 | —$(CH_2)_2COO$— —$CH_2C_6H_4(CH_2)_2$— —$Si(OMe)_3$ |
| 194 | 0 | 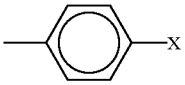 | —$(CH_2)_3$— —$Si(OMe)_2Me$ |
| 195 | 0 | 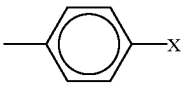 | —$(CH_2)_3Si(OEt)_3$ |
45
TABLE 40
| Compound | k | $Ar^1$ | $Ar^2$ | $Ar^3$ | $Ar^4$ | $Ar^5$ | X |
|---|---|---|---|---|---|---|---|
| 196 | 0 | 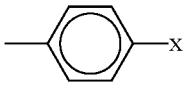 | 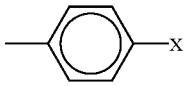 | — | — | 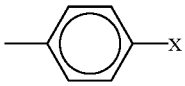 | —$(CH_2)_4Si(OMe)_3$ |
| 197 | 0 | 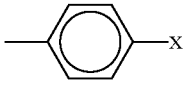 | 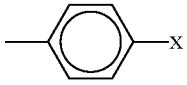 | — | — | 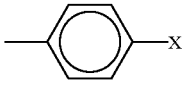 | —$(CH_2)_4$— —$Si(OMe)_2Me$ |
| 198 | 0 | 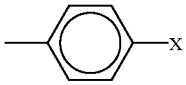 | 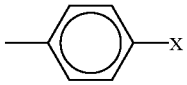 | — | — | 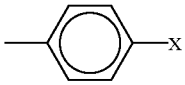 | —$(CH_2)_4SiMe_2(OMe)$ |

TABLE 40-continued
| Compound | k | $Ar^1$ | $Ar^2$ | $Ar^3$ | $Ar^4$ | $Ar^5$ | X |
|---|---|---|---|---|---|---|---|
| 199 | 0 | 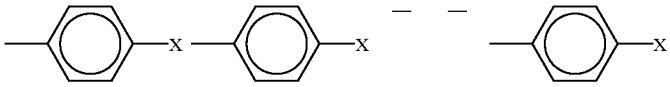 | | — | — | | $—(CH_2)_4Si(OEt)_3$ |
| 200 | 0 | 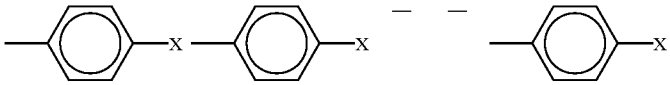 | | — | — | | $—(CH_2)_{12}Si(OMe)_3$ |
TABLE 41
| Compound | k | $Ar^1$ | $Ar^2$ | $Ar^3$ | $Ar^4$ | $Ar^5$ | X |
|---|---|---|---|---|---|---|---|
| 201 | 0 | 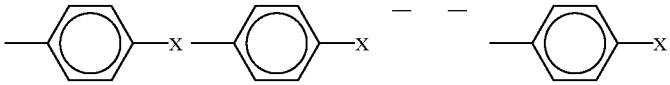 | | — | — | | $—(CH_2)_2C_6H_4—$ $—Si(OMe)_3$ |
| 202 | 0 | 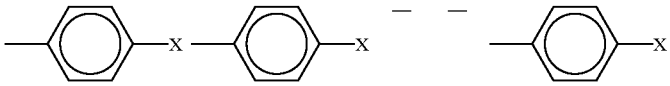 | | — | — | | $—(CH_2)_3C_6H_4—$ $—(CH_2)_2Si(OMe)_3$ |
| 203 | 0 | 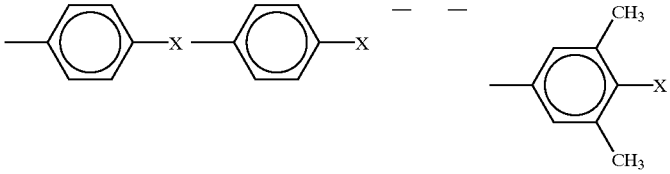 | | — | — | | $—(CH_2)_4Si(OMe)_3$ |
| 204 | 0 | 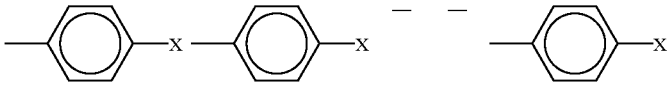 | | — | — | | $—CH{=}CHSi(OMe)_3$ |
| 205 | 0 | 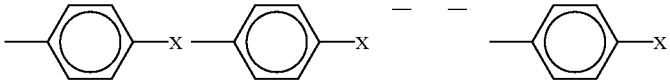 | | — | — | | $—CH{=}CHCH_2—$ $—Si(OMe)_2Me$ |
TABLE 42
| Compound | k | $Ar^1$ | $Ar^2$ | $Ar^3$ | $Ar^4$ | $Ar^5$ | X |
|---|---|---|---|---|---|---|---|
| 206 | 0 | 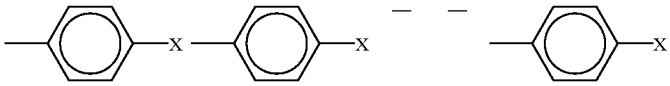 | | — | — | | $—CH{=}CH(CH_2)_2—$ $—Si(OMe)_3$ |
| 207 | 0 | 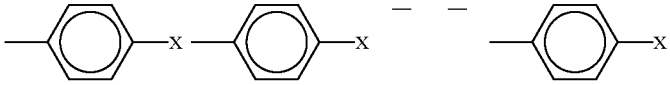 | | — | — | | $—CH{=}CH(CH_2)_3—$ $—SiMe(OMe_3)_2$ |
| 208 | 0 | 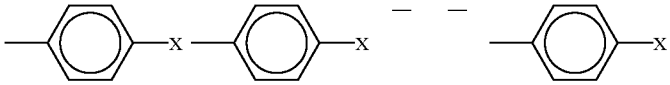 | | — | — | | $—CH{=}CH(CH_2)_2—$ $—SiMe_2(OMe)$ |
| 209 | 0 | 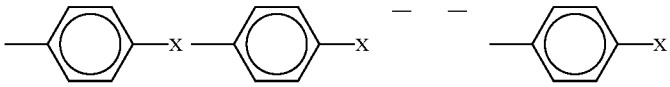 | | — | — | | $—CH{=}CH(CH_2)_2—$ $—Si(OEt)_3$ |

TABLE 42-continued
| Compound | k | $Ar^1$ | $Ar^2$ | $Ar^3$ | $Ar^4$ | $Ar^5$ | X |
|---|---|---|---|---|---|---|---|
| 210 | 0 | 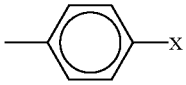 | 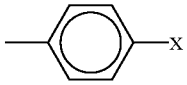 | — | — | 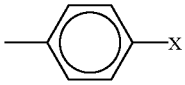 | —CH═CH$(CH_2)_{10}$— —Si$(OMe)_3$ |
TABLE 43
| Compound | k | $Ar^1$ | $Ar^2$ | $Ar^3$ | $Ar^4$ | $Ar^5$ | X |
|---|---|---|---|---|---|---|---|
| 211 | 0 | 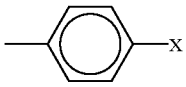 | 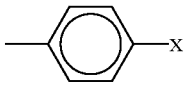 | — | — | 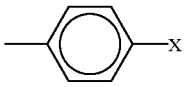 | —CH═CH$C_6H_4$— —Si$(OMe)_3$ |
| 212 | 0 | 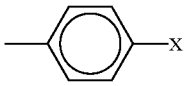 | 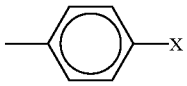 | — | — | 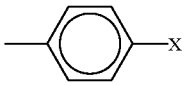 | —CH═CH$C_6H_4$— —$(CH_2)_2$Si$(OMe)_3$ |
| 213 | 0 | 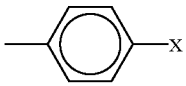 | 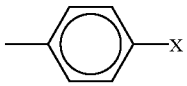 | — | — | 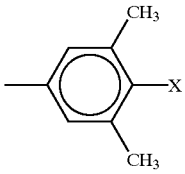 | —CH═CH$(CH_2)_2$— —Si$(OMe)_3$ |
| 214 | 0 | 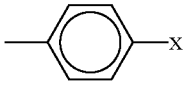 | 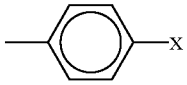 | — | — | 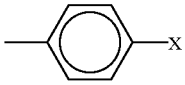 | —CH═N$(CH_2)_3$— —Si$(OMe)_3$ |
| 215 | 0 | 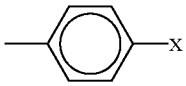 | 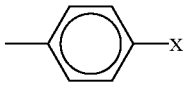 | — | — | 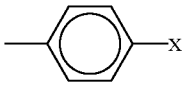 | —CH═N$(CH_2)_3$— —Si$(OEt)_3$ |
TABLE 44
| Compound | k | $Ar^1$ | $Ar^2$ | $Ar^3$ | $Ar^4$ | $Ar^5$ | X |
|---|---|---|---|---|---|---|---|
| 216 | 0 | 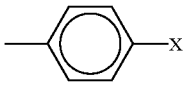 | 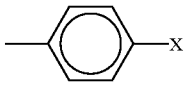 | — | — | 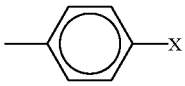 | —CH═N$CH_2$— —Si$(OMe)_2$Me |
| 217 | 0 | 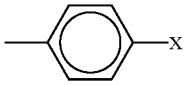 | 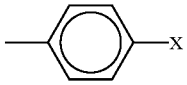 | — | — | 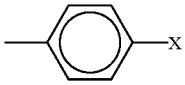 | —CH═N$C_6H_4$— —$(CH_2)_3$Si$(OMe)_3$ |
| 218 | 0 | 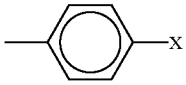 | 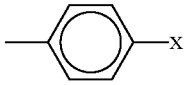 | — | — | 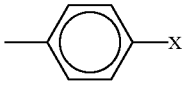 | —CH═N$(CH_2)_3$— —Si$(OMe)_3$ |
| 219 | 0 | 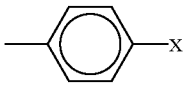 | 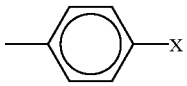 | — | — | 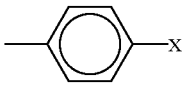 | —O$(CH_2)_3$Si$(OMe)_3$ |

TABLE 44-continued
| Compound | k | $Ar^1$ | $Ar^2$ | $Ar^3$ | $Ar^4$ | $Ar^5$ | X |
|---|---|---|---|---|---|---|---|
| 220 | 0 | 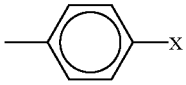 | 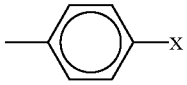 | — | — | 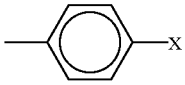 | —O(CH$_2$)$_3$— —Si(OMe)$_2$Me |
TABLE 45
| Compound | k | $Ar^1$ | $Ar^2$ | $Ar^3$ |
|---|---|---|---|---|
| 221 | 0 | 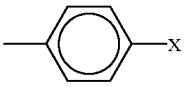 | 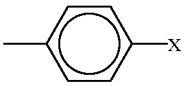 | — |
| 222 | 0 | 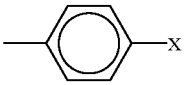 | 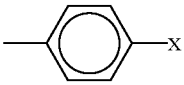 | — |
| 223 | 0 | 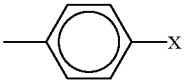 | 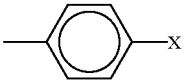 | — |
| 224 | 1 | 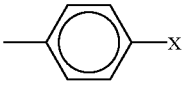 | 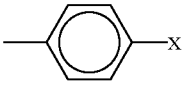 | 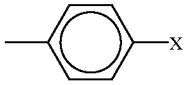 |
| 225 | 1 | 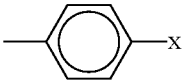 | 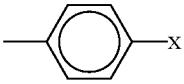 | 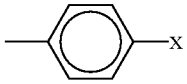 |
| Compound | k | $Ar^4$ | $Ar^5$ | X |
|---|---|---|---|---|
| 221 | 0 | — | 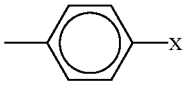 | —O(CH$_2$)$_3$Si(OEt)$_3$ |
| 222 | 0 | — | 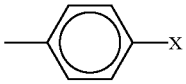 | —CH$_2$O(CH$_2$)$_3$— —Si(OMe)$_3$ |
| 223 | 0 | — | 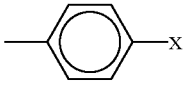 | —(CH$_2$)$_3$O(CH$_2$)$_3$— —Si(OMe)$_2$Me |
| 224 | 1 | 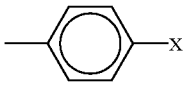 | 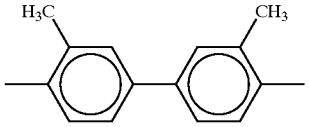 | —(CH$_2$)$_4$Si(OEt)$_3$ |
| 225 | 1 | 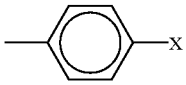 | 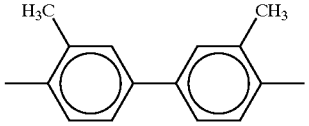 | —(CH$_2$)$_3$Si(OEt)$_3$ |

TABLE 46
| Compound | k | $Ar^1$ | $Ar^2$ | $Ar^3$ |
|---|---|---|---|---|
| 226 | 1 | 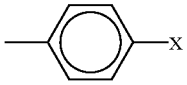 | 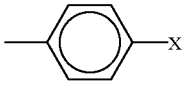 | 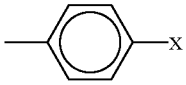 |
| 227 | 1 | 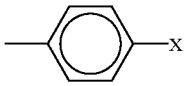 | 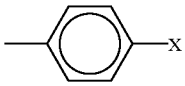 | 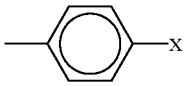 |
| 228 | 1 | 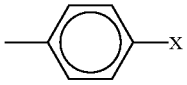 | 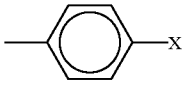 | 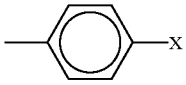 |
| 229 | 1 | 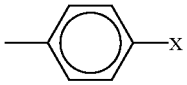 | 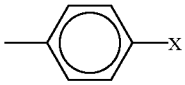 | 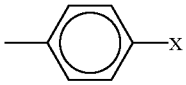 |
| 230 | 1 | 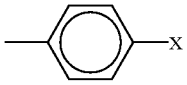 | 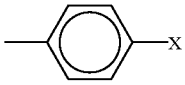 | 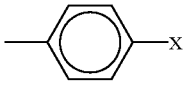 |
| Compound | k | $Ar^4$ | $Ar^5$ | X |
|---|---|---|---|---|
| 226 | 1 | 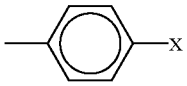 | 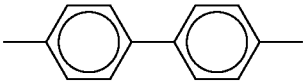 | —$CH_2CH_2$—$(CH_2)_2$— —$Si(OMe)_3$ |
| 227 | 1 | 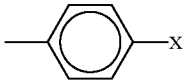 | 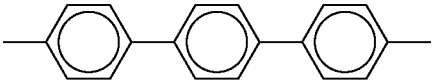 | —$CH_2CH_2$—$(CH_2)_2$— —$Si(OMe)_3$ |
| 228 | 1 | 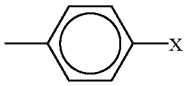 | 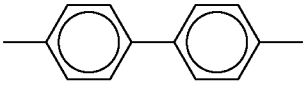 | —$CH_2CH_2$—$CH_2$— —$Si(OMe)_2Me$ |
| 229 | 1 | 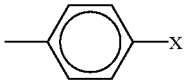 | 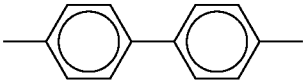 | —$CH_2CH_2$—$C_6H_4$— —$Si(OMe)_2Me$ |
| 230 | 1 | 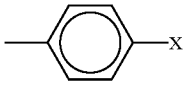 | 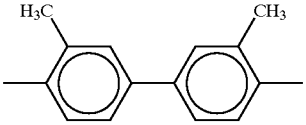 | —CH═$CH(CH_2)_2$— —$Si(OMe)_3$ |
TABLE 47
| Compound | k | $Ar^1$ | $Ar^2$ | $Ar^3$ |
|---|---|---|---|---|
| 231 | 1 | 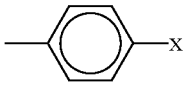 | 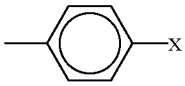 | 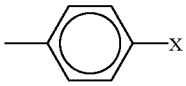 |
| 232 | 1 | 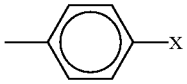 | 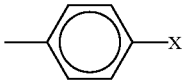 | 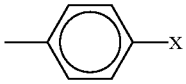 |

TABLE 47-continued
| | | | | |
|---|---|---|---|---|
| 233 | 1 | 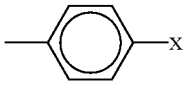 | 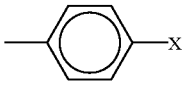 | 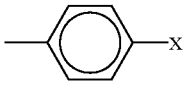 |
| 234 | 1 | 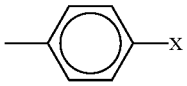 | 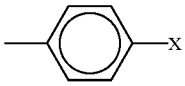 | 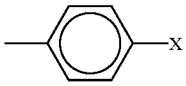 |
| 235 | 1 | 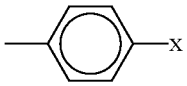 | 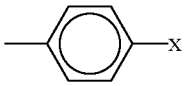 | 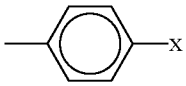 |
| Compound | k | $Ar^4$ | $Ar^5$ | X |
|---|---|---|---|---|
| 231 | 1 | 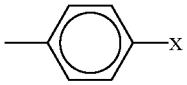 | 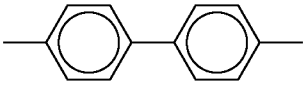 | —CH═CH$(CH_2)_2$— —Si$(OMe)_3$ |
| 232 | 1 | 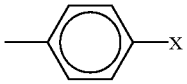 | 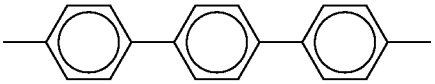 | —CH═CH$(CH_2)_2$— —Si$(OMe)_3$ |
| 233 | 1 | 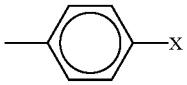 | 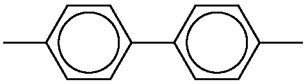 | —CH═$CHCH_2$——Si $(OMe)_2Me$ |
| 234 | 1 | 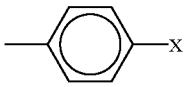 | 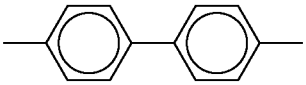 | —CH═$CHC_6H_4$— —Si$(OMe)_3$ |
| 235 | 1 | 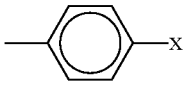 | 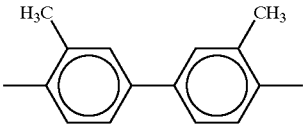 | —CH═N$(CH_2)_3$— —Si$(OMe)_3$ |
TABLE 48
| Compound | k | $Ar^1$ | $Ar^2$ | $Ar^3$ |
|---|---|---|---|---|
| 236 | 1 | 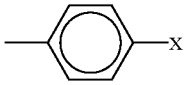 | 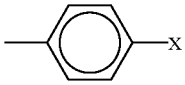 | 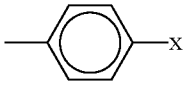 |
| 237 | 1 | 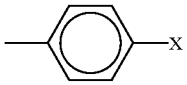 | 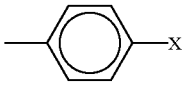 | 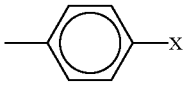 |
| 238 | 1 | 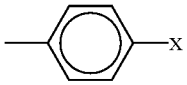 | 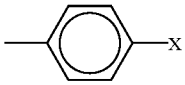 | 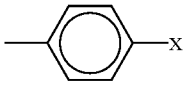 |
| 239 | 1 | 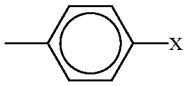 | 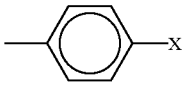 | 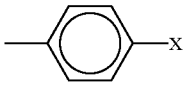 |
| 240 | 1 | 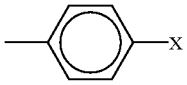 | 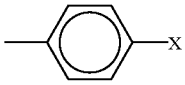 | 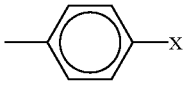 |

TABLE 48-continued
| Compound | k | $Ar^4$ | $Ar^5$ | X |
|---|---|---|---|---|
| 236 | 1 | 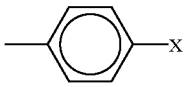 | 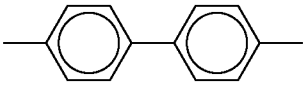 | —CH═N$(CH_2)_3$— —Si$(OMe)_3$ |
| 237 | 1 | 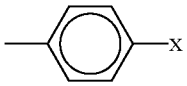 | 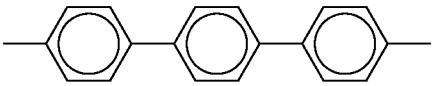 | —CH═N$(CH_2)_3$— —Si$(OMe)_3$ |
| 238 | 1 | 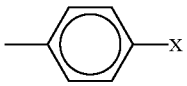 | 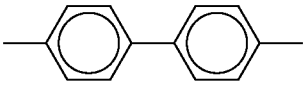 | —CH═N$CH_2$— —Si$(OMe)_2$Me |
| 239 | 1 | 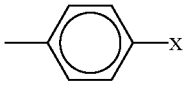 | 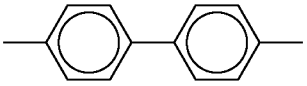 | —CH═N$C_6H_4$— —$(CH_2)_2$Si$(OMe)_3$ |
| 240 | 1 | 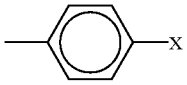 | 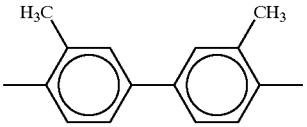 | —O$(CH_2)_3$Si$(OMe)_3$ |
TABLE 49
| Compound | k | $Ar^1$ | $Ar^2$ | $Ar^3$ |
|---|---|---|---|---|
| 241 | 1 | 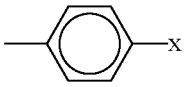 | 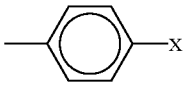 | 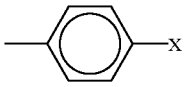 |
| 242 | 1 | 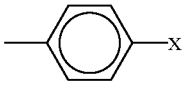 | 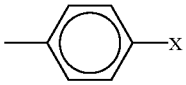 | 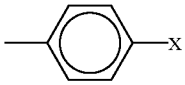 |
| 243 | 1 | 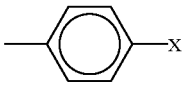 | 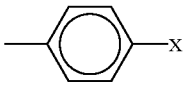 | 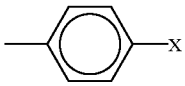 |
| 244 | 1 | 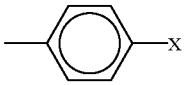 | 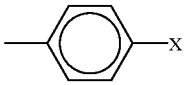 | 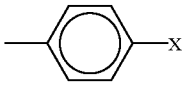 |
| 245 | 0 | 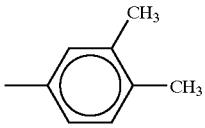 | 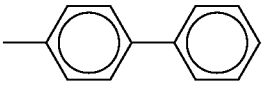 | — |
| Compound | k | $Ar^4$ | $Ar^5$ | X |
|---|---|---|---|---|
| 241 | 1 | 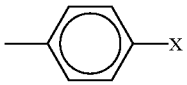 | 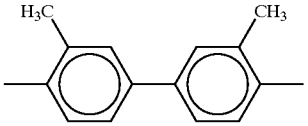 | —O$(CH_2)_3$Si$(OEt)_3$ |

TABLE 49-continued
| | | | | |
|---|---|---|---|---|
| 242 | 1 | 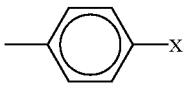 | 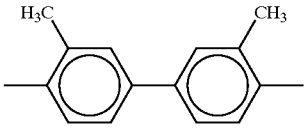 | —$CH_2O(CH_2)_3$—<br>—$Si(OMe)_3$ |
| 243 | 1 | 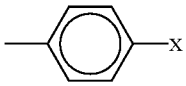 | 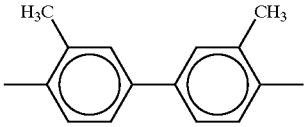 | —$CH_2O(CH_2)_3$—<br>—$Si(OEt)_3$ |
| 244 | 1 | 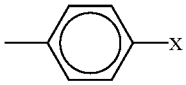 | 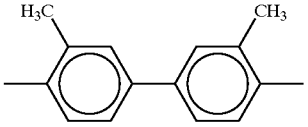 | —$(CH_2)_3O(CH_2)_3$—<br>—$Si(OMe)_3$ |
| 245 | 0 | — | 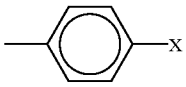 | —$COO(CH_2)_3$—<br>—$Si(O^iPr)_3$ |
25
TABLE 50
| Compound | k | $Ar^1$ | $Ar^2$ | $Ar^3$ | $Ar^4$ | $Ar^5$ | X |
|---|---|---|---|---|---|---|---|
| 246 | 0 | 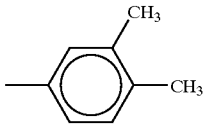 | 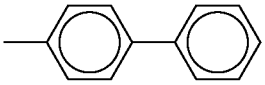 | — | — | 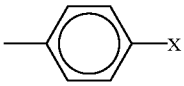 | —$COOCH_2C_6H_4$—<br>—$(CH_2)_2Si(O^iPr)_3$ |
| 247 | 0 | 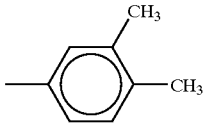 | 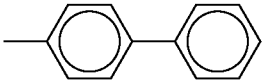 | — | — | 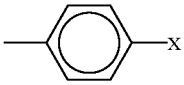 | —$CH_2COO(CH_2)_3$—<br>—$Si(O^iPr)_3$ |
| 248 | 0 | 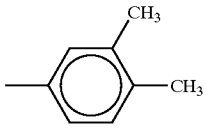 | 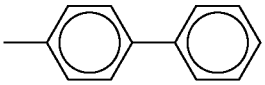 | — | — | 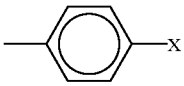 | —$CH_2COOCH_2$—<br>—$C_6H_4(CH_2)_2$—<br>—$Si(O^iPr)_3$ |
| 249 | 0 | 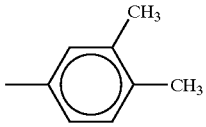 | 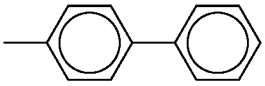 | — | — | 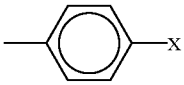 | —$(CH_2)_2COO$—<br>—$(CH_2)_3Si(O^iPr)_3$ |
| 250 | 0 | 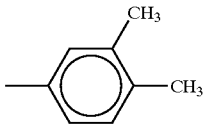 | 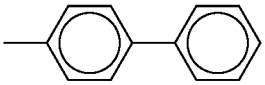 | — | — | 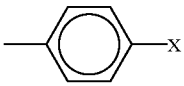 | —$(CH_2)_2COOCH_2$—<br>—$C_6H_4(CH_2)_2$—<br>—$Si(O^iPr)_3$ |

TABLE 51
| Compound | k | $Ar^1$ | $Ar^2$ | $Ar^3$ |
|---|---|---|---|---|
| 251 | 1 | 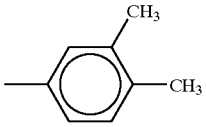 | 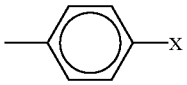 | 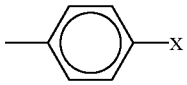 |
| 252 | 1 | 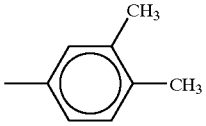 | 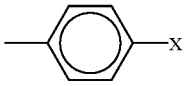 | 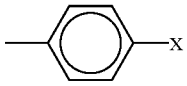 |
| 253 | 1 | 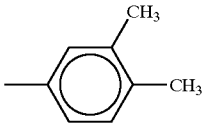 | 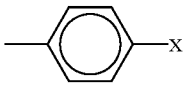 | 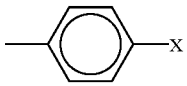 |
| 254 | 1 | 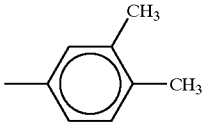 | 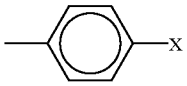 | 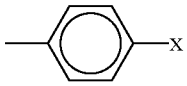 |
| 255 | 1 | 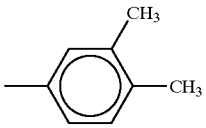 | 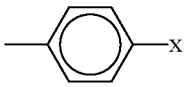 | 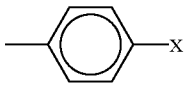 |
| Compound | k | $Ar^4$ | $Ar^5$ | X |
|---|---|---|---|---|
| 251 | 1 | 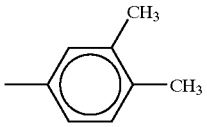 | 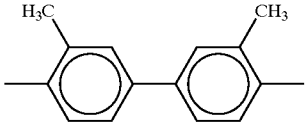 | —COO$(CH_2)_3$— —Si$(O^iPr)_3$ |
| 252 | 1 | 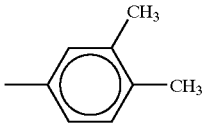 | 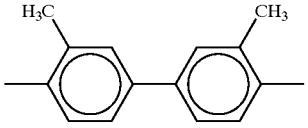 | —COO$CH_2C_6H_4$— —$(CH_2)_2$Si$(O^iPr)_3$ |
| 253 | 1 | 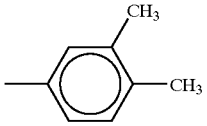 | 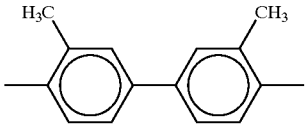 | —$CH_2$COO$(CH_2)_3$— —Si$(O^iPr)_3$ |
| 254 | 1 | 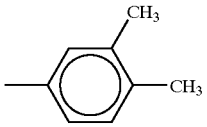 | 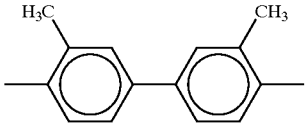 | —$CH_2$COO$CH_2$— —$C_6H_4(CH_2)_2$— —Si$(O^iPr)_3$ |
| 255 | 1 | 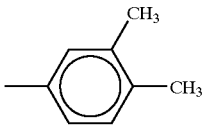 | 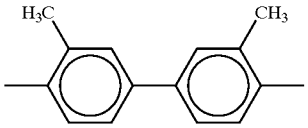 | —$(CH_2)_2$COO— —$(CH_2)_3$Si$(O^iPr)_3$ |

TABLE 52
| Compound | k | $Ar^1$ | $Ar^2$ | $Ar^3$ |
|---|---|---|---|---|
| 256 | 1 | 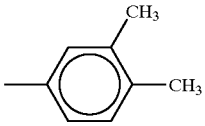 | 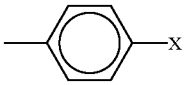 | 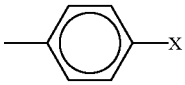 |
| 257 | 0 | 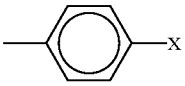 | 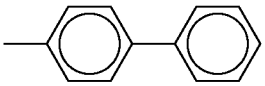 | — |
| 258 | 0 | 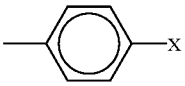 | 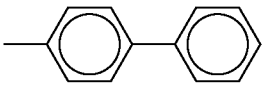 | — |
| 259 | 0 | 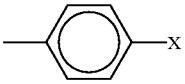 | 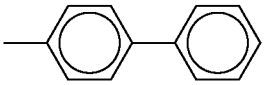 | — |
| 260 | 0 | 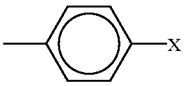 | 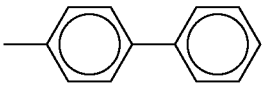 | — |
| Compound | k | $Ar^4$ | $Ar^5$ | X |
|---|---|---|---|---|
| 256 | 1 | 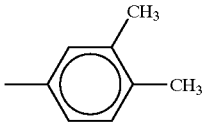 | 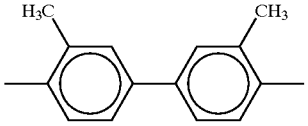 | —$(CH_2)_2COOCH_2$—<br>—$C_6H_4(CH_2)_2$—<br>—$Si(O^iPr)_3$ |
| 257 | 0 | — | 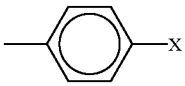 | —$COO(CH_2)_3$—<br>—$Si(O^iPr)_3$ |
| 258 | 0 | — | 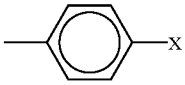 | —$COOCH_2C_6H_4$—<br>—$(CH_2)_2Si(O^iPr)_3$ |
| 259 | 0 | — | 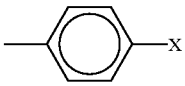 | —$CH_2COO(CH_2)_3$—<br>—$Si(O^iPr)_3$ |
| 260 | 0 | — | 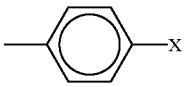 | —$CH_2COOCH_2$—<br>—$C_6H_4(CH_2)_2$—<br>—$Si(O^iPr)_3$ |
TABLE 53
| Compound | k | $Ar^1$ | $Ar^2$ | $Ar^3$ |
|---|---|---|---|---|
| 261 | 0 | 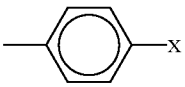 | 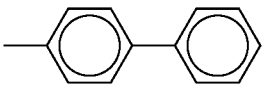 | — |
| 262 | 0 | 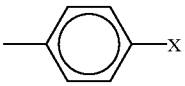 | 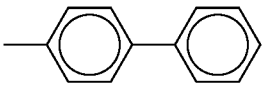 | — |

TABLE 53-continued
| | | | | |
|---|---|---|---|---|
| 263 | 1 | 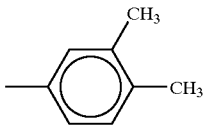 | 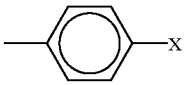 | 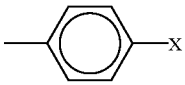 |
| 264 | 1 | 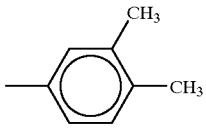 | 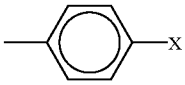 | 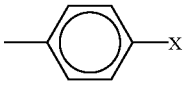 |
| 265 | 1 | 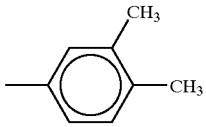 | 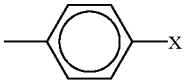 | 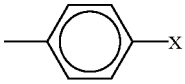 |
| Compound | k | $Ar^4$ | $Ar^5$ | X |
|---|---|---|---|---|
| 261 | 0 | — | 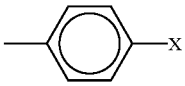 | —$(CH_2)_2$COO— —$(CH_2)_3Si(O^iPr)_3$ |
| 262 | 0 | — | 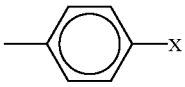 | —$(CH_2)_2COOCH_2$— —$C_6H_4(CH_2)_2$— —$Si(O^iPr)_3$ |
| 263 | 1 | 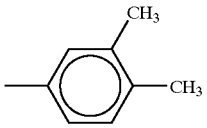 | 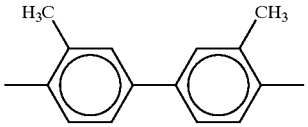 | —$COO(CH_2)_3$— —$SiMe(O^iPr)_2$ |
| 264 | 1 | 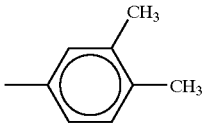 | 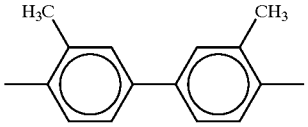 | —$COOCH_2C_6H_4$— —$(CH_2)_2$— —$SiMe(O^iPr)_2$ |
| 265 | 1 | 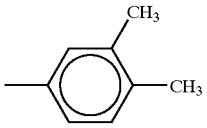 | 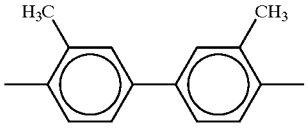 | —$CH_2COO(CH_2)_3$— —$SiMe(O^iPr)_2$ |
TABLE 54
| Compound | k | $Ar^1$ | $Ar^2$ | $Ar^3$ |
|---|---|---|---|---|
| 266 | 1 | 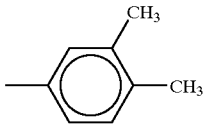 | 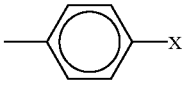 | 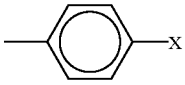 |
| 267 | 1 | 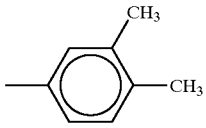 | 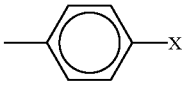 | 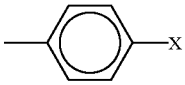 |

TABLE 54-continued

| | | | | |
|---|---|---|---|---|
| 268 | 1 | 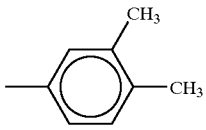 | 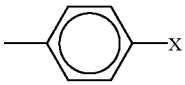 | 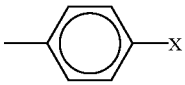 |
| 269 | 0 | 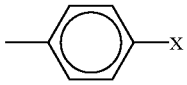 | 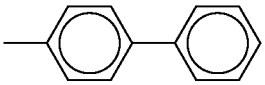 | — |
| 270 | 0 | 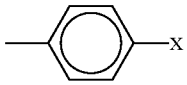 | 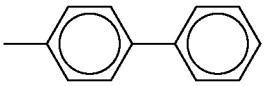 | — |

| Compound | k | $Ar^4$ | $Ar^5$ | X |
|---|---|---|---|---|
| 266 | 1 | 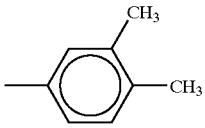 | 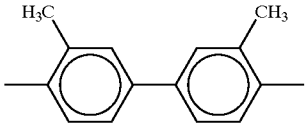 | —$CH_2COOCH_2$—<br>—$C_6H_4(CH_2)_2$—<br>—$SiMe(O^iPr)_2$ |
| 267 | 1 | 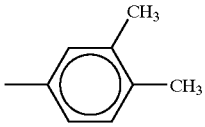 | 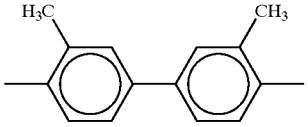 | —$(CH_2)_2COO$—<br>—$(CH_2)_3$—<br>—$SiMe(O^iPr)_2$ |
| 268 | 1 | 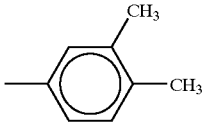 | 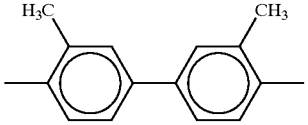 | —$(CH_2)_2COOCH_2$—<br>—$C_6H_4(CH_2)_2$—<br>—$SiMe(O^iPr)_2$ |
| 269 | 0 | — | 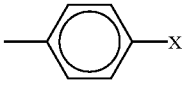 | —$COO(CH_2)_3$—<br>—$SiMe(O^iPr)_2$ |
| 270 | 0 | — | 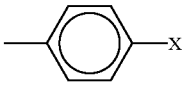 | —$COOCH_2C_6H_4$—<br>—$(CH_2)_2$—<br>—$SiMe(O^iPr)_2$ |

TABLE 55

| Compound | k | $Ar^1$ | $Ar^2$ | $Ar^3$ | $Ar^4$ | $Ar^5$ | X |
|---|---|---|---|---|---|---|---|
| 271 | 0 | 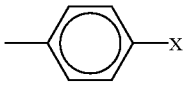 | 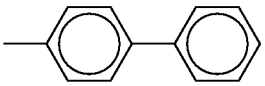 | — | — | 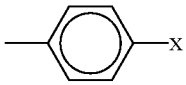 | —$CH_2COO(CH_2)_3$—<br>—$SiMe(O^iPr)_2$ |
| 272 | 0 | 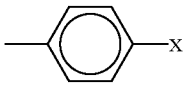 | 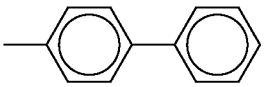 | — | — | 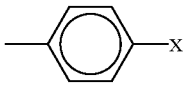 | —$CH_2COOCH_2$—<br>—$C_6H_4(CH_2)_2$—<br>—$SiMe(O^iPr)_2$ |
| 273 | 0 | 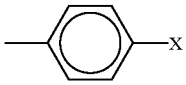 | 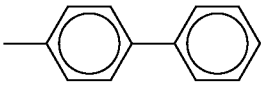 | — | — | 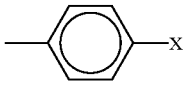 | —$(CH_2)_2COO$—<br>—$(CH_2)_3$—<br>—$SiMe(O^iPr)_2$ |

TABLE 55-continued

| Compound | k | $Ar^1$ | $Ar^2$ | $Ar^3$ | $Ar^4$ | $Ar^5$ | X |
|---|---|---|---|---|---|---|---|
| 274 | 0 | 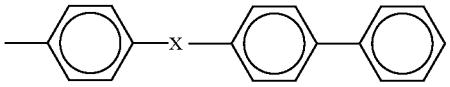 | | — | — | 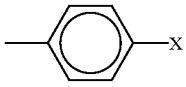 | —$(CH_2)_2COOCH_2$— —$C_6H_4(CH_2)_2$— —$SiMe(O^iPr)_2$ |

The content of the siloxane compound in the protective layer 25 is in a range from 20 to 80 mass % and preferably in a range from 30 to 70 mass % based on the total solid of the protective layer 25.

The protective layer 25 preferably contains a compound having a group connectable with the compound represented by the general formula (1).

The foregoing connectable group means a group connectable with a silanol group produced when the compound represented by the general formula (1) is hydrolyzed and specifically means a group represented by —$Si(R_1)_{(3-a)}Q_a$, epoxy group, isocyanate group, carboxyl group, hydroxy group or a halogen. Compounds having a group represented by —$Si(R_1)_{(3-a)}Q_a$, epoxy group or isocyanate group among these groups have higher mechanical strength and are therefore desirable. Furthermore, the compounds containing two or more of these groups in the molecule are preferable because the crosslinking structure of the cured film as the protective layer becomes three-dimensional and the cured film has higher strength. As a most preferable compound among these compounds, compounds represented by the following general formula (3) are exemplified.

$$B\text{-}[A']_n \qquad \text{General formula (3),}$$

wherein A' represents a substituent represented by —$Si(R_1)_{(3-a)}Q_a$, B is constituted of at least one of a di- or more-valent hydrocarbon group which may be branched, a di- or more-valent aryl group and —NH— or of a combination of these groups, n denotes an integer of; 2 or more, $R_1$ represents any one or more of a hydrogen atom, an alkyl group and a substituted or unsubstituted aryl group, Q represents the foregoing hydrolyzable group and a denotes an integer from 1 to 3.

The compound represented by the general formula (3) is compounds having two or more A' parts, namely, substituted silicon groups having a hydrolyzable group represented by $Si(R_1)_{(3-a)}Q_0$. The Si group part contained in A' of the general formula (3) reacts with the compound of the general formula (1) or the compound of the general formula (3) itself to constitute a Si—O—Si bond, thereby forming a three-dimensional crosslinked and cured film. Because the compound of the general formula (1) has the same Si group part, a cured film can be formed by only using it. On the other hand, the compound of the general formula (3) has two or more A's and it is therefore considered that the crosslinked structure of the cured film becomes three-dimensional, so that the cured film has higher strength resultantly. Also, the Si group part serves to impart moderate flexibility to the crosslinked and cured film in the same manner as the D part in the compound of the general formula (1). As the compounds represented by the general formula (3), those represented by any one of the following general formulae are more desirable.

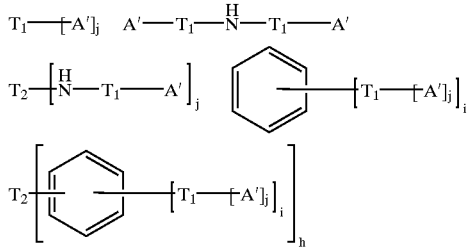

wherein $T_1$ and $T_2$ respectively represent a divalent or trivalent hydrocarbon group which may be branched, A' represents a substituent represented by the aforementioned general formula (3), h, i and j respectively denote an integer from 1 to 3 and are selected such that the number of A's in the molecule is 2 or more.

Specific examples of the compound of the general formula (3) represented by these general formulae are shown in the following table.

Incidentally, the symbol obtained by adding the prefix "III-" to the number of each compound in the table shown below is designated as the symbol of the exemplified compound of the formula (3) in this specification (for example, a compound having the number "7" is expressed as "an exemplified compound (III-7)").

TABLE 56

| | | | |
|---|---|---|---|
| III-1 | 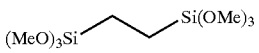 | III-2 | 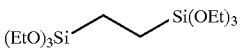 |
| III-3 | 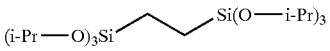 | III-4 | 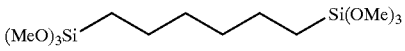 |
| III-5 | 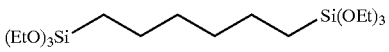 | III-6 | 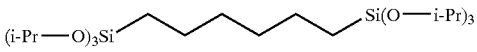 |
| III-7 | 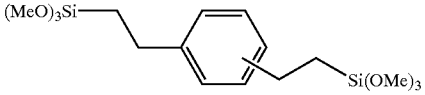 | III-8 | 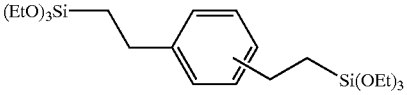 |

TABLE 56-continued

| | | | |
|---|---|---|---|
| III-9 | 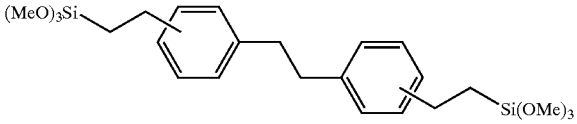 | III-10 | 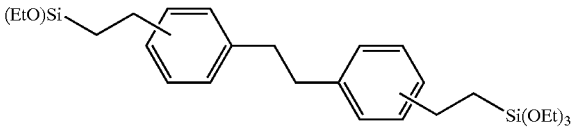 |
| III-11 | 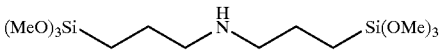 | III-12 | 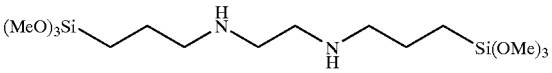 |
| III-13 | 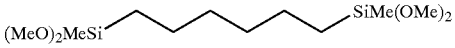 | III-14 | 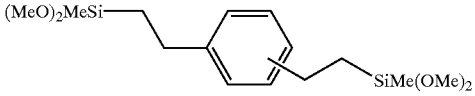 |
| III-15 | $(MeO)_3SiC_3H_6—O—CH_2CH\{—O—C_3H_6Si(OMe)_3\}—CH_2\{—O—C_3H_6Si(OMe)_3\}$ | | |

The compound represented by the general formula (1) may be used either independently or in combination with any one or a mixture of the compound represented by the general formula (3), the compound described in JP-A No. 2001-5207, Paragraphs No. 34 to No. 36, other coupling agents and fluorine compounds optionally for the purpose of controlling the coatability and flexibility of the film. As the foregoing coupling, agent, various silane coupling agents and commercially available silicon type hardcoat agents may be used.

Given as examples of materials to be used as the silane coupling agent are vinyltrichlorosilane, vinyltrimethoxysilane, vinyltriethoxysilane, γ-glycidoxypropylmethyldiethoxysilane, γ-glycidoxypropyltrimethoxysilane, γ-glycidoxypropyltrimethoxysilane, γ-aminopropyltriethoxysilane, γ-aminopropyltrimethoxysilane, γ-aminopropylmethyldimethoxysilane, N-β(aminoethyl) γ-aminopropyltriethoxysilane, tetramethoxysilane, methyltrimethoxysilane and dimethyldimethoxysilane.

As the commercially available silicon type hardcoat agent, KP-85, X-40-9740 and X-40-2239 (manufactured by Shin-Etsu Silicone Co., Ltd.), AY42-440, AY42-441 and AY49-208 (manufactured by Dow Corning Toray Silicone Co., Ltd.) and the like may be used, Also, a fluorine-containing compound such as (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H, 1H, 2H, 2H-perfluoroalkyltriethoxysilane, 1H, 1H, 2H, 2H-perfluorodecyltriethoxysilane or 1H, 1H, 2H, 2H-perfluorooctyltriethoxysilane may be added to impart water repellency and the like. Although the silane coupling agent may be used in an optional amount, the amount of the fluorine-containing compound is preferably 0.25% by mass or less based on 100 mass % of compounds containing no fluorine. When the amount exceeds 0.25%, there is the case where a problem concerning film forming characteristics arises.

In the preparation of a coating solution for forming the protective layer 25 by using the foregoing compounds, it is preferable to prepare the coating solution either by using no solvent or by dissolving these compounds in various solvents according to the need.

As the solvent in this case, alcohols such as methanol, ethanol, propanol and butanol; ketones such as acetone and methyl ethyl ketone; and ethers,;such as tetrahydrofuran, diethyl ether and dioxane may be used. Among these solvents, those having a boiling point of 100° C. or less may be optionally mixed and used. Although the amount of the solvent may be arbitrarily determined, the compound represented by the general formula (1) tends to precipitate if the amount is too small, and the solvent is therefore used in an amount of 0.5 to 30 parts and preferably 1 to 20 parts based on one part of the compound represented by the general formula (1).

The reaction temperature and time when preparing the coating solution differ depending on the type of raw material. The coating solution is prepared at a temperature of usually 0 to 100° C., preferably 10 to 100° C. and particularly preferably 50 to 100° C. No particular limitation is imposed on the reaction time. However, if the reaction time is long, gelation is easily caused and the reaction is therefore preferably run for a period of time ranging from 10, minutes to 100 hours.

For the preparation of the coating solution, the compounds are preferably subjected in advance to hydrolysis condensation using any one of the catalysts (1) to (14) shown as solid catalysts insoluble in the system.

(1) Cation exchange resins such as Amberlite 15, Amberlite 200C, Amberlist 15 (manufactured by Rohm and Haas Co.); Dowex MWC-1-H, Dowex 88, Dowex HCR-W2 (manufactured by Dow Chemical Company); Lebachit SPC-108, Lebachit SPC-118 (manufactured by Bayer); Daiya Ion RCP-150H (Mitsubishi. Chemical Industries); Sumika Ion KC-470, Duolite C26-C, Duolite C-433, Duolite-464 (manufactured by Sumitomo Chemical Co., Ltd.); Nafion-H (manufactured by Du Pont K.K.).

(2) Anion exchange resins such as Amberlite IRA-400, Amberlite IRA-45 (manufactured by Rohm and Haas Co.).

(3) Inorganic solids in which a group containing a protonic acid group such as $Zr(O_3PCH_2CH_3SO_3H)_2$ and $Th(O_3PCH_3CH_2COOH)_2$ is bonded with the surface thereof.

(4) Polyorganosiloxane containing a protonic acid group such as polyorganosiloxane having a sulfonic acid group.

(5) Heteropolyacids such as cobaltous tungstic acid and phosphorousmolybdic acid.

(6) Isopolyacids such as niobic acid, tantalic acid and molybdic acid.

(7) Single type metal oxides such as silica gel, alumina, chromia, zirconia, CaO and MgO.

(8) Complex type metal oxides such as silica-alumina, silica-magnesia, silica-zirconia and zeolite.

(9) Clay minerals such as acid clay, activated clay, montmorillonite and kaolinite.

(10) Metal sulfates such as $LiSO_4$ and $MgSO_4$.

(11) Metal phosphates such as zirconia phosphate and lanthanum phosphate.

(12) Metal nitrates such as $LiNO_3$ and $Mn(NO_3)_2$.

(13) Inorganic solids in which a group containing an amino group is bonded with the surface thereof, such as a solid obtained by reacting aminopropyltriethoxysilane on silica gel.

(14) Polyorganosiloxane containing an amino group, such as amino modified silicone resins.

At least one type among the above catalysts is used to run a hydrolysis condensation reaction. These catalysts may be set to the inside of a fixed bed and the reaction may be run in a continuous system or in a batch system. The amount of the catalyst is preferably 0.1 to 20 mass % based on the total amount of the material containing a substituent of a hydrolyzable silicon group though there is no particular limitation on it.

No particular limitation is imposed on the amount of water used when carrying out a hydrolysis condensation operation. However, water is used in a proportion ranging preferably from 30 to 500 mass % and more preferably from 50 to 300 mass % based on the theoretical amount required to hydrolyze all of the hydrolyzable groups of the compound represented by the general formula (1) because water affects the preserving stability of the products and,further gelation inhibition when the product is subjected to polymerization. When the amount of water exceeds 500 mass %, the preserving stability of the product is impaired and precipitation tends to occur. On the other hand, when the amount of water is less than 30 mass %, unreacted compounds increase, causing phase separation and a reduction in strength when the coating solution is applied and cured.

Moreover, it is preferable to contain a curing catalyst in the coating solution when forming the protective layer 25 to promote the curing reaction of the protective layer 25.

Examples of materials used for the curing catalyst include protonic acids such as hydrochloric acid, acetic acid, phosphoric acid and sulfuric acid; bases such as ammonia and triethylamine; organic tin compounds such as dibutyltin diacetate, dibutyltin dioctoate and stannous okenite; organic titanium compounds such as tetra-n-butyl titanate and tetraisopropyl titanate; organic aluminum compounds such as aluminum tributoxide and aluminumtriacetyl acetonate; and iron salts, manganese salts, cobalt salts, zinc salts and zirconium salts of organic carboxylic acid. The above organic metal compounds are preferable and acetyl acetonate metal compounds or acetyl acetate metal compounds are more preferable in view of preserving stability.

The amount of the curing catalyst to be used is preferably 0.1 to 20 mass % and more preferably 0.3 to 10 mass % based on the total amount of the materials containing the substituent of the hydrolyzable silicon in view of preserving stability, characteristics and strength though it may be determined arbitrarily. The curing temperature is set to 60° C. or more and preferably 80° C. or more to obtain desired strength, though it may be arbitrarily determined. The curing time is preferably 10 minutes to 5 hours though it may be optionally determined according to the need. Also, it is effective to keep a highly wet condition after a curing reaction is finished thereby stabilizing the characteristics. Further, surface treatment may be carried out using hexamethyldisilazane or trimethylchlorosilane to make the surface hydrophilic.

In the layer 25 an antioxidant is preferably added with the intention of preventing the deterioration caused by oxidizing gases such as ozone generated in a capacitor. If the mechanical strength of the surface of the photoreceptor is heightened and the photoreceptor is long-lived, the photoreceptor is eventually in contact with oxidizing gases for a long period of time and stronger oxidation resistance than usual is therefore required. As the antioxidant, a hindered phenol type or hindered amine type is preferable and known antioxidants such as an organic sulfur type antioxidant, phosphite type antioxidant, dithiocarbamate type antioxidant, thiourea type antioxidant and benzimidazole type antioxidant may be used. The amount of the antioxidant to be added is preferably 15 mass % or less and more preferably 10 mass % or less.

Examples of the hindered phenol type antioxidant include 2,6-di-t-butyl-4-methylphenol, 2,5-di-t-butylhydroquinone, N,N'-hexamethylenebis(3,5-di-t-butyl-4-hydroxyhydrocinnamide, 3,5-di-t-butyl-4-hydroxybenzylphosphonate-diethylester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenylacrylate and 4,4'-butylidenebis(3-methyl-6-t-butylphenol).

Because the siloxane type resin having charge-transferability and a crosslinking structure has satisfactory photoelectric characteristics besides high mechanical strength, it may also be used for the charge transfer layer of a laminate type photoreceptor as it is. In this case, a usual method such as a blade coating method, wire bar coating method, spray coating method, dip coating method, beads coating method, air knife coating method and curtain coating method may be used. In the case where necessary film thickness is not obtained by one application, it is possible to obtain intended film thickness by plurally repeated applications. In the case of performing these plurally repeated applications, heat treatment may be carried out either every application, or after the plurally repeated applications are finished.

The charge generation layer 22 in the laminate type photoreceptor is formed using at least a charge generation material and a binder resin.

Although as the charge generation material, known pigments including azo pigments such as bisazo pigments and trisazo pigments; condensed ring aromatic pigments such as dibromoanthanthrone; perylene pigments; pyrrolopyrrole pigments; and phthalocyanine pigments may be all used, particularly metal or non-metal phthalocyanine pigments are preferable. Among these pigments, hydroxygallium phthalocyanine, chlorogallium phthalocyanine, dichlorotin phthalocyanine and titanylphthalocyanine having specific crystals are particularly preferable.

The above chlorogallium phthalocyanine may be produced by crushing chlorogallium phthallocyanine crystals produced by a known method mechanically in a dry system by using an automatic mortar, planetary mill, vibrating mill, CF mill, roller mill, sand mill or kneader or by performing wet crushing treatment using a ball mill, mortar, sand mill or kneader together with a solvent after the dry crushing is finished as described in JP-A No. 5-98181.

Examples of the solvent used in the above treatment include aromatics (e.g., toluene and chlorobenzene), amides (e.g., dimethylformamide and N-methylpyrrolidone), aliphatic alcohols (e.g., methanol, ethanol and butanol), aliphatic polyhydric alcohols (e.g., ethylene glycol, glycerol and polyethylene glycol), aromatic alcohols (e.g., benzyl alcohol and phenethyl alcohol), esters (e.g., acetates and butyl acetate), ketones (e.g., acetone and methyl ethyl ketone), dimethylsulfoxide, ethers (e.g., diethyl ether and tetrahydrofuran), further mixture types of various solvents and mixture types of water and these organic solvents. The solvent is used in an amount of 1 to 200 parts and preferably 10 to 100 parts based on chlorogallium phthalocyanine. The treating is performed at 0° C. to the boiling point of the solvent and preferably at temperatures ranging from 10 to 60° C. Also, a milling adjuvant such as common salt and Glauber's salt may be used when carrying out crushing. The milling adjuvant is used in an amount 0.5 to 20 times and preferably 1 to 10 times the mass of the pigment.

The above dichlorotin phthalocyanine may be obtained by processing dichlorotin phthalocyanine crystals, produced by a known method, by crushing and solvent treatment in the same manner as the above chlorogallium, phthalocynanine as described in JP-A Nos 5-140472 and 5-140473.

The above hydroxygallium phthalocyanine may be produced in the following manner as described in JP-A Nos 5-263007 and 5-279591. Specifically, chlorogallium phthalocyanine crystals produced by a known method are hydrolyzed or subjected to acid-pasting in an acidic or alkaline solution to synthesize hydroxygallium phthalocyanine crystals, which are then directly treated using a solvent or the hydroxygallium phthalocyanine crystals obtained by the synthesis is subjected to wet crushing treatment using a ball mill, mortar, sand mill or kneader together with a solvent or treated using a solvent after processed by dry crushing treatment using no solvent.

Examples of the solvent used in the above treatment include aromatics (e.g., toluene and chlorobenzene), amides (e.g., dimethylformamide and N-methylpyrrolidone), aliphatic alcohols (e.g., methanol, ethanol and butanol), aliphatic polyhydric alcohols (e.g., ethylene glycol, glycerol and polyethylene glycol), aromatic alcohols (e.g., benzyl alcohol and phenethyl alcohol), esters (e.g., acetates and butyl acetate), ketones (e.g., acetone and methyl ethyl ketone), dimethylsulfoxide, ethers (e.g., diethyl ether and tetrahydrofuran), further mixture types of various solvents and mixture types of water and these organic solvents. The solvent is used in an amount of 1 to 200 mass parts and preferably 10 to 100 mass parts based on 100 mass parts of hydroxygallium phthalocyanine. The treatment is performed at 0° C. to 150° C. and preferably ambient temperature to 100° C. Also, a milling adjuvant such as common salt and Glauber's salt may be used when carrying out crushing. The milling adjuvant is used in an amount 0.5 to 20 times and preferably 1 to 10 times the mass of the pigment.

The above oxytitanyl phthalocyanine may be produced in the following manner as described in JP-A No. 4-189873 and JP-A No. 5-43813. Specifically, oxytitanyl phthalocyanine crystals produced by a known method is subjected to acid pasting or to salt milling using a ball mill, mortar, sand mill or kneader together with an inorganic salt to form oxytitanyl phthalocyanine crystals having a peak Bragg angle ($2\theta \pm 0.2°$) at around 27.2 in an X-ray diffraction spectrum and relatively low crystallinity and the resulting crystals are then directly treated using a solvent or processed by wet crushing treatment using a ball mill, mortar, sand mill or kneader together with a solvent. As the acid used for the acid pasting, sulfuric acid is preferable and sulfuric acid having a concentration of 70 to 100% and preferably 95 to 100% is used. The temperature at which the oxytitanyl phthalocyanine crystals are dissolved is designed to be in a range from −20 to 100° C. and preferably 0 to 60° C. The amount of the concentrated sulfuric acid is designed to be in a range from 1 to 100 times and preferably 3 to 50 times the mass of the oxytitanyl phthalocyanine crystals. As a solvent for precipitation, water or a mixture solvent of water and an organic solvent is used in an optional amount. Mixture solvents of water and alcohol type solvents such as methanol and ethanol or mixture solvents of water and aromatic type solvents such as benzene and toluene are particularly preferable. Although there is no particular limitation to the precipitation temperature, it is preferable to cool using ice or the like to prevent an exothermic phenomenon. Also, the ratio (oxytitanyl phthalocyanine/inorganic salt) by mass of oxytitanyl phthalocyanine crystals to the inorganic salt is in a range from 1/0.1 to 1/20 and preferably 1/0.5 to 1/5. Examples of the solvent used in the above solvent treatment include aromatics (e.g., toluene and chlorobenzene), aliphatic alcohols (e.g., methanol, ethanol and butanol) halogen type hydrocarbons (e.g., dichloromethane, chloroform and trichloroethane), further mixture types of various solvents and mixture types of water and these organic solvents. The solvent is used in an amount of 1 to 100 mass parts and preferably 5 to 50 mass parts based on 100 mass parts of oxytitanyl phthalocyanine. The treating is performed at ambient temperature to 100° C. and preferably 50 to 100° C. The milling adjuvant is used in an amount 0.5 to 20 times and preferably 1 to 10 times the mass of the pigment.

As the binder resin, any of insulation resins may be selected without any particular limitation. Also, it is possible to select from organic photoconductive polymers such as poly-N-vinylcarbazole, polyvinylanthracene, polyvinylpyrene and polysilane.

Preferable examples of the binder resin may include, though not limited to, insulation resins such as polyvinylbutyral resins, polyarylate resins (e.g., polymerization condensates of bisphenol A and phthalic acid), polycarbonate resins, polester resins, phenoxy resins, vinyl chloride/vinyl acetate copolymers, polyamide resins, acryl resins, polyacrylamide resins, polyvinylpyridine resins, cellulose resins, urethane resins, epoxy resins, casein, polyvinyl alcohol resins and polyvinylpyrrolidone resins. These binder resins may be either singly or in combinations of two or more.

The compounding ratio (mass ratio) of the charge generation material to the binder resin is preferably in a range of 10:1 to 1:10. As a method of dispersing these materials, a usual method such as a ball mill dispersion method, attritor dispersion method or sand mill dispersion method may be applied. In this case, it is necessary to apply conditions under which the crystal type is not changed by a dispersing operation.

According to the experiments made by the inventors of the invention, it has been confirmed that the crystal type is not changed from that found before these materials are dispersed in all the above dispersion methods.

Further, in this dispersion operation, it is effective to decrease the size of the particle to 0.5 $\mu$m or less, preferably 0.3 $\mu$m or less and more preferably 0.15 $\mu$m or less. Also, as the solvent to be used for dispersion, usual solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene may be used either singly or by mixing two or more.

The thickness of the charge generation layer is generally 0.1 to 5 $\mu$m and preferably 0.2 to 2.0 $\mu$m. In this case, a usual method such as a blade coating method, wire bar coating method, spray coating method, dip coating method, beads coating method, air knife coating method and curtain coating method may be used as a coating method when forming the charge generation layer. Pigments treated using a compound shown as a silane, coupling agent may be used or the compound may be added to a pigment dispersion solution with the intention of promoting the dispersion stability and light-sensitivity of the pigment or of stabilizing the electrical characteristics.

As the charge transfer layer 23 in the photoreceptor, those formed using known technologies may be used. These charge transfer layers 23 may be formed by compounding the charge transfer material and the binder resin or by compounding the high molecular charge transfer material.

It is to be noted that the already mentioned siloxane compounds may bemused as the binder resin when the charge transfer layer 23 constitutes the surface layer (in the case of the example of FIG. 2).

Examples of the charge transfer material include electron-transferable compounds such as quinone type compounds, e.g., p-benzoquinone, chloranil, bromanil and anthraquinone; tetracyanoquinodimethane type compounds; fluorenone compounds, e.g., 2,4,7-trinitrofluorenone; xanthone type compounds, benzophenone type compounds, cyanovinyl type compounds and ethylene type compounds; and positive hole transferable compounds such as triarylamine type compounds, benzidine type compounds, arylalkane type compounds, aryl substituted ethylene type compounds, stilbene type compounds, anthracene type compounds and hydrazone type compounds. Although these charge transfer materials may be used either singly or by mixing two or more, the charge transfer material used in the invention is not limited to these examples.

As the charge transfer material, particularly triphenylamine type compounds represented by the following general formula (4) and benzidine type compounds represented by the following general formula (5) are preferably used because these compounds have high charge (hole)-transferability and high stability.

General formula (4)

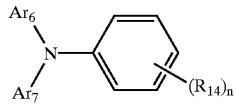

一般式（4） wherein $R_{14}$ represents a hydrogen atom or a methyl group, n denotes 1 or 2, $Ar_6$ and $Ar_7$ respectively represent a substituted or unsubstituted aryl group, wherein the substituent is selected from a halogen atom, an alkyl group having 1 to 5 carbon atoms, an aryl group, an alkoxy group having 1 to 5 carbon atoms or a substituted amino group substituted with an alkyl group having 1 to 3 carbon atoms.

Specific examples of the triphenylamine type compounds represented by the above general formula (4) are shown collectively in the following table by specifying each substituent. Incidentally, the symbol obtained by adding the prefix "4-" to the number of each compound in the table shown below is designated as the symbol of the exemplified compound in this specification (for example, a compound having the number "27" is expressed as "an exemplified compound (4-27").

TABLE 57

| Compound | $(R_{14})_n$ | $Ar_6$ | $Ar^7$ |
|---|---|---|---|
| 1 | 4-$CH_3$ | 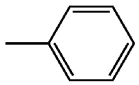 | 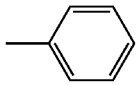 |
| 2 | 3,4-$CH_3$ | | |
| 3 | 4-$CH_3$ | 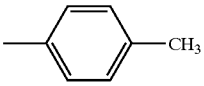 | 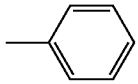 |
| 4 | 3,4-$CH_3$ | | |
| 5 | 4-$CH_3$ | 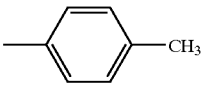 | 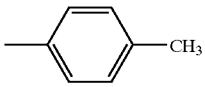 |
| 6 | 3,4-$CH_3$ | | |
| 7 | 4-$CH_3$ | 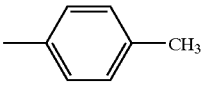 | 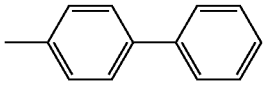 |
| 8 | 3,4-$CH_3$ | | |
| 9 | 3,4-$CH_3$ | 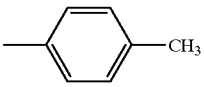 | 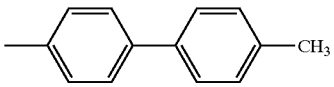 |
| 10 | 3,4-$CH_3$ | | |
| 11 | 4-$CH_3$ | 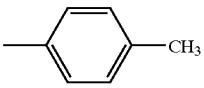 | 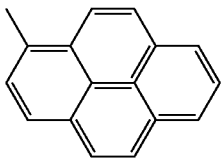 |
| 12 | 3,4-$CH_3$ | | |

TABLE 57-continued
| Compound | $(R_{14})_n$ | $Ar_6$ | $Ar^7$ |
|---|---|---|---|
| 13<br>14 | 4-$CH_3$<br>3,4-$CH_3$ | 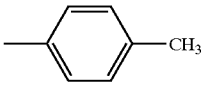 | 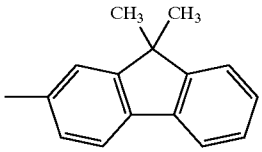 |
| 25<br>26 | 4-$CH_3$<br>3,4-$CH_3$ | 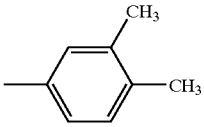 | 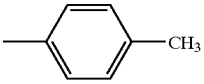 |
| 27<br>28 | 4-$CH_3$<br>3,4-$CH_3$ | 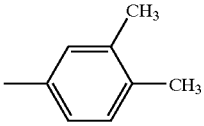 | 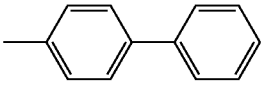 |
| 29<br>30 | 4-$CH_3$<br>3,4-$CH_3$ | 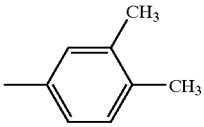 | 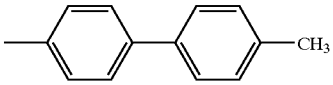 |
| 31<br>32 | 4-$CH_3$<br>3,4-$CH_3$ | 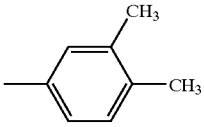 | 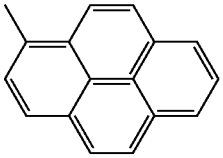 |
| 33<br>34 | 4-$CH_3$<br>3,4-$CH_3$ | 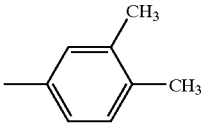 | 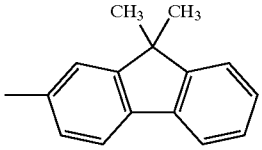 |
| 35<br>36 | 4-$CH_3$<br>3,4-$CH_3$ | 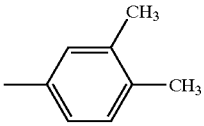 | 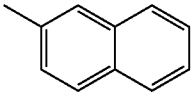 |
| 37<br>38 | 4-$CH_3$<br>3,4-$CH_3$ | 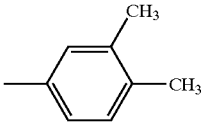 | 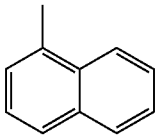 |
TABLE 58
| Compound | $(R_{14})_n$ | $Ar_6$ | $Ar_7$ |
|---|---|---|---|
| 15<br>16 | 4-$CH_3$<br>3,4-$CH_3$ | 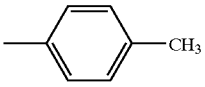 | 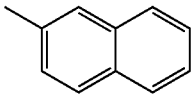 |

TABLE 58-continued
| Compound | $(R_{14})_n$ | $Ar_6$ | $Ar_7$ |
|---|---|---|---|
| 17<br>18 | 4-$CH_3$<br>3,4-$CH_3$ | 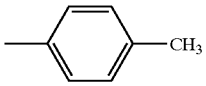 | 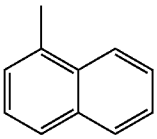 |
| 19<br>20 | 4-$CH_3$<br>3,4-$CH_3$ | 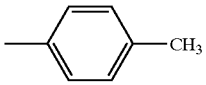 | 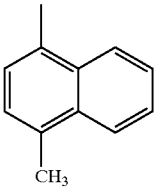 |
| 21<br>22 | 4-$CH_3$<br>3,4-$CH_3$ | 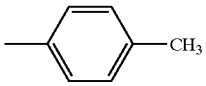 | 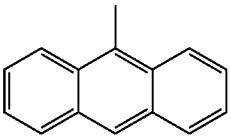 |
| 23<br>24 | 4-$CH_3$<br>3,4-$CH_3$ | 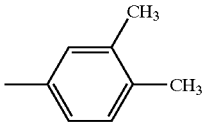 | 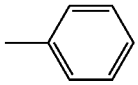 |
| 39<br>40 | 4-$CH_3$<br>3,4-$CH_3$ | 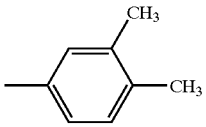 | 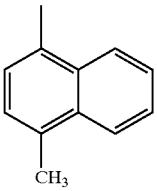 |
| 41<br>42 | 4-$CH_3$<br>3,4-$CH_3$ | 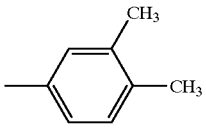 | 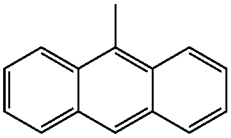 |
| 43<br>44 | 4-$CH_3$<br>3,4-$CH_3$ | 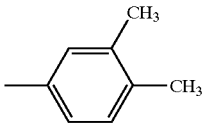 | 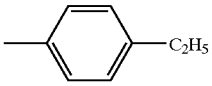 |
| 45<br>46 | 4-$CH_3$<br>3,4-$CH_3$ | 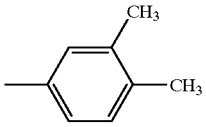 | 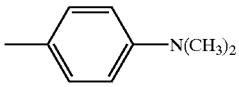 |
| 47<br>48 | 4-$CH_3$<br>3,4-$CH_3$ | 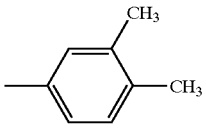 | 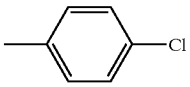 |

TABLE 59

| Compound | $(R_{14})_n$ | $Ar_6$ | $Ar_7$ |
|---|---|---|---|
| 49<br>50 | 4-$CH_3$<br>3,4-$CH_3$ | 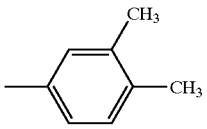 | 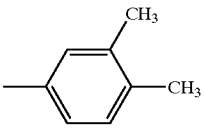 |
| 51<br>52 | 4-$CH_3$<br>3,4-$CH_3$ | 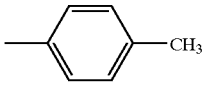 | 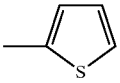 |
| 53<br>54 | 4-$CH_3$<br>3,4-$CH_3$ | 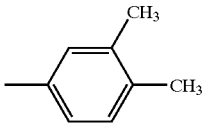 | 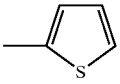 |
| 55<br>56 | 4-$CH_3$<br>3,4-$CH_3$ | 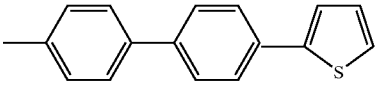 | |
| 57<br>58 | 4-$CH_3$<br>3,4-$CH_3$ | 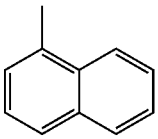 | 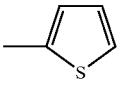 |
| 59<br>60 | 4-$CH_3$<br>3,4-$CH_3$ | 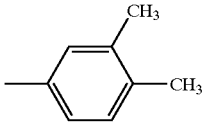 | 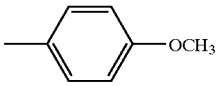 |

TABLE 59-continued

| Compound | $(R_{14})_n$ | $Ar_6$ | $Ar_7$ |
|---|---|---|---|
| 61<br>62 | 4-$CH_3$<br>3,4-$CH_3$ | 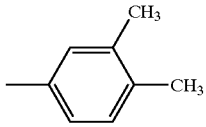 | 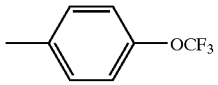 |

General formula (5)

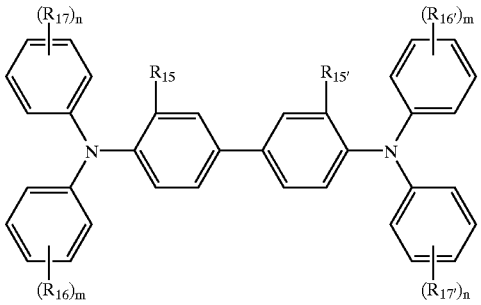

wherein $R_{15}$ and $R_{15'}$, which may be the same or different, respectively represent a hydrogen atom, a halogen atom, an alkyl group having 1 to 5 carbon atoms or an alkoxy group having 1 to 5 carbon atoms, $R_{16}$, $R_{16'}$, $R_{17}$ and $R_{17'}$, which may be the same or different, respectively represent a hydrogen atom, a halogen atom, an alkyl group having 1 to 5 carbon atoms, an alkoxy group having 1 to 5 carbon atoms or amino group substituted with an alkyl group having 1 to 2 carbon atoms and m and n respectively denote an integer from 0 to 2.

Specific examples of the benzidine type compounds represented by the above general formula (5) are shown collectively in the following table by specifying each substituent. Incidentally, the symbol obtained by adding the prefix "5-" to the number of each compound in the table shown below is designated as the symbol of the exemplified compound in this specification (for example, a compound having the number "27" is expressed as "an exemplified compound (5-27").

TABLE 60

| Compound No. | $R_{15}$ $R_{15'}$ | $(R_{16})_m$ $(R_{16'})_m$ | $(R_{17})_n$ $(R_{17'})_n$ | Compound No. | $R_{15}$ $R_{15'}$ | $(R_{16})_m$ $(R_{16'})_m$ | $(R_{17})_n$ $(R_{17'})_n$ |
|---|---|---|---|---|---|---|---|
| 1 | $CH_3$ | H | H | 28 | Cl | H | H |
| 2 | $CH_3$ | 2-$CH_3$ | H | 29 | Cl | 2-$CH_3$ | H |
| 3 | $CH_3$ | 3-$CH_3$ | H | 30 | Cl | 3-$CH_3$ | H |
| 4 | $CH_3$ | 4-$CH_3$ | H | 31 | Cl | 4-$CH_3$ | H |
| 5 | $CH_3$ | 4-$CH_3$ | 2-$CH_3$ | 32 | Cl | 4-$CH_3$ | 2-$CH_3$ |
| 6 | $CH_3$ | 4-$CH_3$ | 3-$CH_3$ | 33 | Cl | 4-$CH_3$ | 3-$CH_3$ |
| 7 | $CH_3$ | 4-$CH_3$ | 4-$CH_3$ | 34 | Cl | 4-$CH_3$ | 4-$CH_3$ |
| 8 | $CH_3$ | 3,4-$CH_3$ | H | 35 | $C_2H_5$ | H | H |
| 9 | $CH_3$ | 3,4-$CH_3$ | 3,4-$CH_3$ | 36 | $C_2H_5$ | 2-$CH_3$ | H |
| 10 | $CH_3$ | 4-$C_2H_5$ | H | 37 | $C_2H_5$ | 3-$CH_3$ | H |
| 11 | $CH_3$ | 4-$C_3H_7$ | H | 38 | $C_2H_5$ | 4-$CH_3$ | H |
| 12 | $CH_3$ | 4-$C_4H_9$ | H | 39 | $C_2H_5$ | 4-$CH_3$ | 4-$CH_3$ |
| 13 | $CH_3$ | 4-$C_2H_5$ | 2-$CH_3$ | 40 | $C_2H_5$ | 4-$C_2H_5$ | 4-$CH_3$ |
| 14 | $CH_3$ | 4-$C_2H_5$ | 3-$CH_3$ | 41 | $C_2H_5$ | 4-$C_3H_7$ | 4-$CH_3$ |

TABLE 61

| Compound No. | $R_{15}$ $R_{15'}$ | $(R_{16})_m$ $(R_{16'})_m$ | $(R_{17})_n$ $(R_{17'})_n$ | Compound No. | $R_{15}$ $R_{15'}$ | $(R_{16})_m$ $(R_{16'})_m$ | $(R_{17})_n$ $(R_{17'})_n$ |
|---|---|---|---|---|---|---|---|
| 15 | $CH_3$ | 4-$C_2H_5$ | 4-$CH_3$ | 42 | $C_2H_5$ | 4-$C_4H_9$ | 4-$CH_3$ |
| 16 | $CH_3$ | 4-$C_2H_5$ | 3,4-$CH_3$ | 43 | $OCH_3$ | H | H |
| 17 | $CH_3$ | 4-$C_3H_7$ | 3-$CH_3$ | 44 | $OCH_3$ | 2-$CH_3$ | H |
| 18 | $CH_3$ | 4-$C_3H_7$ | 4-$CH_3$ | 45 | $OCH_3$ | 3-$CH_3$ | H |
| 19 | $CH_3$ | 4-$C_4H_9$ | 3-$CH_3$ | 46 | $OCH_3$ | 4-$CH_3$ | H |
| 20 | $CH_3$ | 4-$C_4H_9$ | 4-$CH_3$ | 47 | $OCH_3$ | 4-$CH_3$ | 4-$CH_3$ |
| 21 | $CH_3$ | 4-$C_2H_5$ | 4-$C_2H_5$ | 48 | $OCH_3$ | 4-$C_2H_5$ | 4-$CH_3$ |
| 22 | $CH_3$ | 4-$C_2H_5$ | 4-$OCH_3$ | 49 | $OCH_3$ | 4-$C_3H_7$ | 4-$CH_3$ |
| 23 | $CH_3$ | 4-$C_3H_7$ | 4-$C_3H_7$ | 50 | $OCH_3$ | 4-$C_4H_9$ | 4-$CH_3$ |
| 24 | $CH_3$ | 4-$C_3H_7$ | 4-$OCH_3$ | 51 | $CH_3$ | 2-$N(CH_3)_2$ | H |
| 25 | $CH_3$ | 4-$C_4H_9$ | 4-$C_4H_9$ | 52 | $CH_3$ | 3-$N(CH_3)_2$ | H |
| 26 | $CH_3$ | 4-$C_4H_9$ | 4-$OCH_3$ | 53 | $CH_3$ | 4-$N(CH_3)_2$ | H |
| 27 | H | 3-$CH_3$ | H | 54 | $CH_3$ | 4-Cl | H |

These compounds may be used either singly or by mixing two or more.

Also, high molecular charge transfer materials may be used. As the high molecular charge transfer material, known materials having charge-transferability such as poly-N-vinylcarbazole and polysilane may be used. Particularly, polyester type high molecular charge transfer materials as shown in JP-A No. 8-176293 and JP-A No. 8-208820 have high charge-transferability and are therefore particularly preferable. Although the high molecular charge transfer material may be formed as a film by only using it, it may be formed as a film by mixing with the above binder resin.

As the binder resin used for the charge transfer layer 23, high molecular charge transfer materials such as polycarbonate resins, polyester resins, methacryl resins, acryl resins, polyvinyl chloride resins, polyvinylidene chloride resins, polystyrene resins, polyvinyl acetate reins, styrene/butadiene copolymers, vinylidene chloride/acrylonitrile copolymers, vinyl chloride/vinyl acetate copolymers, vinyl chloride/vinyl acetate/maleic acid anhydride copolymers, silicon resins, silicon-alkyd resins, phenol-formaldehyde resins, styrene-alkyd resins, poly-N-vinylcarbazole, polysilane and polyester type high molecular charge transfer materials as described in JP-A No. 8-176293 and JP-A No. 8-208820 may be used.

Further, organic zirconium compounds such as zirconium chelate compounds, zirconium alkoxide compounds and zirconium coupling agents, organic titanium compounds such as titanium chelate compounds, titanium alkoxide compounds and titanate coupling agents, organic aluminum compounds such as aluminum chelate compounds and aluminum coupling agents, and organic metal compounds such as antimony alkoxide compounds, germanium alkoxide compounds, indium alkoxide compounds, indium chelate compounds, manganese alkoxide compounds, manganese chelate compounds, tin alkoxide compounds, tin chelate compounds, aluminum silicon alkoxide compounds, aluminum titanium alkoxide compounds and aluminum zirconium alkoxide compounds, particularly, organic zirconium compounds, organic titanyl compounds and aluminum compounds have low residual potential and exhibit good electrophotographic characteristics and are therefore preferably used. Also, silane coupling agents such as vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane and β-3,4-epoxycyclohexyltrimethoxysilane, or a curable type matrixes such as photocurable resins may be used and further charge transfer materials which can be cured in combination with these compounds and represented by the general formula (1) maybe used. These binder resins may be used either singly or by mixing two or more.

The compounding ratio (mass ratio) of the charge transfer material to the binder resin is preferably 10:1 to 1:5. The thickness of the charge transfer layer 23 used in the invention is generally 5 to 50 μm and preferably 10 to 30 μm.

As a coating method, a usual method such as a blade coating method, wire bar coating method, spray coating method, dip coating method, beads coating method, air knife coating method and curtain coating method may be used.

As the solvent used in the preparation of a coating solution used when the charge transfer layer 23 is disposed, usual organic solvents including aromatic hydrocarbons such as benzene, toluene, xylene and chlorobenzene; ketones such as acetone and 2-butanone; halogenated aliphatic hydrocarbons such as methylene chloride, chloroform and ethylene chloride; cyclic or straight-chain ethers such as tetrahydrofuran and ethyl ether may be used either singly or by mixing two or more.

Also, additives such as an antioxidant, photostabilizer and thermal stabilizer may be compounded in the light-sensitive layer for the purpose of preventing the photoreceptor from being deteriorated caused by ozone and oxidizing gas generated in a copying machine, light and heat.

Examples of the antioxidant include hindered phenol, hindered amine, paraphenylenediamine, arylalkane, hydroquinone, spirochroman, spiroindanone and their derivatives, organic sulfur compounds and organic phosphorous compounds.

Examples of the photostabilizer include derivatives of benzophenone, benzotriazole, dithiocarbamate and tetramethylpiperidine.

Also, at least one electron-receiving material may be compounded for the purpose of improving sensitivity, reducing residual potential, decreasing fatigues during repeated use. Examples of the electron-receiving material used for the photoreceptor provided with the aforementioned layers may include succinic acid anhydride, maleic acid anhydride, dibromomaleic acid anhydride, phthalic acid anhydride, tetrabromophthalic acid anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, phthtalic acid and compounds represented by the general formula (1). Among these materials, fluorenone types, quinone types and benzene derivatives having an electron-attractive substituent such as Cl, CN and $NO_2$ are particularly preferable.

In the case where the photoreceptor is a monolayer type (in the cases of FIG. 5 and FIG. 6), the already mentioned materials may be used for the charge generation material and the charge transfer material. Also, as the binder resin, the same binder resins that are used in the charge generation layer and the charge transfer layer may be used. When the protective layer 25 is not disposed as shown in FIG. 5, a siloxane compound having the foregoing crosslinking structure is used in place of the binder resin. The content of the charge generation material in the case of a monolayer type is about 10 to 85 mass % and preferably 20 to 50 mass %. Also, charge transfer materials and high molecular charge transfer materials may be added for the purpose of improving the photoelectric characteristics. The amount of these transfer materials to be added is preferably designed to be 5 to 50 mass %. The compounds represented by the general formula (1) may be added. As the solvent used for application and coating method, the same solvent and method as above may be used. The film thickness is preferably about 5 to 50 $\mu$m and more preferably 10 to 40 $\mu$m.

A known method may be applied to the image forming method of the invention without any particular limitation insofar as a structure in which the foregoing photoreceptor is used and the compound having acid-adsorbing ability is supplied to the surface of the photoreceptor is adopted.

Treatment for removing toners and dusts stuck to the photoreceptor and de-electrification treatment for removing an electrostatic latent image left unremoved on the surface of the photoreceptor may be carried out appropriately.

As a charging system in the imaging system of the invention, a non-contact system using a conventionally known corotron or scolotron may be preferably adopted. This reason is that because the aforementioned photoreceptor has strong mechanical strength, it exhibits particularly excellent durability even if a contact charging system applying,large stress to the photoreceptor is used.

In the case of adopting a contact charging system, a charger is in contact with and close to the photoreceptor. Therefore, although the absolute, amount of products generated by discharging is relatively small, the generated products are easily stuck to the surface of the photoreceptor. However, as aforementioned, the compound having acid-adsorbing ability is supplied to the surface of the photoreceptor whereby the products generated by discharging which products are stuck to the surface of the photoreceptor can be removed and there is therefore no problem.

<Process Cartridge and Image Forming Apparatus>

The image forming method of the invention is preferably applied to a process cartridge and an image forming apparatus.

No particular limitation is imposed on the process cartridge which is preferably used in the image forming method of the invention as far as it comprises a photoreceptor provided with at least a layer that contains a siloxane compound having charge-transferability and a crosslinking structure and a supply means for supplying a compound having acid-adsorbing ability to the surface of the photoreceptor. The process cartridge comprises, besides the above means, known means such as a charging means for electrifying the surface of the photoreceptor, a latent image forming means for forming an electrostatic latent image on the electrified surface of the photoreceptor, a developing means for developing the electrostatic latent image to obtain a toner image and a transfer means for transferring the toner image to an image receiving member to obtain an image, and is mounted on a known image forming apparatus in a dismountable manner. By allowing the cartridge to be mounted in a dismountable manner, customers can avoid soiling of their hands and clothes and can exchange the means such as the photoreceptor easily at low costs in a short time.

No particular limitation is imposed on the image forming apparatus preferably used in the image forming method of the invention as far as it comprises a photoreceptor provided with at least a layer that contains a siloxane compound having charge-transferability and a crosslinking structure and a supply means for supplying a compound having acid-adsorbing ability to the surface of the photoreceptor. The image forming apparatus comprises, besides the above means, known means such as a charging means for electrifying the surface of the photoreceptor, a latent image forming means for forming an electrostatic latent image on the electrified surface of the photoreceptor, a developing means for developing the electrostatic latent image to obtains a toner image and a transfer means for transferring the toner image to an image receiving member to obtain an image, a mechanical cleaning means and the like, and is preferably provided with the foregoing process cartridge.

The image forming apparatus having the aforementioned structure according to the invention may be applied to all conventionally known electrophotographic image forming apparatuses. Particularly, the,above photoreceptor has high resistance to oxidizing gases generated by the charging means. Also, when the image forming apparatus is provided with the mechanical cleaning means, it has a light-sensitive layer having mechanically high strength and can therefore maintain good photoreceptor characteristics for a long period of time even when it is used under these severe conditions.

Moreover, the provision of the supply means for supplying the compound having acid-adsorbing ability ensures that products generated by discharging can be removed from the surface of the photoreceptor in an efficient manner.

Figure 7:
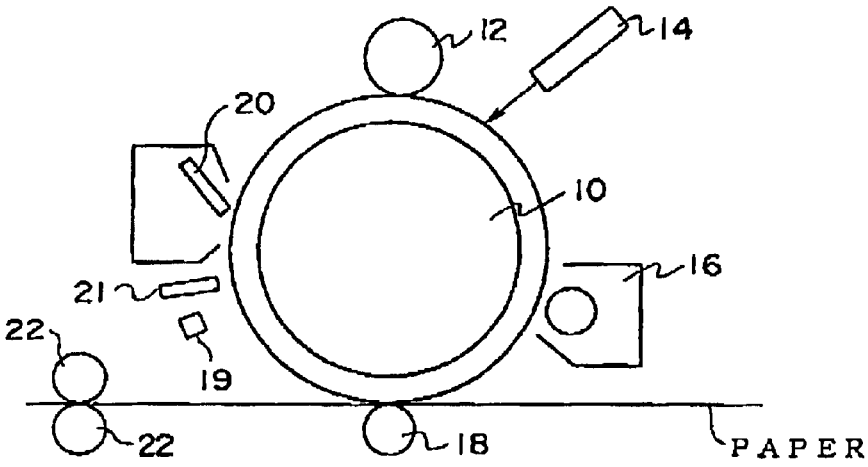
FIG. 7 is a schematic structural view showing one example of an embodiment of an image forming apparatus when an image forming method according to the present invention is applied.

FIG. 7 is a schematic structural view showing one example of an electrophotographic image forming apparatus preferably used in the image forming method of the invention. The electrophotographic image forming apparatus comprises a photoreceptor 10 provided with a layer that contains a siloxane compound having charge-transferability and a crosslinking structure, a charging roll 12 which is a charging means used in a contact charging system, a laser exposure optical system 14, a developing unit 16 using a powdery toner, a transfer roll 18, a deelectrification device 19, a cleaning blade 20 which is a mechanical cleaning means and a fixing roll 22. The image forming apparatus further comprises a supply means 21 such as a flicker as shown in FIG. 1 as a means for supplying the compound having acid-adsorbing ability to the surface of the photoreceptor in the case of applying the aforementioned method (1).

It is to be noted that when the method (2) is applied, the developing unit 16 serves as the supply means for supplying the compound having acid-adsorbing ability to the surface of the photoreceptor 10 in order to supply the compound having acid-adsorbing ability together with a developing agent contained in the developing unit 16.

The photoreceptor provided with the layer having charge-transferability and containing a siloxane compound having a crosslinking structure and a method for supplying the compound having acid-adsorbing ability to the surface of the photoreceptor 10 are as aforementioned. Therefore, explanations will be furnished as to, primarily, means other than these means hereinbelow.

Here, the mechanical cleaning means is a type which is in contact directly with the surface of the photoreceptor to remove a toner, paper powder and dusts stuck to the surface. Known means such as a brush and roll besides a blade system such as the cleaning blade 20 may be used as the cleaning means.

The contact charging system charging means is a type for electrifying the surface of the: photoreceptor by applying voltage to a conductive member which is brought into contact with the surface of the photoreceptor 10. As the shape of the conductive member, besides a roll form such as the charging roll 12 in FIG. 7, any one of a brush form, blade form or pin electrode form may be used. However, a roll-like conductive member is preferable. In general, the roll-like conductive member has a structure in which an elastic layer is formed on the surface of a roll as the core material and a resistance layer is formed on the elastic layer. Further, a protective layer may be disposed on the outside of the resistance layer according to the need.

As the core material, those having conductivity and generally iron, copper, brass, stainless steel, aluminum and nickel may be used. Also, other than the above, resin molded articles obtained by dispersing conductive particles or the like may be used.

As a material of the elastic layer, conductive or semiconductive elastic materials and generally elastic materials obtained by dispersing conductive particles or semiconductive particles in a rubber material may be used.

As the rubber material, EPDM, polybutadiene, natural rubber, polyisobutylene, SBR, CR, NBR, silicone rubber, urethane rubber, epichlorohydrin rubber, SBS, thermoplastic elastomers, norbornane rubber, fluorosilicone rubber, ethylene oxide rubber or the like is used.

As the conductive or semiconductive particles, carbon black, metals such as zinc, aluminum, copper, iron, nickel, chrome and titanium and metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO and MgO may be used. These materials may be used either singly or by mixing two or more.

The resistance layer and the protective layer are those obtained by dispersing conductive particles or semiconductive particles in a binder resin and by controlling the resistance thereof. As the binder resin, an acryl resin, cellulose resin, polyamide resin, methoxymethylated nylon, ethoxymethylated nylon, polyurethane resin, polycarbonate resin, polyester resin, polyethylene resin, polyvinyl resin, polyarylate resin, polythiophene resin, polyolefin resin such as PFA, FEP and PET, styrene butadiene resin or the like is used. As the conductive or semiconductive particles, carbon black, metals or metal oxides as those used in the elastic layer are used The resistance of the resistance layer or protective layer is $10^3$ to $10^{14}$ Ωcm, preferably $10^5$ to $10^{12}$ Ωcm and more preferably $10^7$ to $10^{12}$ Ωcm. The film thickness of the resistance layer or protective layer is 0.01 to 1,000 μm, preferably 0.1 to 500 μm and more preferably 0.5 to 100 μm.

Also, an antioxidant such as hindered phenol and hindered amine, a filler such as clay or kaolin and a lubricant such as silicone oil may be added according to the need.

As to a method for forming these layers, the aforementioned each material is dissolved and dispersed in a proper solvent to prepare a coating solution, which is then applied to a subject material to thereby form these layers. As a coating method, a usual method such as a blade coating method, wire bar coating method, spray coating method, dip coating method, beads coating method, air knife coating method and curtain coating method may be adopted.

It is necessary to apply voltage to the conductive member to electrify the photoreceptor by using the conductive member of the above charging means. The applied voltage is preferably d.c. voltage or one obtained by superimposing a.c. voltage on d.c. voltage. Particularly it As preferable to superimpose a.c. voltage on d.c. voltage in view of charging uniformity and environmental stability.

The magnitude of the voltage as d.c. voltage is preferably a positive or negative voltage of 50 to 2,000 V and particularly 100 to 1,500 V. When superimposing a.c. voltage, the voltage between peeks is designed to be preferably 400 to 3,000 V, more preferably 800 to 2,500 V and still more preferably 1,200 to 2,500 V. The frequency of the a.c. voltage is 50 to 20,000 Hz and preferably 100 to 5,000 Hz.

With regard to the surface of the fixing roll or fixing belt, it is necessary to form, for example, the surface of the roll by using a material, which is highly releasable from a toner, such as silicon rubber and a fluororesin to prevent a toner from adhering. At this time, it is effective to decrease a releasable liquid such as silicone oil applied to the fixing roll to a minimum. The releasable liquid is effective for fixing latitudes. However, because the releasable liquid is transferred to a transfer-receiving material to which a toner image is fixed, giving rise to the problem that a sticking phenomenon arises, a tape cannot be applied and it is impossible to add characters by using a magic marker. This is significant in the case of OHP sheet. Also, the releasable liquid cannot smooth the roughness of the fixed surface, causing a reduction in the transparency of OHP sheet.

In the case of the aforementioned structure of the toner, sufficient fixing latitudes are, exhibited. Therefore, a releasable liquid such as silicone oil to be applied to the fixing roll or the fixing belt is required a little.

For example, the amount of the releasable liquid may be 1 micro little or less per one sheet of paper having A4 size. If the magnitude is around this range, the aforementioned various problems can be substantially avoided.

EXAMPLES

The present invention will be explained in more detail by way of examples, which are not intended to be limiting of the invention, in which all designations of parts indicates parts by mass.

(Production of Photoreceptors 1 to 9)

Photoreceptors 1 to 9 were produced in the following manner.

Photoreceptor 1:

A drawn tube 340 mm long with a diameter of 84 mm which was made of an aluminum alloy of JIS A3003 was polished using a centerless polishing machine to manufacture a cylinder conductive support having a surface roughness (Ra) of 0.6 μm.

The produced conductive support was subjected to washing treatment performed in the following manner.

First, the conductive support was subjected to degreasing treatment and then to etching treatment using a 2 wt % sodium hydroxide solution for one minute. Thereafter, the conductive support was subjected to neutralizing treatment and washing treatment using pure water to carry out a washing process.

After the washing treatment was finished, the conductive support was subjected to anodic oxidation treatment performed using a 10 wt % sulfuric acid solution at a current density of 1.0 A/dm$^2$ to form an anodic oxidation film on the surface of the conductive support. After washed, the conductive support was dipped in a 1 wt % nickel acetate solution kept at 80° C. for 20 minutes to perform sealing treatment. The conductive support was further washed with water and dried An anodic oxidation film (intermediate layer) 7 μm in thickness was thus formed on the surface of the conductive support made of aluminum.

One part of chlorogallium phthalocyanine having strong diffraction peaks at Bragg angles (2θ±0.2°) of 7.4°, 16.60°, 25.5° and 28.3° respectively in an x-ray diffraction spectrum was mixed with one part of polyvinylbutyral (S-lec BM-S, manufactured by Sekisui Chemical Co., Ltd.) and 100 parts of n-butyl acetate. The mixture was treated in a paint shaker with glass beads to disperse, thereby preparing a coating solution (1). The prepared coating solution (1) was applied to the above anodic oxidation film by using a dip coating method, followed by drying under heating at 100° C. for 10 minutes to form a charge generation layer with a film thickness of 0.15 μm.

2 Parts of a benzidine compound which was the exemplified compound (5-27) and 3 parts of a high molecular compound (viscosity average molecular weight: 39,000) shown by the following base unit 1 were dissolved in 20 parts of chlorobenzene to prepare a coating solution (2). The prepared coating solution (2) was applied to the aforementioned charge generation layer by using a dip coating method, followed by drying under heating at 110° C. for 40 minutes to form a charge transfer layer with a film thickness of 20 μm.

Base Unit 1

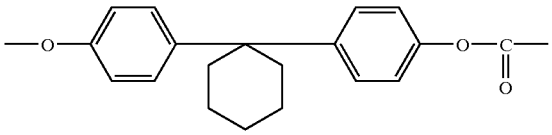

The following structural materials were dissolved in 5 parts of isopropyl alcohol, 3 parts of tetrahydrofuran and 0.3 parts of distilled water, to which was then added 0.5 parts of an ion exchange resin (Amberlist 15E) and the mixture was stirred at ambient temperature for 24 hours to carry out hydrolysis.

| -Structural materials- | |
|---|---|
| Exemplified compound (2) -261 | 2 parts |
| Methyltrimethoxysilane | 2 parts |
| Tetramethoxysilane | 0.5 parts |
| Colloidal silica | 0.3 parts |

After the hydrolysis was finished, 0.04 parts of aluminum trisacetylacetonate and 0.1 parts of 3,5-di-t-butyl-4-hydroxytoluene (BHT) were added to 2 parts of the solution obtained by separating the ion exchange resin from the above mixture by filtration to form a coating solution. This coating solution was applied to the above charge transfer layer by using a ring type dip coating method and air-dried at ambient temperature for 30 minutes, followed by treating under heating at 170° C. for one hour to cure the film to form a protective layer (a layer that contains a siloxane compound having charge-transferability and a crosslinking structure) with a film thickness of 3 μm.

A photoreceptor 1 in which the anodic oxidation film (intermediate layer), the charge generation layer, the charge transfer layer and the protective layer were formed in this order on the surface of the conductive support was produced in this manner.

Photoreceptor 2:

The same procedures as in the preparation of the photoreceptor 1 were conducted except that a coating solution (3) consisting of 20 parts of a zirconium compound (trademark: Organotics ZC540, manufactured by Matsumoto Chemical Industry Co., Ltd.), 2.5 parts of a silane compound (trademark: A1100, manufactured by Nippon Unicar Company Limited) and 45 parts of butanol was prepared and the prepared coating solution (3) was applied to the anodic oxidation film by a dip coating method, followed by drying under heating at 150° C. for 10 minutes to form an intermediate layer consisting of a silane compound and having a film thickness of 0.1 μm, to thereby produce a photoreceptor 2.

The photoreceptor 2 in which the anodic oxidation film (intermediate layer), the intermediate layer, the charge generation layer, the charge transfer layer and the protective layer were formed in this order on the surface of the conductive support was produced in this manner.

Photoreceptor 3:

An acidic processing solution comprising 3 mass % of a mixture solution (Alsurf 401, manufactured by Nippon Paint Co., Ltd.) consisting of phosphoric acid and chromic acid and ion exchange water containing 0.3 mass % of hydrofluoric acid (Alsurf 45, manufactured by Nippon Paint Co., Ltd.) was kept at 45° C. An extrusion-drawn tube (ED tube) (manufactured by Showa Aluminum Corporation) 340 mm long with a diameter of 84 mm which was made of an aluminum alloy of JIS A3003 and had been alkali-degreased was dipped in this processing solution for 10 minutes to carry out dipping treatment. Thereafter the tube was washed with ion exchange water. The ED tube treated in this manner had a cloudy surface exhibiting a green-white color.

A solution consisting of 20 parts of a zirconium compound (trademark: Organotics ZC540, manufactured by Matsumoto Chemical Industry Co., Ltd.), 2.5 parts of a silane compound (trademark: A1100, manufactured by Nippon Unicar Company Limited) and 45 parts of butanol was applied to the outer peripheral surface of the ED tube by a dip coating method, followed by drying under heating at 150° C. for 10 minutes to form an intermediate layer with a film thickness of 0.1 μm.

One part of titanylphthalocyanine having strong diffraction peaks at a Bragg angle (2θ±0.2°) of 27.3° in an X-ray diffraction spectrum was mixed with one part of polyvinylbutyral (S-lec BN-S, manufactured by Sekisui Chemical Co., Ltd.) and 100 parts of n-butyl acetate. The mixture was treated in a paint shaker with glass beads to disperse, thereby preparing a coating solution (4). The prepared coating solution (4) was applied to the above intermediate layer by dip coating, followed by drying under heating at 100° C. for 10 minutes to form a charge generation layer with a film thickness of 0.15 μm.

A charge transfer layer and a protective layer were formed in the same manner as in the case of the photoreceptor 1 to produce a photoreceptor 3.

The photoreceptor 3 in which the intermediate layer, the charge generation layer, the charge transfer layer and the protective layer were formed in this order on the, surface of the conductive support (ED tube) was produced in this manner.

Photoreceptor 4:

A photoreceptor 4 was produced in the same manner as in the case of the photoreceptor 3 except that no intermediate layer was formed on the outer peripheral surface of the ED tube.

The photoreceptor 4 in which the charge generation layer, the charge transfer layer and the protective layer were formed in this order on the surface of the conductive support (ED tube) was produced in this manner.

Photoreceptor 5:

10 Parts of the compound shown as III-13, 4 parts of methylphenylsiloxane, 20 parts: of isopropyl alcohol, 20 parts of tetrahydrofuran and 0.5 parts of distilled water were mixed with each other, to which was then added 0.5 parts of an ion exchange resin (Amberlist 15E) and the mixture was hydrolyzed under stirring for 2 hours at ambient temperature.

After the hydrolysis was finished, 8 parts of 4,4'-dihydroxymethyltriphenylamine and 0.2 parts of aluminum trisacetylacetonate were added to the solution to form a uniform solution. 0.3 mass parts of BHT was added to the solution to prepare a coating solution (5).

The coating solution (5) was applied to the above charge transfer layer by dip coating and cured under heating at 150° C. for one hour to form a protective layer with a dry film thickness of 4 $\mu$m. Except for the above procedures, the same procedures as in the preparation of the photoreceptor 1 was conducted to produce a photoreceptor 5.

The photoreceptor 5 in which the anodic oxidation film (intermediate layer), the charge generation layer, the charge transfer layer and the protective layer were formed in this order on the surface of the conductive support was produced in this manner.

Photoreceptor 6:

An aluminum cylinder substrate (conductive support) obtained by honing an ED tube 340 mm long with a diameter of 84 mm was degreased using a surfactant or a weakly etching degreasing agent and then dipped in pure water at 100° C. for 10 minutes. Thereafter, the conductive support was exposed to 120° C. steam for 10 minutes to carry out boehmite treatment.

Then, an anodic oxidation film and a light-sensitive layer were formed in the same manner as in the case of the photoreceptor 1 to produce a photoreceptor 6.

The photoreceptor 6 in which the charge generation layer, the charge transfer layer and the protective layer were formed in this order on the surface of the conductive support was formed in this manner.

Photoreceptor 7:

A photoreceptor 7 was produced in the same manner as in the case of the photoreceptor 1 except that the anodic oxidation treatment was not performed.

The photoreceptor 7 in which the charge generation layer, the charge transfer layer and the protective layer were formed in this order on the surface of the conductive support was formed in this manner.

Photoreceptor 8:

An aluminum cylinder substrate 340 mm long with a diameter of 84 mm which had been treated by EI processing was subjected to honing processing.

A solution consisting of 20 parts of a zirconium compound (trademark: Organotics ZC540, manufactured by Matsumoto Chemical Industry Co., Ltd.), 2.5 parts of a silane compound (trademark: A1100, manufactured by Nippon Unicar Company Limited), 1.5 parts of polyvinylbutyral resin (Esreck BM-S, manufactured by Sekisui Chemical Co., Ltd.) and 45 parts of butanol was applied to the outer peripheral surface of the aluminum cylinder substrate (conductive support) and dried under heating at 150° C. for 10 minutes to form an intermediate layer with a film thickness of 1.0 $\mu$m. Then, a charge generation layer, a charge transfer layer and a protective layer were formed in the same manner as in the case of the photoreceptor 1 to produce a photoreceptor 8.

The photoreceptor 8 in which the intermediate layer, the charge generation layer, the charge transfer layer and the protective layer were formed in this order on the surface of the conductive support was produced in this manner.

Photoreceptor 9:

A photoreceptor 9 was produced in the same manner as in the case of the photoreceptor 1 except that no protective layer was formed. Specifically, the photoreceptor 9 had a layer structure in which the anodic oxidation film (intermediate layer), the charge generation layer and the charge transfer layer were formed in this order on the surface of the conductive support.

(Production of Toners 1 to 4 and a Carrier)

| -Preparation of a resin particle dispersion- | |
|---|---|
| Styrene | 350 parts |
| Butylacrylate | 50 parts |
| Acrylic acid | 8 parts |
| Carbon tetrabromide | 4 parts |

The above compounds (all of these compounds are manufactured by Wako Pure Chemical Industries, Ltd.) were mixed and dissolved to prepare a mixed solution.

The mixed solution was dispersed and emulsified in a solution prepared by dissolving 8 parts of a nonionic surfactant (trademark: Nonipole 8.5, manufactured by Sanyo Chemical Industries, Ltd.) and 7 parts of an anionic surfactant (trademark: Neogen SC, manufactured by Dai-ichi Kogyo Seiyaku Co., Ltd.) in 585 parts of ion exchange water in a flask. 50 Parts of ion exchange water in which 3 parts of ammonium persulfate (manufactured by Wako Pure Chemical) was dissolved was poured into the resulting solution with mixing the solution gradually over 10 minutes. After the atmosphere in the flask was replaced with nitrogen, the solution in the flask was heated until the temperature of the solution was 70° C. in an oil bath with stirring to continue emulsion polymerization for 6 hours as it was. After that, the reaction mixture was cooled to ambient temperature to prepare a resin particle dispersion.

A part (20 ml) of this resin particle dispersion was allowed to stand on an oven kept at 80° C. to remove water to measure the characteristics of the residue, to find that the residue had a volumetric average particle diameter of 145 nm, a glass transition point of 58° C. and a weight average molecular weight of 22,000.

| Preparation of a colorant dispersion | |
|---|---|
| Phthalocyanine pigment (PVFASTBLUE, manufactured by Dainichiseika Colour & Chemical) | 70 parts |
| Nonionic surfactant (polyoxyethylene octylphenyl ether, oxyethylene 12 mol adduct) | 3 parts |
| Titanium coupling agent (bis(dioctylpirophosphate)oxyacetate titanate | 3 parts |
| Ion exchange water | 300 parts |
| **Preparation of a releasing agent dispersion** | |
| Paraffin wax (HNP0190, manufactured by Nippon Seiro Co., Ltd., melting point: 90° C.) | 100 parts |
| Anionic surfactant (Ripal 860 K, manufactured by Lion Corporation) | 3.5 parts |
| Ion exchange water | 500 parts |

The above compounds were mixed, dissolved and then subjected to dispersion treatment using a homogenizer (Ultratarax, manufactured by IKA) to prepare a colorant dispersion in which a cyan colorant (phthalocyanine pigment) with a volumetric average particle diameter of 160 nm was dispersed.

Preparation of a Toner

Toner 1:

(a) Coagulation Step

| Preparation of coagulated particles | |
|---|---|
| Resin particle dispersion | 300 parts |
| Colorant dispersion | 15 parts |
| Releasing agent dispersion | 25 parts |
| Zinc chloride | 1 part |
| Ion exchange water | 500 parts |

The above compounds were placed in a round type stainless flask and dispersed using a homogenizer (Ultratarax T50, manufactured by IKA). The mixture was heated up to 55° C. in a heating oil bath with stirring.; After the mixture was kept at 55° C. for 30 minutes and observed using an optical microscope, to confirm that coagulated particles having a volumetric average particle diameter of 5.5 μm were formed.

(b) Uniting Step

The pH of the above resin fine particle adhered particle dispersion was measured at 56° C. to find that it was 2.5. An aqueous 1 N NaOH solution was added to this dispersion to adjust the dispersion to pH 5.0 to stabilize the coagulated particles. Then, the dispersion was heated up to 97° C. with continuing stirring and then kept in this condition for 5 hours to unite the adhered particles. Thereafter, the reaction product was separated by filtration and washed thoroughly with ion exchange water, followed by drying using a vacuum drier to obtain a toner 1.

The shape factors SF-1 and SF-2 of the toner 1 were 112 and 104 respectively.

Toner 2:

A toner 2 was produced in the same manner as in the case of the toner 1 except that the pH at 56° C. was adjusted to 5.5 in the uniting step. The shape factors SF-1 and SF-2 of the toner 2 were 125 and 110 respectively.

Toner 3:

A toner 3 was produced in the same manner as in the case of the toner 1 except that the pH at 56° C. was adjusted to 6.0 in the uniting step. The shape factors SF-1 and SF-2 of the toner 3 were 137 and 117 respectively, Toner 4:

A toner 4 was produced in the same manner as in the case of the toner 1 except that the pH at 56° C. was adjusted to 6.5 in the uniting step. The shape factors SF-1 and SF-2 of the toner 4 were 145 and 124 respectively.

Carrier

| | |
|---|---|
| Ferrite (trademark: EFC-35B, manufactured by Powderteck, mass average particle diameter: 35μ) | 100 mass parts |
| Toluene | 13.5 mass parts |
| Methylmethacrylate/perfluorooctylmethacrylate copolymer (polymerization ratio: 80/20, weight average molecular weight: 49,000) | 2.3 mass parts |
| Carbon black (trademark: VXC72, manufactured by Cabot orporation) | 0.3 mass parts |
| Eposter S (melamine resin particles, manufactured by Nippon hokubai Co., Ltd.) | 0.3 mass parts |

Each component excluding the ferrite was dispersed for one hour by using a sand mill to prepare a resin coating layer-forming solution. The prepared resin coating layer-forming solution and the ferrite were placed in a vacuum deaeration type kneader and stirred at 60° C. under reduced pressure for 20 minutes to form a resin coating layer on the ferrite, thereby producing a carrier. The volumetric resistance of the produced carrier was $2\times10^{11}$ Ωcm.

Examples 1 to 10 and Comparative Examples 1 and 2

As shown in the following table, 1.0 parts of negatively chargeable silica, 0.5 parts of negatively chargeable titania and a fixed amount of each hydrotalcite compound differing in percentage composition were added to 100 parts of each of the produced toners 1 to 4 to produce external additive toners. 8 Parts of this external additive toner was added to and mixed with 100 parts of the carrier to produce a developing agent.

The volumetric average particle diameter of a powder of each hydrotalcite compound fell in a range from 0.2 to 0.5 μm

TABLE 62

| | Toner | Hydrotalcite compound | | Photo- | Charge amount of a |
|---|---|---|---|---|---|
| | particle No. | Composition | Content (parts) | receptor No. | toner (μC/g) |
| Example 1 | 1 | $Mg_{0.7}Al_{0.3}(OH)_2(CO_3)_{0.15}.0.57H_2O$ | 0.2 | 1 | −35.5 |
| Example 2 | 2 | $Mg_{0.8}Al_{0.2}(OH)_2(CO_3)_{0.10}.0.61H_2O$ | 0.4 | 1 | −30.5 |
| Example 3 | 3 | $Mg_{0.75}Al_{0.25}(OH)_2(CO_3)_{0.125}.0.50H_2O$ | 0.2 | 1 | −33.6 |
| Example 4 | 2 | $Mg_{0.8}Al_{0.2}(OH)_2(CO_3)_{0.10}.0.61H_2O$ | 0.4 | 2 | −30.5 |
| Example 5 | 3 | $Mg_{0.75}Al_{0.25}(OH)_2(CO_3)_{0.125}.0.50H_2O$ | 0.2 | 3 | −33.6 |
| Example 6 | 3 | $Mg_{0.75}Al_{0.25}(OH)_2(CO_3)_{0.125}.0.50H_2O$ | 0.6 | 4 | −32.5 |
| Example 7 | 2 | $Mg_{0.8}Al_{0.2}(OH)_2(CO_3)_{0.10}.0.61H_2O$ | 0.4 | 5 | −30.5 |
| Example 8 | 4 | $Mg_{0.8}Al_{0.2}(OH)_2(CO_3)_{0.10}.0.61H_2O$ | 0.4 | 6 | −32.5 |
| Example 9 | 2 | $Mg_{0.8}Al_{0.2}(OH)_2(CO_3)_{0.10}.0.61H_2O$ | 0.4 | 7 | −30.5 |
| Example 10 | 3 | $Mg_{0.8}Al_{0.2}(OH)_2(CO_3)_{0.10}.0.61H_2O$ | 0.4 | 8 | −32.6 |

TABLE 62-continued

| | Toner particle No. | Hydrotalcite compound Composition | Content (parts) | Photo-receptor No. | Charge amount of a toner ($\mu$C/g) |
|---|---|---|---|---|---|
| Comparative example 1 | 2 | — | — | 1 | −35.7 |
| Comparative example 2 | 3 | $Mg_{0.8}Al_{0.2}(OH)_2(CO_3)_{0.10}.0.61H_2O$ | 0.4 | 9 | −32.6 |

The photoreceptor of DocuColor 1250 (roller diameter: 8 mm, thickness of an elastic layer: 3 mm) manufactured by Fuji Xerox Co., Ltd. reformed to a contact charging system by changing a corotron charger to a roller-like member having an elastic layer on the surface thereof was changed to the photoreceptors 1 to 9 manufactured as shown in the above table to make a durability test as explained below.

First, the produced developing agent was placed in a developing machine for a cyan developing agent and the developing machine was set to a prescribed position. Full-color mode printing was carried out continuously without setting other black, yellow and magenta developing machines to form 5000 prints a day. A cartridge was prepared and set to a prescribed position and only a toner was supplied. When electrifying the roller member, voltage obtained by superimposing a d.c. current component on an a.c. constant current mode was applied to the roller member to electrify the surface of the photoreceptor. The Bias condition of developing was as follows: VH: −510 V, VL: −200 V and developing Bias: −410 V. As the paper used in the continuous printing, PPC paper (L, A4) manufactured by Fuji Xerox Co., Ltd. was used. The results obtained by printing under an environment of about 28° C. and 85% RH are shown in the above table.

In this operation, the photoreceptor made about 4 revolutions per print and the print was made from the start until 100000 sheets (400000 cycles).

In the above table, the charge amount of a toner is a value obtained by an image analysis in CSG (charge spectrograph method).

Further, the image quality was determined by observing a 256-gradation pattern and a 400-line resolution pattern visually. The results are shown in the following table.

Each developing agent and each photoreceptor were combined to obtain Examples 1 to 10 and Comparative Examples 1 and 2 as shown in the above table.

TABLE 63

| | Change in image quality | | | | |
|---|---|---|---|---|---|
| | After 2 days (5000 copies) | After 3 days (10000 copies) | After 5 days (20000 copies) | After 10 days (45000 copies) | After 20 days (95000 copies) |
| Example 1 | Good | Good | Good | Good | Good |
| Example 2 | Good | Good | Good | Good | Good |
| Example 3 | Good | Good | Good | Good | Good |
| Example 4 | Good | Good | Good | Good | Good |
| Example 5 | Good | Good | Good | Good | Good |
| Example 6 | Good | Good | Good | Good | Good |
| Example 7 | Good | Good | Good | Good | Good |
| Example 8 | Good | Good | Good | Good | Image flow occurs |

TABLE 63-continued

| | Change in image quality | | | | |
|---|---|---|---|---|---|
| | After 2 days (5000 copies) | After 3 days (10000 copies) | After 5 days (20000 copies) | After 10 days (45000 copies) | After 20 days (95000 copies) |
| Example 9 | Good | Good | Good | Good | Interference fringes are generated, Black dots are generated |
| Example 10 | Good | Good | Good | Good | Black dots are generated |
| Comparative example 1 | Good | Image flow occurs | Image flow is impaired | — | — |
| Comparative example 2 | Good | Good | Black lines lines are generated | Black lines are increased | — |

In Examples 1 to 10, each photoreceptor had the layer (hereinafter referred to as "siloxane type crosslinking cured film" as the case may be) having charge-transferability and containing a siloxane compound having a crosslinking structure and the compound having acid-adsorbing ability was supplied to the surface of the photoreceptor. Therefore, high quality images were obtained from the start next morning after the continuous printing.

However, in Examples 8 to 10, a print image of a 95000th print obtained at the start on the morning of 20th day was confirmed to find an image defect shown in the table In Comparative Example 1 using a toner containing no hydrotalcite compound, image flow was confirmed on a print obtained at the start of the morning of 3rd day. The image flow was afterward improved after 100 prints were made. However, this image defect was confirmed on prints obtained at the start on the morning of 4th day and 5th day, showing that this example had a problem.

In Comparative Example 2 in which the protective layer of the photoreceptor had no siloxane type crosslinking cured film, there was no image problem until 4th day. However, black lines were observed on 5th day and were not improved even if the printing was continued. When observing the surface of the photoreceptor, fine scratches in the direction of revolution were observed and clear adhere, substances were seen in a part of scratches. The black lines in images corresponded to these adhered substances.

Examples 11 to 18 and Comparative Examples 3 to 5

The photoreceptor of DocuColor 1250 (roller diameter: 8 mm, thickness of an elastic layer: 3 mm) manufactured by Fuji Xerox Co., Ltd. reformed to a contact charging system by changing a corotron charger to a roller-like member having an elastic layer on the surface thereof was changed to the photoreceptors 1 to 9 manufactured as shown in the following table to make a durability test as explained below.

First, a roller obtained by producing acrylic conductive brush having a monofilament thickness of 15 deniers and a fiber density of $9.3\times10^2$ f/cm$^2$ such that the outside diameter of the brush became 10 mm on a SUS core bar 4 mm in diameter was placed on the upstream portion of the cleaning blade such that the amount of the bite was 1 mm. The roller was set so as to rotate in a direction forward to the photoreceptor such that it synchronizes with the photoreceptor at a rotation of 500 rpm. It is to be noted that "f" of the unit f/cm$^2$ of the above fiber density is an abbreviation of filament and indicates the number of filaments per 1 cm$^2$.

Also, a bar-like flicker, (formed by compressive molding and having a diameter of 5 mm and a length of 320 mm) containing a hydrotalcite compound to dust off a toner was disposed on the position facing the photoreceptor such that the amount of the bite was 1 mm.

The flicker was produced by selecting or mixing hydrotalcite of $Mg_{0.1}Al_{0.3}(OH)_2(CO_3)_{0.15}.0.57H_2O$, PMMA (methacryl resin), cerium oxide and SUS appropriately as shown in the following table and by compression-molding the mixture bar-wise.

Also, the above compounds were combined to prepare Examples 11 to 18 and Comparative Examples 3 to 5.

TABLE 64

| | Toner particle No. | Composition of a flicker | photoreceptor No. | (μC/g) |
|---|---|---|---|---|
| Example 11 | 1 | Hydrotalcite compound (70 mass %) + PMMA (30 mass %) | 1 | −35.5 |
| Example 12 | 2 | Hydrotalcite compound (30 mass %) + PMMA (70 mass %) | 2 | −33.6 |
| Example 13 | 3 | Hydrotalcite compound (70 mass %) + PMMA (30 mass %) | 3 | −31.0 |
| Example 14 | 1 | Hydrotalcite compound (30 mass %) + PMMA (70 mass %) | 4 | −35.5 |
| Example 15 | 2 | Hydrotalcite compound (30 mass %) + PMMA (40 mass %) + cerium oxide (30 mass %) | 5 | −33.6 |
| Example 16 | 3 | Hydrotalcite compound (70 mass %) + PMMA (30 mass %) | 6 | −31.0 |
| Example 17 | 1 | Hydrotalcite compound (70 mass %) + PMMA (30 mass %) | 7 | −35.5 |
| Example 18 | 2 | Hydrotalcite compound (70 mass %) + PMMA (30 mass %) | 8 | −33.6 |
| Comparative example 3 | 1 | Made of SUS | 1 | −35.5 |
| Comparative example 4 | 2 | Hydrotalcite compound (70 mass %) + PMMA (30 mass %) | 9 | −33.6 |
| Comparative example 5 | 2 | PMMA (100 mass %) | 1 | −33.6 |

The produced developing agent was placed in a developing machine for a cyan developing agent and the developing machine was set to a prescribed position. Full-color mode printing was carried out continuously without setting other black, yellow and magenta developing machines to form 5000 prints a day. A cartridge was prepared and set to a prescribed position and only a toner was supplied. When electrifying the roller member, voltage obtained by superimposing a d.c. current component on an a.c. constant current mode was applied to the roller member to electrify the surface of the photoreceptor. The Bias condition of developing was as follows: VH: −510 V, VL: −200 V and developing Bias: −410 V. As the paper used in the continuous printing, PPC paper (L, A4) manufactured by Fuji Xerox Co., Ltd. was used. The results obtained by printing under an environment of about 28° C. and 85% RH are shown in the above table.

In this operation, the photoreceptor 1 made about 4 revolutions per print and the print was made from the start until 100000 sheets (400000 cycles).

In the above table, the charge amount of a toner is a value obtained by an image analysis in CSG (charge spectrograph method).

Further, the image quality was determined by observing a 256-gradation pattern and a 400-line resolution pattern visually. The results are shown in the following table.

TABLE 65

| | Change in image quality | | | | |
|---|---|---|---|---|---|
| | After 2 days (5000 copies) | After 3 days (10000 copies) | After 5 days (20000 copies) | After 10 days (45000 copies) | After 20 days (95000 copies) |
| Example 11 | Good | Good | Good | Good | Good |
| Example 12 | Good | Good | Good | Good | Good |
| Example 13 | Good | Good | Good | Good | Good |
| Example 14 | Good | Good | Good | Good | Good |
| Example 15 | Good | Good | Good | Good | Good |
| Example 16 | Good | Good | Good | Good | Interference fringes are generated, Black dots are generated |
| Example 17 | Good | Good | Good | Good | Black dots are generated |
| Example 18 | Good | Good | Good | Good | Image flow occurs |

TABLE 65-continued

| | Change in image quality | | | | |
|---|---|---|---|---|---|
| | After 2 days (5000 copies) | After 3 days (10000 copies) | After 5 days (20000 copies) | After 10 days (45000 copies) | After 20 days (95000 copies) |
| Comparative example 3 | Good | Image flow occurs | Image flow is impaired | — | — |
| Comparative example 4 | Good | Good | Black lines are generated | Black lines are increased | — |
| Comparative example 5 | Good | Image flow occurs | Image flow is impaired | — | — |

In examples 11 to 18, each photoreceptor had the layer having charge-transferability and containing a siloxane compound having a crosslinking structure and the compound having acid-adsorbing ability was supplied to the surface of the photoreceptor. Therefore, high quality images were obtained from the start next morning after the continuous printing.

However, in Examples 16 to 18, a print image of a 95000th print obtained at the start on the morning of 20th day was confirmed to find an image defect shown in the table.

When using the flicker to which no hydrotalcite compound was not supplied as in Comparative Examples 3 and 5, image flow was confirmed on a print obtained at the start of the morning of 3rd day. The image flow was afterward improved after 100 prints were made. However, this image defect was confirmed on prints obtained at the start on the morning of 4th day and 5th day, showing that this example had a problem.

When using the photoreceptor in which the protective layer of the photoreceptor had no siloxane type crosslinking cured film as in Comparative Example 4, there was no image problem until 4th day. However, black lines were observed on 5th day and were not improved even if the printing was continued. When observing the surface of the photoreceptor, fine scratches in the direction of revolution were observed and clear adhered substances were seen in a part of scratches. The black lines in images corresponded to these adhered substances.

According to the invention, it is possible to provide an image forming method, a process cartridge and an image forming apparatus which ensure that an electrophotographic image having superior image quality and fixing ability is obtained for a long period of time.

It is also possible to provide an image forming method, a process cartridge and an image forming apparatus which ensure that good cleaning characteristics are secured and a good electrophotographic image is obtained even under a high temperature and highly wet environment.

What is claimed is:

1. An image forming method comprising:

developing, with a developing agent, an electrostatic latent image formed on a surface of a photoreceptor to form a toner image;

transferring the toner image onto an image receiving member to form a transferred image; and fixing the transferred image onto the image receiving member to form an image, wherein the photoreceptor includes a layer that contains a siloxane compound having charge-transferability and a crosslinking structure, with a compound having acid-adsorbing ability being supplied to the surface of the photoreceptor.

2. The image forming method according to claim 1, wherein the compound having acid-adsorbing ability is a compound having anion-exchangeability.

3. The image forming method according to claim 2, wherein the compound having anion-exchangeability is a hydrotalcite compound.

4. The image forming method according to claim 1, wherein the compound having acid-adsorbing ability is a compound adsorbing an acid.

5. The image forming method according to claim 1, wherein the compound having acid-adsorbing ability is supplied to the surface of the photoreceptor together with the developing agent.

6. The image forming method according to claim 1, wherein the compound having acid-adsorbing ability is supplied to the surface of the photoreceptor through an auxiliary cleaning member.

7. The image forming method according to claim 1, wherein the toner is negatively chargeable.

8. The image forming method according to claim 1, wherein shape factors SF-1 and SF-2 of the toner respectively satisfy expressions (1) and (2), and the average particle diameter of the toner is 3 $\mu$m or more and 11 $\mu$m or less:

$$100 \leqq SF\text{-}1 \leqq 140 \quad (1)$$

$$100 \leqq SF\text{-}2 \leqq 120 \quad (2)$$

provided that SF-1=(maximum length of diameter)$^2\times 100\pi/4$ and SF-2=(peripheral length of projected image)$^2\times 100/4$).

9. A process cartridge used in the image forming method of claim 1, the process cartridge comprising at least:

a photoreceptor including a layer that contains a siloxane compound having charge-transferability and a crosslinking structure; and supply means for supplying a compound having acid-adsorbing ability to a surface of the photoreceptor.

10. An image forming apparatus comprising a photoreceptor, latent image forming apparatus for forming an electrostatic latent image formed on a surface of the photoreceptor, a developing device for developing the latent image using a toner, and a transfer device for transferring the toner image to an image receiving member, wherein the photoreceptor includes at least a layer that contains a siloxane compound having charge-transferability and a crosslinking structure, and supply means for supplying a compound having acid-adsorbing ability to the surface of the photoreceptor.

11. The image forming apparatus according to claim 10, further comprising a cleaning device for removing residual toner from the surface of the photoreceptor after transfer.

12. The image forming apparatus according to claim 10, wherein the compound having acid-adsorbing ability is a compound having anion-exchangeability.

13. The image forming apparatus according to claim 10, wherein the compound having acid-adsorbing ability is a compound adsorbing an acid.

14. The image forming apparatus according to claim 10, wherein the compound having anion-exchangeability is a hydrotalcite compound.

15. The image forming apparatus according to claim 10, wherein the compound having acid-adsorbing ability is supplied to the surface of the photoreceptor by the developing device.

16. The image forming apparatus according to claim 10, wherein the compound having acid-adsorbing ability is supplied to the surface of the photoreceptor through an auxiliary cleaning member.

17. The image forming apparatus according to claim 10, wherein the toner is negatively chargeable.

18. The image forming apparatus according to claim 10, wherein shape factors SF-1 and SF-2 of the toner respectively satisfy expressions (1) and (2), and the average particle diameter of the toner is 3 $\mu$m or more and 11 $\mu$m or less:

$$100 \leqq SF\text{-}1 \leqq 140 \quad (1)$$

$$100 \leqq SF\text{-}2 \leqq 120 \quad (2)$$

provided that SF-1=(maximum length of diameter)$^2\times 100\pi/4$ and

SF-2=(peripheral length of projected image)$^2\times 100/4$).

* * * * *